US007222927B2

(12) United States Patent
Eguchi et al.

(10) Patent No.: US 7,222,927 B2
(45) Date of Patent: May 29, 2007

(54) LIQUID DISCHARGE DEVICE AND LIQUID DISCHARGE METHOD

(75) Inventors: Takeo Eguchi, Kanagawa (JP); Kazuyasu Takenaka, Tokyo (JP); Iwao Ushinohama, Kanagawa (JP); Yuichiro Ikemoto, Kanagawa (JP); Yukihiro Ohzeki, Kanagawa (JP)

(73) Assignee: Sony Corporation (JP)

( * ) Notice: Subject to any disclaimer, the term of this patent is extended or adjusted under 35 U.S.C. 154(b) by 489 days.

(21) Appl. No.: 10/730,135

(22) Filed: Dec. 9, 2003

(65) Prior Publication Data

US 2004/0189727 A1 Sep. 30, 2004

(30) Foreign Application Priority Data

Dec. 12, 2002 (JP) ..... P2002-360408
Mar. 3, 2003 (JP) ..... P2003-055236

(51) Int. Cl.
*B41J 29/38* (2006.01)

(52) U.S. Cl. ..... 347/12; 347/62; 347/57

(58) Field of Classification Search ..... 347/15, 347/40, 43, 41, 16, 65, 12, 62, 57
See application file for complete search history.

(56) References Cited

U.S. PATENT DOCUMENTS 4,575,730 A 3/1986 Logan et al.
5,754,201 A * 5/1998 Ishinaga et al. ..... 347/62

FOREIGN PATENT DOCUMENTS

| | | |
|---|---|---|
| EP | 1 167 038 | 1/2002 |
| EP | 1 201 435 A2 | 5/2002 |
| EP | 1 354 704 A1 | 10/2003 |
| EP | 1 555 125 | 10/2003 |
| EP | 1 369 248 A1 | 12/2003 |
| EP | 1 419 887 | 5/2004 |
| EP | 1 568 505 | 8/2005 |
| JP | 2002-036522 | 2/2002 |

OTHER PUBLICATIONS

EPO Search Report Mar. 11, 2004.
EPO Search Report mailed Apr. 25, 2006.

* cited by examiner

*Primary Examiner*—Lamson Nguyen
(74) *Attorney, Agent, or Firm*—Rader, Fishman, & Grauer PLLC; Ronald P. Kananen

(57) ABSTRACT

With a liquid discharge device, a maximum of N liquid droplets are discharged so as to land within each pixel region for forming a pixel corresponding to the pixel region, a target landing position is selected at random for each liquid droplet, from M liquid landing position candidates, forming an array in the direction of an array of nozzles, determined such that at least a part of the landing liquid droplet region corresponding to each landing position candidate is included within the pixel region, and the discharge direction of the liquid droplet is controlled such that the liquid droplet lands at the determined target landing position. The liquid discharge device having such a configuration has the advantage of preventing occurrence of streaks between dot columns in a printed image due to irregularities in an array of discharge portions.

26 Claims, 24 Drawing Sheets

FIG. 18A

| STATE OF THE SWITCHES | | | | LANDING POSITION OF DOTS | | | | | | | |
|---|---|---|---|---|---|---|---|---|---|---|---|
| Dpx | D6 | D5 | D4 | −3 | −2 | −1 | 0 | +1 | +2 | +3 | |
| 0 | 0 | 0 | 0 | | | | ● | | | | |
| | | 1 | | | | ● | | | | | |
| | 1 | 0 | | | ● | | | | | | |
| | | 1 | | ● | | | | | | | |
| 1 | 0 | 0 | | | | | ● | | | | |
| | | 1 | | | | | | ● | | | |
| | 1 | 0 | | | | | | | ● | | |
| | | 1 | | | | | | | | ● | |

FIG. 18B

| STATE OF THE SWITCHES | | | | LANDING POSITION OF DOTS | | | | | | | |
|---|---|---|---|---|---|---|---|---|---|---|---|
| Dpx | D6 | D5 | D4 | 0 | 1 | 2 | 3 | 4 | 5 | 6 | 7 |
| 0 | 1 | 1 | 1 | ● | | | | | | | |
| | | 0 | | | ● | | | | | | |
| | 0 | 1 | | | | ● | | | | | |
| | | 0 | | | | | ● | | | | |
| 1 | 0 | 0 | | | | | | ● | | | |
| | | 1 | | | | | | | ● | | |
| | 1 | 0 | | | | | | | | ● | |
| | | 1 | | | | | | | | | ● |

LIQUID DISCHARGE DEVICE AND LIQUID DISCHARGE METHOD

BACKGROUND OF THE INVENTION

1. Field of the Invention

The present invention relates to a liquid discharge device and liquid discharge method for discharging liquid droplets, and more particularly to a liquid discharge device and liquid discharge method for providing improved image quality.

2. Description of the Related Art

In general, conventional ink jet printers, which are a kind of liquid discharge device, include a head wherein ink discharge portions, each having a nozzle, are linearly disposed. With such ink jet printers, minute liquid droplets (ink droplets) are discharged onto a recording medium such as a printing paper sheet or the like, disposed so as to face the nozzle face, from each ink discharge portion of the head, so as to form generally-round-shaped dots on the recording medium, such that image pixels are formed of single or multiple dots. Furthermore, the image pixels are two-dimensionally arrayed, thereby forming images or characters.

On the other hand, with the ink jet printers, liquid droplets are discharged with some irregularity due to the configuration thereof. With regard to the dot array on the recording medium, formed of ink droplets discharged thereon, random irregularities are less conspicuous due to the irregularities being evened out. However, directional irregularities due to positioning of the liquid discharge portions (head) are markedly conspicuous, even in the event the amount of the irregularities is minute.

FIG. 21, consisting of FIGS. 21A, 21B, and 21C, is a diagram for describing irregularities in a dot array. In FIG. 21, the portions denoted by the arrows indicate the printing results in cases of directional irregularities occurring in the right direction in the drawing, by 1/36, 1/12, and 1/4, of the dot pitch (the distance between the center positions of adjacent dots), with three dot sizes of "small", "medium", and "large", respectively.

As can be understood from FIG. 21, in the event that a dot array is printed with directional irregularities of around 10%, the irregularities can be visibly observed. In the event that a dot array is printed with the directional irregularities of around 20% or more, the irregularities are markedly conspicuous, and in general, such irregularities are recognized as being defective. Note that whether or not the irregularities in dot pitch are conspicuous depends upon the color of the ink, as well. For example, the irregularities in dot pitch in yellow are relatively more permissible than with other colors (i.e., the irregularities in yellow are conspicuous less than with other colors).

Conventionally, two methods, which will be described below, are known for solving the above-described problem of irregularities in dot pitch for a liquid discharge device employing a serial method wherein the head is linearly and reciprocally moved in the horizontal direction as to the recording medium, as well as the recording medium being transported in the direction generally vertical to the aforementioned reciprocal movement. Note that, with the serial method, the direction of the reciprocal movement of the head will be referred to as "main scanning direction", and the direction generally vertical to the main direction (i.e., the direction for transporting a recording medium) will be referred to as "sub-scanning direction" hereafter, in the present specification.

A first method is to overlap the adjacent dots such that undesirable unprinted portions do not occur, even in the event that printing is performed with some irregularities in dot pitch. That is to say, the size of each dot (the diameter of the each dot) is increased corresponding to the dot pitch. With an arrangement using this method wherein the dot diameter is determined to be equal to or greater than $\sqrt{2}$ times the dot pitch (i.e., equal to or greater than the distance between the center positions of the diagonally-adjacent dots) under an assumption that dots are formed in a round shape, the gap between the adjacent dots does not occur as long as normal printing is performed, and furthermore, even in the event that printing is performed with some irregularities in dot pitch, the irregularities are less conspicuous, thereby preventing undesirable white streaks on an image.

FIG. 22 is a diagram which shows an example of the printing results in a case of the same positional irregularities in a dot column as in FIG. 21, with an overall dot size a little greater than $\sqrt{2}$ times as great as the dot pitch.

On the other hand, a second method is known as "double printing method". With the double printing method, large-sized dots used in the first method are not employed, but printing is performed twice. Specific description will be made below. Let us say that printing is performed with some irregularities in a dot array. In this case, following the first printing, undesirable unprinted gaps occur. With the second method, the second printing is performed so as to fill the unprinted gaps. FIG. 23 is a diagram which shows printing results obtained with the double printing method which is referred to here as the second method. In FIG. 23, different hatching patterns denote dots formed at different times of main scanning, or formed with different heads. The double printing method is applied not only to printing in the main scanning direction, but also may be applied to printing in the sub-scanning direction as well, thereby forming an image with small-sized dots.

On the other hand, a line method is known as another printing method other than the aforementioned serial method, wherein a liquid discharging apparatus includes a head with a length over the entire length of a recording medium (the entire range of a recording medium in the main scanning direction of the serial method). In general, the liquid discharging apparatus includes a stationary head, and only the recording medium is transported.

Note that with the line method, the transporting direction for the recording medium will be referred to as the "main scanning direction" in the present specification.

With the line method, it can be easily understood that the head with a length over the entire length of the recording medium, integrally formed on a silicon or glass substrate, exhibits improved properties such as improved precision of array of the liquid discharging portions, and the like. However, in actual practice, it is almost impossible to manufacture a head having such a configuration due to various kinds of problems, such as manufacturing method, a small yielding percentage, overheating, costs, and the like.

Accordingly, a line head for mounting an ink jet printer is known, wherein multiple small-sized head chips are arrayed with the adjacent ends being into contact with each other, and each head chip is driven according to predetermined signals so as to print on a recording medium, thereby performing printing over the entire length of the recording medium in the step of printing on the recording medium (see Japanese Unexamined Patent Application Publication No. 2002-36522, for example). Note that manufacturing of the aforementioned head chip also has various kinds of limitations, and the length thereof in the direction of the liquid discharge portion array is limited to 1 inch or shorter at the most, which is a practical limit.

However, the above-described conventional methods have problems as follows.

First, the first method for the serial method (the technique wherein the dot size is increased) has an advantage with regard to irregularities in dot positions, but leads to a problem of conspicuous dot roughness due to an increase of the dot size. Accordingly, with printing images requiring intermediate tones, such as photographs, a problem occurs in that the sensation of image roughness increases.

On the other hand, with the second method for the serial method (double printing), there is no need to employ large-sized dots, unlike the aforementioned first method, and accordingly, the sensation of image roughness is reduced over the entire image, thereby improving printing image quality, and the like. However, there is the need to form a great number of dots in both the main scanning direction and the sub-scanning direction, leading to a problem of low recording speed. In order to solve this problem, a great number of the liquid discharge portions must be moved at a speed as high as possible, often leading to a problem of reduction of reliability and a problem of high costs.

On the other hand, while an arrangement employing the line method may employ the above-described first method wherein large-sized dots are employed so as to reduce the influence of irregularities in discharge from the liquid discharge portions, the same problem occurs as with the aforementioned serial method arrangement employing the first method.

Furthermore, with the line method arrangement, multiple head chips are connected one to another, often leading to a problem of a margin of error in the array intervals. Furthermore, there is a problem in that the thickness and the like of these multiple head chips is not always uniform. The influence of such margins of error often reaches a level several times as great as the influence of irregularities in the discharge angle of liquid droplets occurring in a single head chip.

Note that the line method arrangement includes a stationary head, and accordingly, double printing, wherein a second print is made over the region where a first print has been made, cannot be performed. That is to say, the line method arrangement cannot employ the second method, unlike the aforementioned serial method arrangement employing the second method.

However, with a special modification of the parallel method arrangement, wherein a single recording medium is fed in and out several times while moving the position of the head a little, double printing can be performed under the condition that a stiff recording medium is used, and the object of printing is a photograph (as with a sublimation printer or the like). However, it is difficult to move the head only in the horizontal direction (the direction of the width of the recording medium, i.e., the direction vertical to the main scanning direction of the line method arrangement). Furthermore, unlike the sublimation printer, the ink jet printer requires some period of time for drying the dots arrayed on the recording medium (ink dots which have landed on the recording medium), and accordingly, the operation wherein the single recording medium is fed in and out is repeated several times without any protection prior to the ink dots becoming sufficiently dry, leads to a risk of smearing.

Furthermore, in this case, the available recording medium is restricted to a special one, i.e., a general recording medium such as a normal paper sheet, or the like, cannot be used. Furthermore, a general line-method arrangement has the advantage of high-speed recording. However, in the event that the line-method arrangement employs the aforementioned second method, the recording speed is reduced, leading to reduction of the advantage of the line-method arrangement. Accordingly, in the event that the line-method arrangement is to employ the double printing without such restrictions while maintaining the advantage of high-speed recording, the double printing can be performed only in the transporting direction for the recording medium, i.e., the main scanning direction.

In this case, while the line-method arrangement has the advantage of an improved image tone due to double printing, the double printing only in the main scanning direction has only the advantage of the improved image tone, but has no advantage of leveling of the influence due to irregularities in discharge.

As described above, the ink dots in a single line in the main scanning direction are formed by discharging from a single liquid discharge portion, and accordingly, the distance between the center positions of the adjacent ink dots in the main scanning direction exhibits high precision. On the other hand, each of the ink dots in the sub-scanning direction are formed by discharging from different liquid discharge portions, leading to great irregularities in the distance between the center positions of the adjacent ink dots in the sub-scanning direction.

From the reasons described above, the line-method arrangement without sub-scanning often has a problem that conspicuous streaks occur in an image in the sub-scanning direction due to irregularities in the array of the liquid discharge portions.

Furthermore, the serial-method arrangement employing the second method (double printing) has the advantage that in the event that malfunctioning occurs in a part of liquid discharge portions of the head, such as malfunctioning wherein ink cannot be discharged, or the like, the second method (double printing) is performed, whereby defects on the recording medium due to malfunctioning of discharge or the like becomes less conspicuous.

On the other hand, the line-method arrangement cannot employ the aforementioned second method as described above. Accordingly, even in the event that malfunctioning, such as non-discharge or the like, occurs in a small number of liquid discharge portions, correction cannot be performed for the defects occurring due to the malfunctioning, directly leading to deterioration in image quality due to malfunctioning of the head.

SUMMARY OF THE INVENTION

Accordingly, it is an object of the present invention to provide a liquid discharge device having the advantage of reduction of positional irregularities in dot columns, and in particular, with the serial-method arrangement, to provide a liquid discharge device having the advantage of preventing occurrence of streaks between dot columns due to irregularities in an array of discharge portions, using the technique for performing liquid-droplet discharge with deviation, which has been proposed by the present inventors (e.g., Japanese Unexamined Patent Application Publication No. 2002-320861, Japanese Unexamined Patent Application Publication No. 2002-320862, and Japanese Unexamined Patent Application Publication No. 2003-37343, which are undisclosed techniques, have relation to the present invention, and are not conventional techniques), which will be referred to as "first object" hereafter.

Furthermore, it is an object thereof to provide a liquid discharge device having the advantage of the fact that even in the event that malfunctioning such as non-discharge or the like occurs in a part of the liquid discharge portions, occurrence of streaks or the like is prevented, as well as the positional irregularities in landing positions of liquid droplets becoming less conspicuous, which will be referred to as "second object" hereafter.

Description will be made below regarding a liquid discharge device for solving the above-described problems.

A liquid discharge device according to the present invention for solving the aforementioned first object comprises a head wherein deviation of the discharge direction of a liquid droplet, discharged from a liquid discharge portion having a nozzle, can be controlled so as to be selected from multiple directions along a predetermined direction, multiple liquid droplets are discharged so as to land on each pixel region for forming a pixel corresponding to the pixel region, a target landing position of a liquid droplet which is to be discharged on each pixel region is determined at random, and the discharge direction of the liquid droplet which is to be discharged from the liquid discharge portion is controlled such that the liquid droplet lands at the determined target landing position.

With the above-described invention, each liquid discharge portion of the head has a configuration wherein a liquid droplet can be discharged in a direction selected from multiple discharge direction candidates.

Furthermore, with each pixel region, an M number of target landing position candidates of a liquid droplet are determined along a predetermined direction. Note that at least a part of the landing liquid droplet region corresponding to each landing position candidate is included within the pixel region.

At the time of discharging a liquid droplet onto the pixel region, a target landing position is selected at random, from M target liquid landing position candidates, and the liquid droplet is discharged so as to land at the determined target landing position.

Thus, the liquid droplet lands at the pixel region such that at least a part of the landing liquid droplet region is included within the pixel region, with random deviation as to the pixel region. This reduces the maldistribution of the landing positions of liquid droplets due to irregularities in the properties of the liquid discharge portions or the like, whereby overall arrays thereof follow a uniform and isotropic distribution.

A liquid discharge device including a head including multiple liquid discharge portions, each having a nozzle, arrayed in a predetermined direction, wherein a maximum of N (N denotes a positive integer) liquid droplets are discharged so as to land on each pixel region for forming a pixel corresponding to the pixel region, according to another aspect of the present invention comprises: discharge direction varying means for controlling the discharge direction of a liquid droplet discharged from the nozzle of each liquid discharge portion such that deviation of the landing position occurs in the predetermined direction; first discharge control means for performing discharge control using the discharge direction varying means such that ink liquid droplets are discharged from at least the two different liquid discharge portions positioned close one to another, in the discharge directions different one from another, so as to land at the same pixel column or the same pixel region for forming a pixel column or a pixel; and second discharge control means for performing discharge control using the discharge direction varying means such that a landing position is selected for each liquid-droplet discharge from the liquid discharge portion, from M (M denotes an integer of 2 or more) of different landing position candidates forming an array in the predetermined direction, determined such that at least a part of the landing liquid droplet region corresponding to each landing position candidate is included within the pixel region, and a liquid droplet is discharged so as to land at the determined landing position.

With the above-described invention, at least two different liquid discharge portions positioned close one to another can discharge liquid droplets with different deviation of the discharge angle, for forming a single pixel column or a single pixel. For example adjacent liquid discharge portions N and (N+1) each can discharge liquid droplets so as to land at the same pixel region or the same pixel region column.

Thus, a pixel or pixel column can be formed using multiple different liquid discharge portions.

Furthermore, a target landing position of a liquid droplet for each pixel region is selected from M different landing position candidates along the predetermined direction. Note that at least a part of the landing liquid droplet region corresponding to each landing position candidate is included within the pixel region.

At the time of discharging a liquid droplet onto the pixel region, a target landing position is selected from M target liquid landing position candidates, and the liquid droplet is discharged so as to land at the determined target landing position.

Thus, the liquid droplet lands at the pixel region such that at least a part of the landing liquid droplet region is included within the pixel region, with positional irregularities within the pixel region. This reduces the maldistribution of the landing positions of liquid droplets due to irregularities in the properties of the liquid discharge portions or the like, whereby overall dot columns follow a uniform and isotropic distribution.

BRIEF DESCRIPTION OF THE DRAWINGS

FIG. 18, consisting of FIGS. 18A and 18B, shows a table which shows the relation between the on/off states of the polarity conversion switch and first discharge control switch, and the landing position of the dot along the direction of an array of nozzles;

DESCRIPTION OF THE PREFERRED EMBODIMENTS

First Embodiment

Description will be made regarding a first embodiment of the present invention with reference to the drawings and the like. The first embodiment has been made generally in order to achieve the first object of the present invention. Note that the term "ink droplet" used here means a small amount (e.g., several picoliters) of ink (liquid) discharged from a nozzle 18 of a liquid discharge portion described later. Also, the term "dot" used here means a dot formed of one ink droplet discharged on a recording medium such as a printing paper sheet or the like. Also, the term "pixel" used here is the smallest increment of an image, and the term "pixel region" used here means a region for forming the pixels.

In general, a predetermined number of liquid droplets (0, 1, or more) are discharged onto each pixel region, whereby a pixel with a predetermined tone level (tone level, 1, 2, 3, or more) is formed on each pixel region. That is to say, one pixel region has zero, one, or more dots corresponding to the tone level thereof. Furthermore, a great number of pixels are arrayed on the recording medium, whereby an image is formed thereon.

Note that the dot is not always completely included within the corresponding pixel region, but may deviate out of the corresponding pixel region.

Description will be made below regarding a liquid discharge device according to the first embodiment of the present invention. The liquid discharge device comprises a liquid chamber for storing liquid which is to be discharged, an energy generating device for energizing the liquid stored in the aforementioned liquid chamber, and a discharge opening for discharging the liquid stored in the aforementioned liquid chamber due to the energy generated by the aforementioned energy generating device. With the liquid discharge device, deviation of the discharge direction can be controlled by adjusting the energy, which is generated by the energy generating device, provided to the liquid. For example, the aforementioned energy generating device forms one face of the aforementioned liquid chamber, and controls the energy distribution on the face of the liquid chamber, thereby controlling deviation of the discharge direction of the liquid discharged from the aforementioned discharge opening. As an example, the liquid discharge device according to the present embodiment includes multiple heating devices serving as energy generating devices, with these multiple heating devices being disposed so as to form the aforementioned face of the liquid chamber, and the supply of energy is adjusted for each heating device so as to control the energy distribution on the aforementioned face. Note that it is needless to say that the liquid discharge device is not restricted to the embodiments described below.

(Configuration of Head)

Figure 1:
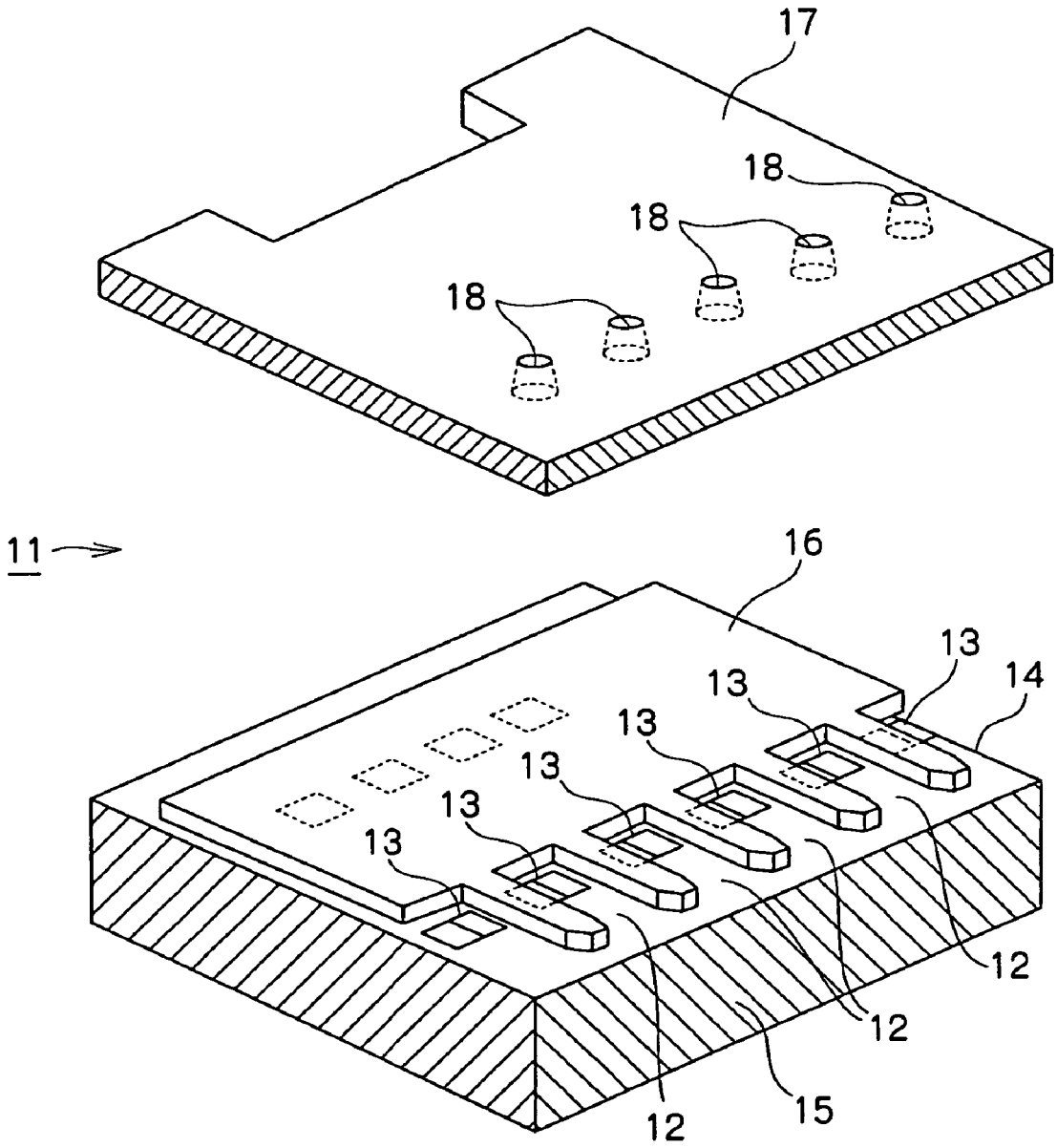
FIG. 1 is a disassembling perspective view which illustrates a head of an ink jet printer to which a liquid discharge device according to the present invention is applied.

FIG. 1 is a disassembling perspective view which shows a head 11 of an ink jet printer (which will be simply referred to as "printer" hereafter) to which the liquid discharge device according to the present invention is applied. Note that while a nozzle sheet 17 is bonded onto a barrier layer 16 in actual practice, FIG. 1 shows the head 11 with the nozzle sheet 17 in a disassembled state.

The head 11 has a base member 14 including a semiconductor substrate 15 formed of Si or the like, and heating resistors 13 (serving as energy generating devices in the present invention) formed on one face of the semiconductor substrate 15 by deposition. The heat resistors 13 are electrically connected to an external circuit through electric-conductive portions (not shown) formed on the semiconductor substrate 15.

On the other hand, the barrier layer 16 is formed of photosensitive cyclized rubber resist or light-hardening dry-film resist, and is formed by a process wherein the barrier layer 16 is formed over the entire face on the semiconductor substrate 15, on which the heating resistors 13 have been formed, following which unnecessary portions thereof are removed by photolithography, for example.

On the other hand, the nozzle sheet 17 includes multiple nozzles 18 formed thereon, formed of nickel using electroforming, for example. The nozzle sheet 17 is bonded onto the barrier layer 16 such that the position of each nozzle 18 matches the position of the corresponding heating resistor 13, i.e., each nozzle 18 faces the corresponding heating resistor 13.

Each ink liquid chamber 12 formed of the base member 14, the barrier layer 16, and the nozzle sheet 17, has a configuration so as to surround the corresponding heating resistor 13. That is to say, the base member 14 serves as the bottom wall of the ink liquid chamber 12, the barrier layer 16 serves as a side wall thereof, and the nozzle sheet 17 serves as the top wall. Thus, each ink liquid chamber 12 includes openings on the front and right side in FIG. 1, and each opening communicates with an ink channel (not shown).

In general, one head 11 such as described above includes around one hundred of the ink chambers 12, and the heating resistors 13, each disposed in the corresponding ink liquid chamber 12. Each heating resistor 13 is controlled according to instructions from a control unit of the printer, whereby ink can be discharged from desired ink liquid chambers 12 corresponding to the heating resistor 13 through the nozzles 18 disposed facing the ink liquid chambers 12.

More specifically, ink is supplied to the ink liquid chambers 12 from an ink tank (not shown) connected to the head 11. Pulse currents are applied to the desired heating resistors 13 for a short period of time, e.g., for 1 to 3 μsec, so as to perform rapid heating of the corresponding heating resistors 13, and accordingly, a vapor-phase ink bubble occurs in the ink in contact with the heating resistor 13, and thus this ink is pushed out of the way. The amount of ink pushed out thus is the same as the volume of the expanding ink bubble (i.e., the ink boils). As a result, ink in contact with the nozzle 18 is discharged as an ink liquid droplet from the nozzle 18. The amount of ink discharged therefrom is equivalent to that of to the ink pushed out. The discharged ink droplet lands on a printing paper sheet, thereby forming a dot (pixel).

Note that, in the present specification, the combination of the single ink liquid chamber 12, the heating resistor 13 disposed within the ink liquid chamber 12, and the nozzle 18 disposed on the upper portion will be referred to as an "ink discharge portion (liquid discharge portion)" hereafter. That is to say, the head 11 is formed of an array of multiple ink discharge portions.

Figure 2:
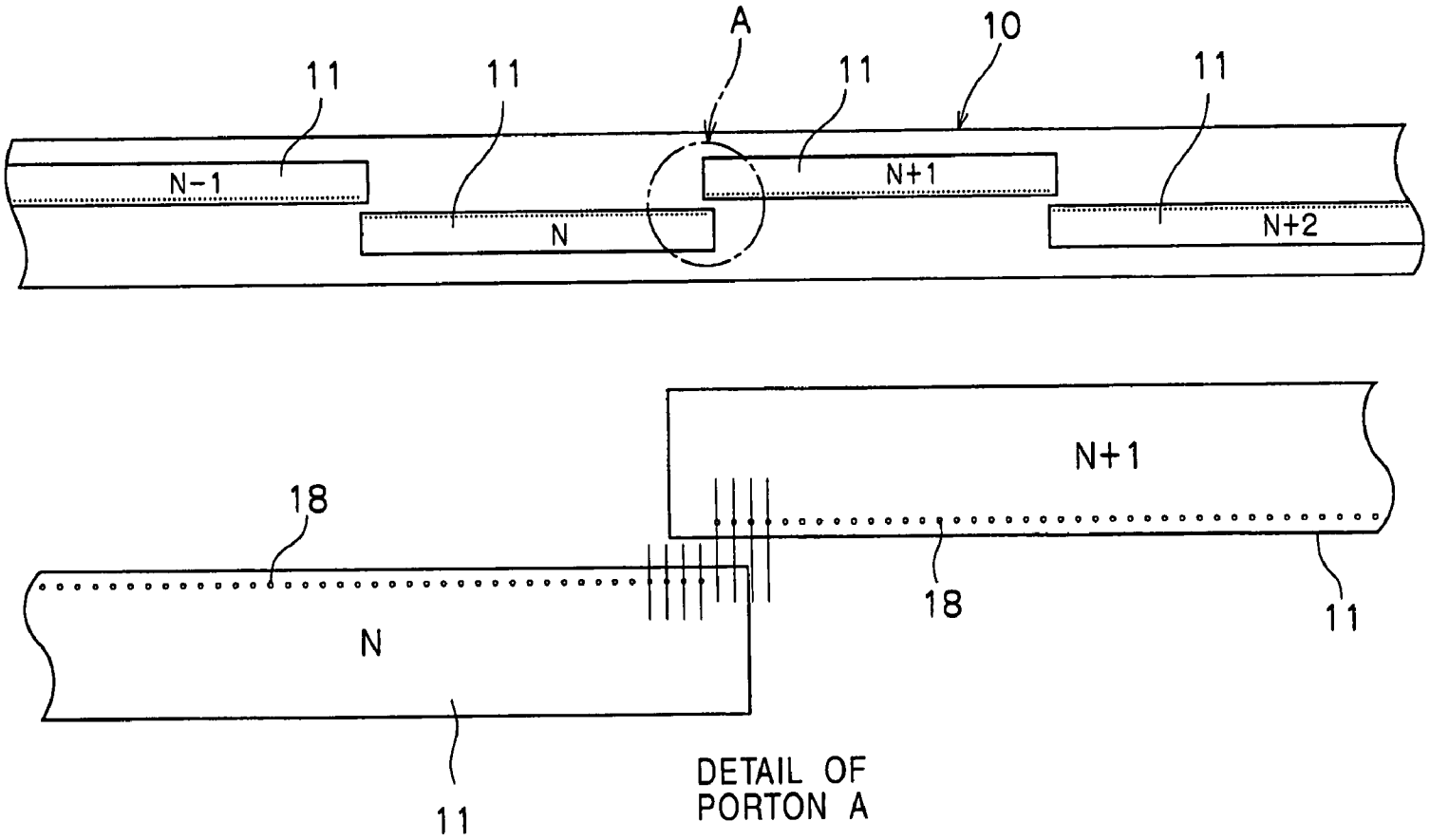
FIG. 2 is a plan view which illustrates a line head according to an embodiment.

Furthermore, with the present embodiment, a line head is formed of multiple heads 11 arrayed in the width direction of the recording medium. FIG. 2 is a plan view which shows a line head 10 according to the present embodiment. FIG. 2 shows four heads 11 (N−1, N, N+1, and N+2). In the manufacturing process for the line head 10, multiple heads (head chips) without the nozzle sheets 17, shown in FIG. 1, are arrayed.

Subsequently, the single nozzle sheet 17 is bonded onto the entire face of the head-chip array such that each ink discharge portion matches the corresponding nozzle 18, whereby the line head 10 is formed. Note that the heads 11 are arrayed such that the nozzle pitch of the nozzles 18 each positioned at the ends of the adjacent heads 11, i.e., the distance between the nozzle 18 disposed at the right end of the N'th head 11 and the nozzle 18 disposed at the left end of the (N+1)'th head 11, shown in the enlarged view of the portion A in FIG. 2, matches the nozzle pitch within a single head 11.

(Discharge Direction Varying Means)

The head 11 includes discharge direction varying means. The discharge direction varying means according to the present embodiment enable the discharge direction of the ink liquid droplets discharged from the nozzle 18 to be changed in a predetermined range along the direction of the array of the nozzles 18 (liquid discharge portions), and has a configuration described below.

Figure 3A:
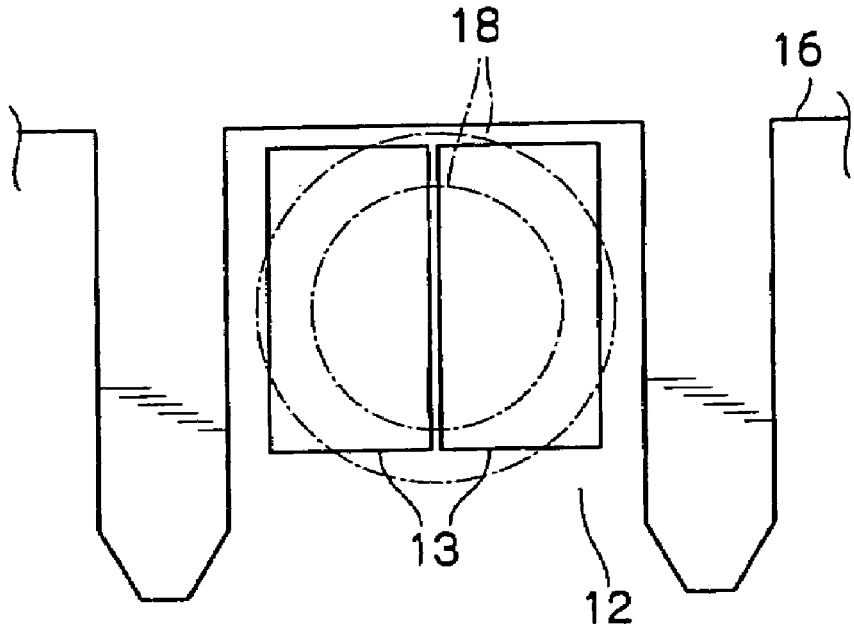
FIG. 3, consisting of FIGS. 3A and 3B, shows a plan view and a cross-sectional side view which illustrates an ink discharge portion of the head shown in FIG. 1, in more detail.
Figure 3B:
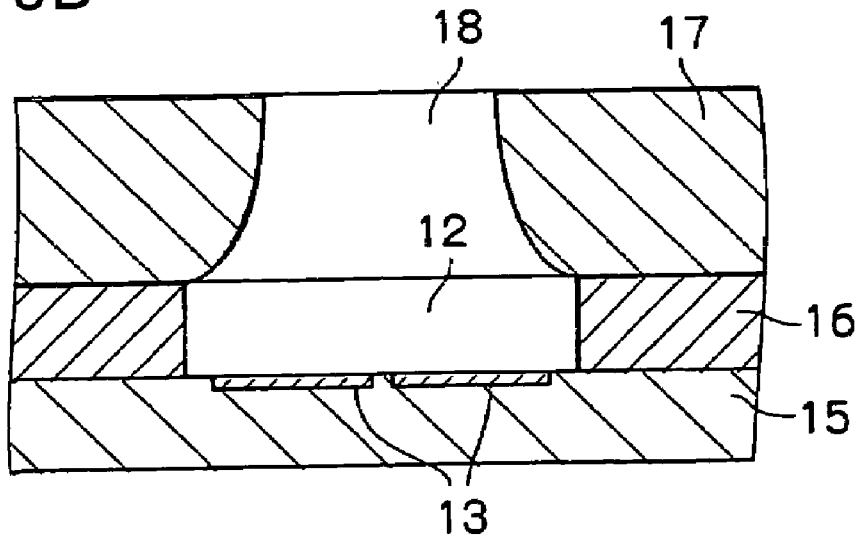

FIG. 3, consisting of FIGS. 3A and 3B, shows a plan view which illustrates the ink discharge portion of the head 11, and a cross-sectional view of the side thereof, in more detail. In the plan view in FIG. 3A, the position of the nozzle 18 is denoted by alternate long and short dashed lines.

As shown in FIGS. 3A and 3B, the head 11 according to the present embodiment includes two divided heating resistors 13 arrayed within the single ink liquid chamber 12. Furthermore, the divided two heating resistors 13 are arrayed in the direction of the array of the nozzles 18 (the horizontal direction in FIG. 3).

Each of the two divided heating resistor 13, wherein a single heating resistor in a conventional arrangement is divided in the direction orthogonal to the nozzle-array direction, has the same length and half the width as compared with the conventional arrangement, and accordingly, has a resistance two times as great as with the single heating resistor in the conventional arrangement. Let us say that the two divided heating resistors 13 are connected in serial. In this case, a circuit is formed, wherein the heating resistors 13 having a resistance two times as great as with the single heating resistor in a conventional arrangement are connected serially, and accordingly, the circuit has a resistance four times as great as with the single heating resistor in a conventional arrangement.

Now, in order to boil the ink stored within the ink liquid chamber 12, the heating resistor 13 needs to be heated by supplying a predetermined amount of electric power to the heating resistor 13. The ink is discharged due to the energy generated at the time of boiling. Note that while the heating resistor 13 with a small resistance requires a large current, the heating resistors 13 with a high resistance require only a small current for boiling.

Thus, the size of transistors or the like for switching electric current can be reduced, thereby reducing the entire size of the device. Note that the heating resistor 13 formed with a reduced thickness exhibits an increased resistance. However, the thickness of the heating resistor 13 cannot be reduced beyond a limit in accordance with the strength (durability) of a material forming the heating resistor 13. Accordingly, with the present embodiment, the heating resistor 13 is formed by dividing a single conventional heating resistor into two portions without reducing the thickness, in order to increase the resistance of the heating resistor 13.

As described above, each ink liquid chamber 12 includes two divided heating resistors 13. Now, in the event that current supply is controlled such that the two divided heating resistors 13 require the same period of time (bubble generating time) for reaching the bubbling temperature of the ink, the ink bubbles at the same time on the two divided heating resistors, whereby the ink liquid droplets are discharged in the direction of the center axis of the nozzle 18.

On the other hand, in the event that current supply is controlled such that the two divided heating resistors 13 have different bubble generating times, the ink bubbles with predetermined time difference on the two divided heating resistors. As a result, the discharge direction of the ink liquid droplets is deviated from the center axis of the nozzle 18, whereby the ink is discharged with a predetermined deviation. Thus, the ink liquid droplets can hit a portion with a predetermined deviation from the hit portion in a case of the ink liquid droplets being discharged without deviation control.

Figure 4:
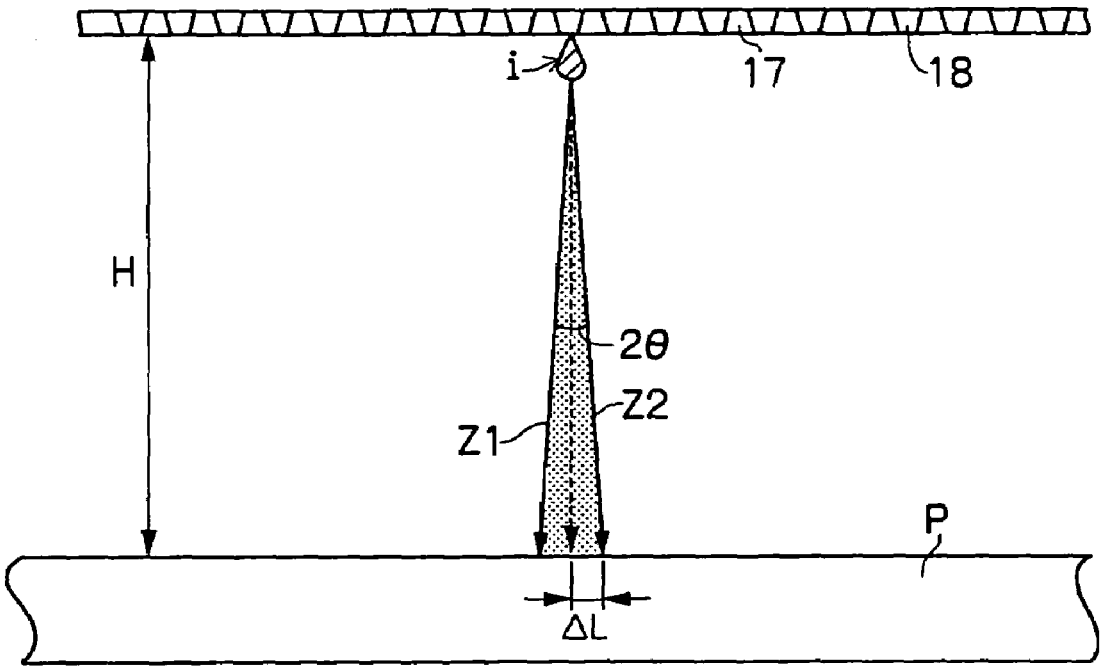
FIG. 4 is a diagram for describing deviation of the discharge direction of ink.

FIG. 4 is a diagram for describing the deviation along the discharge direction of the ink liquid droplets. In FIG. 4, in the event that an ink liquid droplet i is discharged in the direction vertical to the discharge face of the ink liquid droplet i, the ink liquid droplet i is discharged without deviation denoted by the dashed arrow shown in FIG. 4. On the other hand, in the event that the ink liquid droplet i is discharged with deviation, i.e., with a discharge deviation angle θ from the nozzle center axis (in the direction of Z1 or Z2 in FIG. 4), the hit position of the ink liquid droplet i is represented by the following expression:

$$\Delta L = H \times \tan\theta$$

where H denotes the distance between the discharge face and the face (hit face of the ink liquid droplet i) of a printing paper sheet P serving as a recording medium. Note that the distance H is generally uniform over the entire line head.

As can be understood from the above expression, in the event that the ink liquid droplet i is discharged with a discharge deviation angle θ from the nozzle center axis, a position offset ΔL of the hit position of the ink liquid droplet occurs.

In general, with conventional ink jet printers, the distance H between the tip of the nozzle 18 and the printing paper sheet P is around 1 mm to 2 mm. Now, let us say that the distance H is generally maintained to 2 mm. Note that the change of the distance H causes the change of the hit position of the ink liquid droplet i. Accordingly, the distance H needs to be generally maintained to a constant. That is to say, in the event that the ink liquid droplet i is discharged onto the printing paper sheet P from the direction vertical thereto through the nozzle 18, some change in the distance H does not causes change in the hit position of the ink liquid droplet i. On the other hand, in the event that the ink liquid droplet i is discharged with deviation, the change in the distance H causes a change in the hit position of the ink liquid droplet i.

Note that with the head 11 having the resolution of 600 DPI, the interval between the adjacent nozzles 18 is determined to approximately 42.3 (μm) by the expression 25.40×1000/600.

Figure 5A:
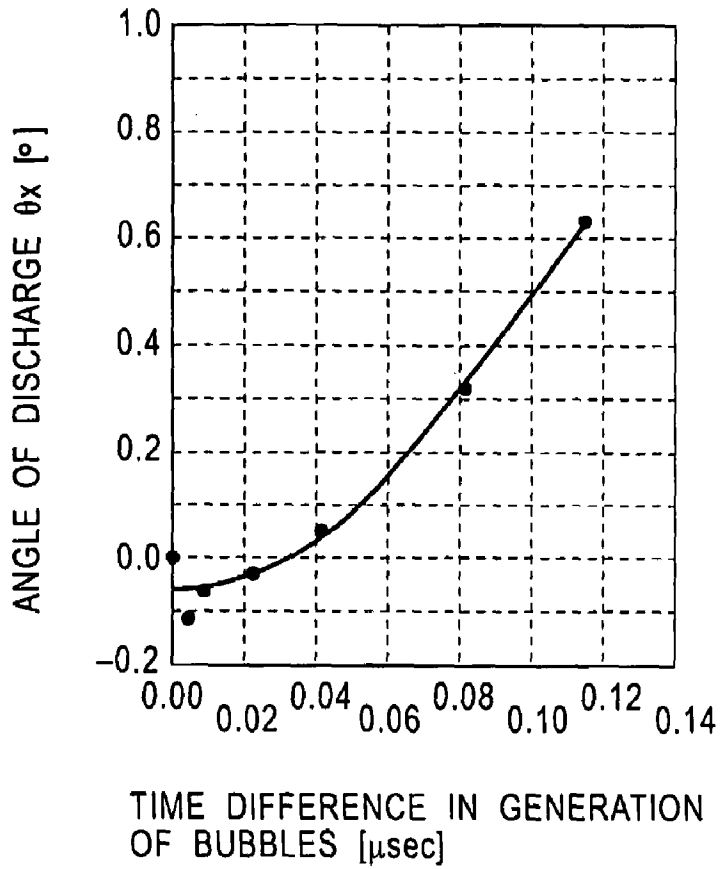
FIGS. 5A and 5B show relation between time difference in ink bubble generation and ink discharge angle obtained from simulation results in a case of the ink discharge portion having two-divided heating resistors.
Figure 5B:
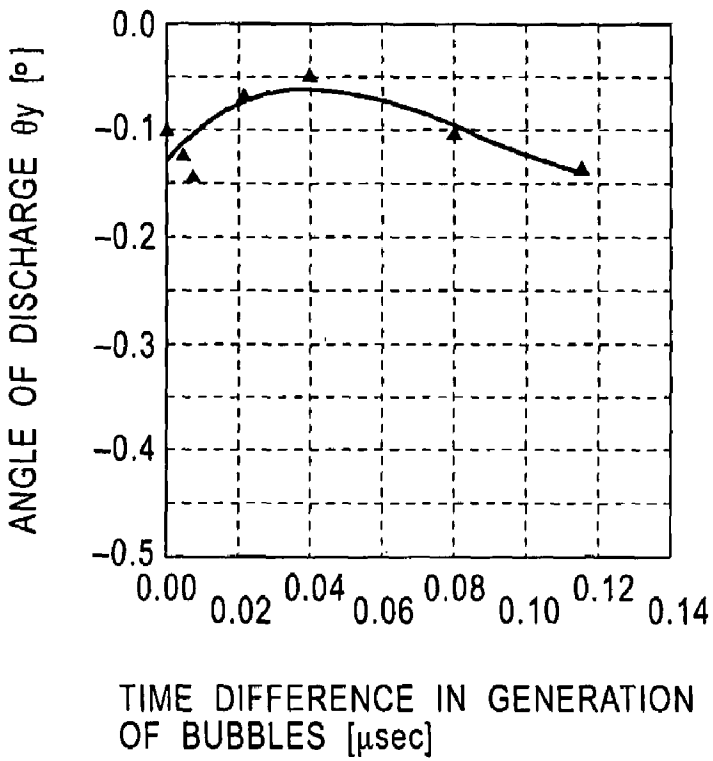
Figure 5C:
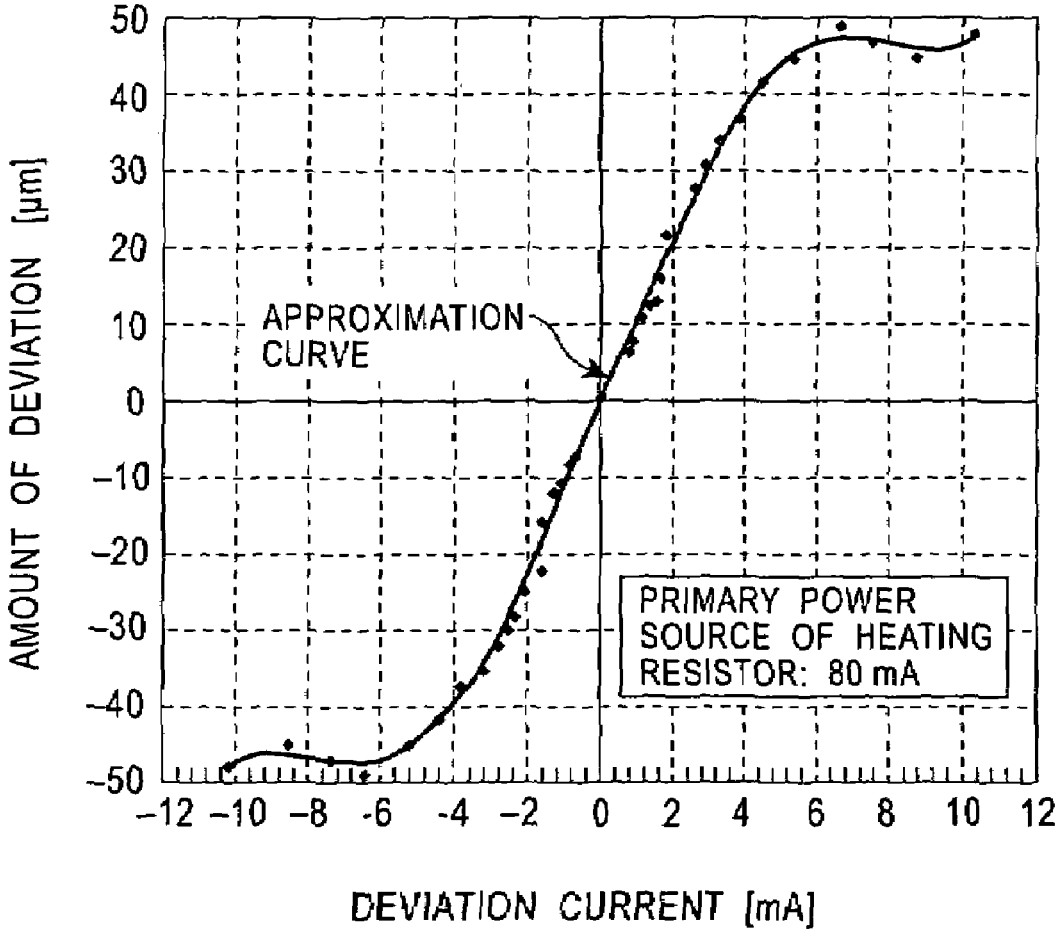
FIG. 5C shows the relation between half of the difference in currents flowing in the divided heating resistors (deviation current) and the amount of deviation, obtained from measured data.

FIGS. 5A and 5B are charts which show the relation between the time difference in ink bubble generation between the two-divided heating resistors 13 and ink discharge angle, which is obtained by computer simulation. In these charts, the X direction (X direction denoted by θX of the vertical axis of the chart, note that this does not denote the horizontal direction of the chart) denotes the direction of the array of the nozzles 18 (the direction of the array of the heating resistors 13). On the other hand, the Y direction (Y direction denoted by θy of the vertical axis of the chart, note that this does not denote the horizontal direction of the chart) denotes the direction (transporting direction of a printing sheet) orthogonal to the X direction. On the other hand, FIG. 5C shows the measured data relation between the deviation current represented by the horizontal axis, and the deviation amount of the ink landing position represented by the vertical axis, wherein the deviation current is represented by half of the current difference between the two divided heating resistors 13, causing the time difference in ink bubble generation between two divided heating resistors 13, and the deviation amount (which is measured in a case of H of approximately 2 mm) is caused due to the ink discharge angle (X direction). Note that the data shown in FIG. 5C was obtained by the measurement of ink discharging with deviation under the condition of the main current of 80 mA being applied to both the heating resistors 13, and the aforementioned deviation current being further applied to one of the two divided heating resistors 13.

In the event that the time difference in bubble generation occurs between the two divided heating resistors 13 arrayed in the direction of the array of the nozzles 18, the ink is discharged with an ink discharge angle deviated from the nozzle center axis. More specifically, as shown in FIG. 5A, the greater the time difference in bubble generation is, the greater the discharge angle θX (which represents the deviation from the nozzle center axis, and corresponds to θ shown in FIG. 4) along the direction of the array of the nozzles 18.

As described above, the head according to the present embodiment includes multiple ink discharge portions, each having two divided heating resistors 13, wherein supplied current is controlled for each heating resistor 13, thereby controlling occurrence of time difference in bubble generation on the two heating resistors 13. Thus, deviation of the ink discharge direction can be controlled by adjusting the time difference.

Figure 6:
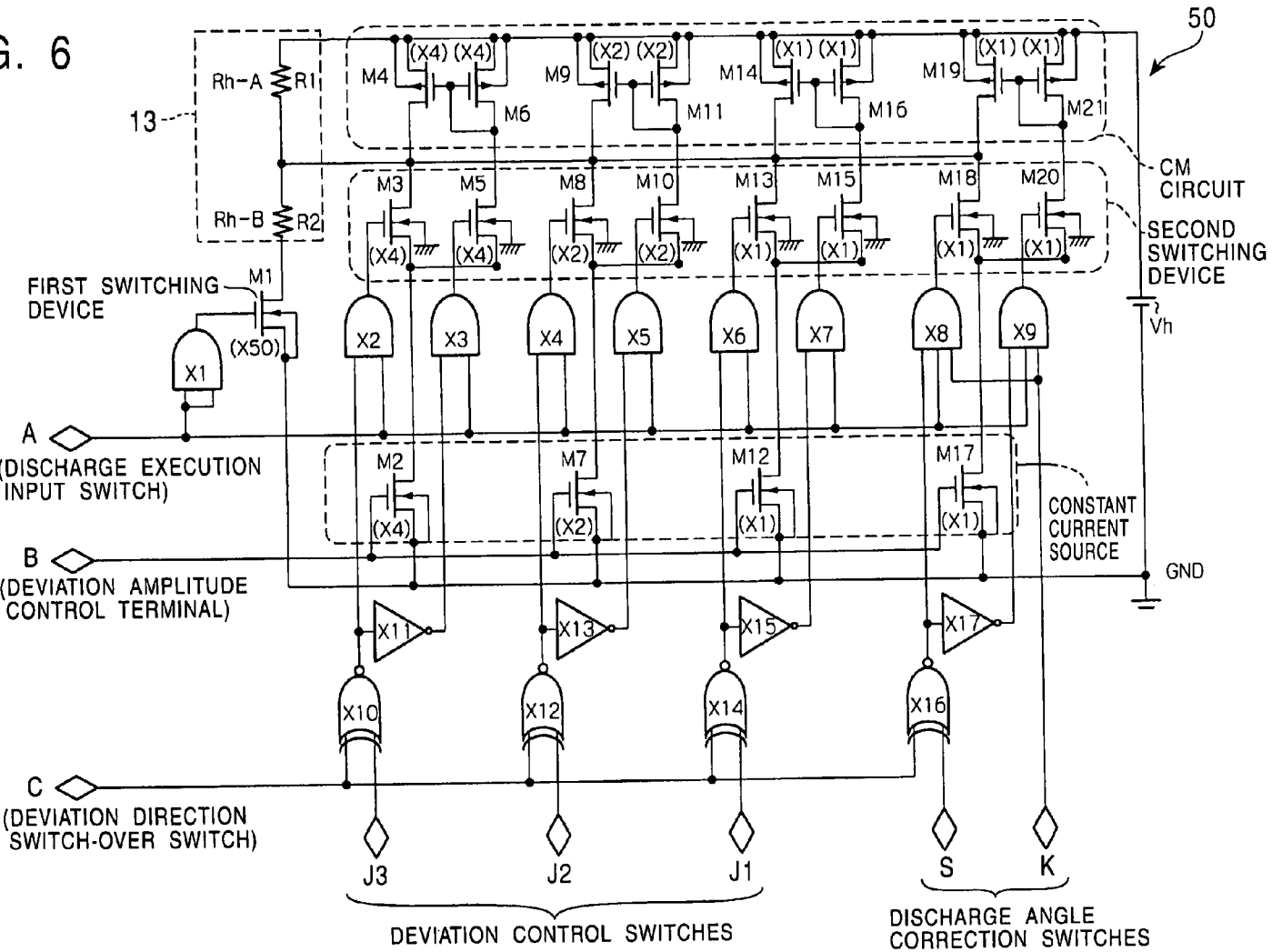
FIG. 6 shows a discharge control circuit according to the embodiment for controlling the time difference in bubble generation between the two divided heating resistors.

Next, specific description will be made regarding a method for controlling the deviation of the discharge direction of the ink liquid droplet. FIG. 6 shows a circuit configuration example according to the present embodiment for controlling the time difference in bubble generation between the two divided heating resistors 13. In this example, deviation of the discharge direction of the ink liquid droplet is controlled with a 3-bit control signal. That is to say, the difference between the currents applied to resistors Rh-A and Rh-B can be determined to any of eight predetermined levels, thereby setting deviation of the discharge direction of the ink liquid droplet to a corresponding one of the eight levels.

In FIG. 6, the resistors Rh-A and Rh-B serve as the two divided resistors 13, and are connected serially. A power source Vh supplies electric power to the resistors Rh-A and Rh-B.

A discharge control circuit 50 controls the deviation of the discharge direction of the ink liquid droplet by adjusting the difference between the currents supplied to the resistors Rh-A and Rh-B, and includes transistors M1 through M21. The transistors M4, M6, M9, M11, M14, M16, M19, and M21 are P-MOS transistors and the others are N-MOS transistors. The pair of the transistors M4 and M6, the pair of the transistors M9 and M11, the pair of the transistors M14 and M16, and the pair of the transistors M19 and M21, each form a current mirror circuit (which will be referred to as "CM circuit" hereafter). Thus, the discharge control circuit 50 includes four CM circuits.

Now, description will be made regarding the CM circuit formed of the transistors M4 and M6, as an example. The gate and the drain of the transistor M6 and the gate of the transistor M4 are connected one to another, and accordingly, the CM circuit has a configuration wherein the same voltage is applied to the transistors M4 and M6 at all times, and thus, generally the same current flows in the transistors M4 and M6. The other CM circuits have the same configuration.

On the other hand, the transistors M3 and M5 serve as a differential amplifier, i.e., a switching device (which will be referred to as "second switching device" hereafter) for the CM circuit formed of the transistors M4 and M6. In this case, the second switching device operates such that a current flows into the node between the resistors Rh-A and Rh-B through the CM circuit, or a current flows from the node between the resistors Rh-A and Rh-B.

On the other hand, the transistors M8 and M10, the transistors M13 and M15, and the transistors M18 and M20, serve as the second switching devices for the CM circuits formed of the transistors M9 and M11, the transistors M14 and M16, and the transistors M19 and M21, respectively.

With regard to the CM circuit formed of the transistors M4 and M6, and the second switching device formed of the transistors M3 and M5, the drains of the M4 and M3 are connected one to another, as well as the drains of the M6 and M5 are connected one to another. The other second switching devices are connected to the corresponding CM circuits in the same way.

Furthermore, the drains of the transistors M4, M9, M14, and M19, forming a part of the CM circuits, and the drains of the transistors M3, M8, M13, and M18, are connected to the node between the resistors Rh-A and Rh-B.

On the other hand, each of transistors M2, M7, M12, and M17, serve as constant current sources for the corresponding CM circuits. The drains of these transistors are connected to the sources of the transistors M3, M8, M13, and M18, and the back gates thereof.

Furthermore, the discharge control circuit has a configuration wherein the drain of a transistor M1 is connected to the resistor Rh-B serially, and upon a discharge execution input switch being set to "1" (ON), the transistor M1 is turned on so as to apply a current to the resistors Rh-A and Rh-B. That is to say, the transistor M1 serves as a switching device (which will be referred to as "first switching device" hereafter) for performing on/off switching of current supply to the resistors Rh-A and Rh-B.

Furthermore, output terminals of AND gates X1 through X9 are connected to the gates of the corresponding transistors M1, M3, M5, . . . . Note that while two-input AND gates are employed for the AND gates X1 through X7, three-input AND gates are employed for the AND gates X8 and X9. At least one of the input terminals of each of the AND gates X1 through X9 are connected to the discharge execution input switch A.

Furthermore, with regard to XNOR gates X10, X12, X14, and X16, one input terminal of each XNOR gate is connected to a deviation direction switch-over switch C (deviation direction switching means) serving as a switch for switching the deviation direction of the discharge direction of the ink liquid droplet as to the direction of the array of the nozzles 18. Upon the deviation direction switch-over switch being set to 1 (on), one of the input signals of the XNOR gate X10 is set to 1.

On the other hand, deviation control switches J1 through J3 serve as switches for controlling the amount of deviation of the discharge direction of the ink liquid droplet. For example, upon the input terminal J3 being set to 1 (on), one of the input signals of the XNOR gate X10 is set to 1.

Furthermore, the output terminals of the XNOR gates X10 through X16 are each connected to one of the input terminals of the AND gates X2, X4, . . . , as well as each being connected to one of the input terminals of the AND gates X3, X5, . . . , through NOT gates X11, X13, . . . . Furthermore, one of the input terminals of AND gates X8 and X9 is connected to the discharge angle correction switch K.

On the other hand, a deviation amplitude control terminal B serves as a terminal for controlling the currents which flow in the transistors M2, M7, . . . , serving as constant current sources for the corresponding CM circuits, and is connected to the gates of the corresponding transistors M2, M7, . . . . Upon a predetermined voltage (Vx) being applied to the deviation amplitude control terminal B, the voltage Vgs (gate-source voltage) is applied to the gates of the transistors M2, M7, . . . , and accordingly, currents flow in the transistors M2, M7, . . . . Here, each of the transistors M2, M7, . . . , can be represented by an equivalent circuit formed of sub-transistors connected in parallel, and the numbers of sub-transistors of the equivalent circuits corresponding to the transistors M2, M7, . . . , are different one to another. Accordingly, the currents proportional to the numbers (which corresponds to the numbers of the aforementioned sub-transistors) in parentheses shown in FIG. 6 flow in the transistors M3 through M20, and the transistors M8, M7, . . . .

Furthermore, the source of the transistor M1, of which drain is connected to the resistor Rh-B, and the sources of the transistors M2, M7, . . . , serving as the constant current sources for the corresponding CM circuits, are connected to the ground (GND).

With the above-described circuit configuration, each number (×N (N=1, 2, 4, or 50)) in parentheses shown in FIG. 6 denotes the number of the aforementioned sub-transistors, connected in parallel, which form a corresponding equivalent circuit. For example, "×1" (M12 through M21) denotes that the corresponding equivalent circuit has a single sub-transistor. On the other hand, "×2" (M7 through M11) denotes that the corresponding equivalent circuit has two sub-transistors connected in parallel. In the same way, "×N" denotes that the corresponding equivalent circuit has the number N of sub-transistors connected in parallel.

With the circuit configuration according to the present embodiment, the transistors M2, M7, M12, and M17, are represented by the aforementioned equivalent circuits having the four, two, one, and one, sub-transistors, respectively. Accordingly, upon a predetermined voltage being applied between the gates of these transistors and the ground, the drain currents flow in the transistors with the ratio of 4:2:1:1.

Next, description will be made regarding the operation of the discharge control circuit 50.

First, as a representative example, description will be made with the operation of the combination of the CM circuit formed of the transistors M4 and M6, and the switching device thereof formed of the transistors M3 and M5.

The discharge execution input switch A is set to 1 (on) only at the time of the ink liquid droplet being discharged. More specifically, with the present embodiment, at the time of the ink liquid droplet being discharged from the nozzle 18, the discharge execution input switch A is set to 1 (on) only during the period of 1.5 μsec (1/64) so as to supply electric power to the resistors Rh-A and Rh-B from the power source Vh (5V). On the other hand, the discharge execution input switch A is set to 0 (off) during the other period of 94.5 μsec (63/64), and ink supply is performed during this period for the ink liquid chamber 12 of the ink discharge portion which has discharged an ink liquid droplet.

For example, upon A, B, C, and J3, being set to 1, Vx (analog voltage), 1, and 1, respectively, the XNOR gate X10 outputs 1, and accordingly, the output 1 and the input signal 1 from A are input to the AND gate X2, and thus, the AND gate X2 outputs 1. Accordingly, the transistor M3 is turned on.

Furthermore, in the event the output from the XNOR gate X10 outputs 1, the NOT gate X11 outputs 0, and accordingly, this output 0 and the input signal 1 from A are input to the AND gate X3. Accordingly, the AND gate X3 outputs 0, and thus, the transistor M5 is turned off.

In this case, the drains of the transistor M4 and M3 are connected one to another, and the drains of the transistors M6 and M5 are connected one to another. Accordingly, in the event that the transistor M3 is on, and the transistor M5 is off, as described above, a current flows into the transistor M3 from the resistor Rh-A, but no current flows in the transistor M6 due to the transistor M5 being off. Furthermore, while no current flowing is in the transistor M6, no current flows in the transistor M4, as well, due to the nature of the CM circuit. Furthermore, the transistor M2 is on, and accordingly, a current only flows through the transistors M3 and M2, in a case as described above.

Upon the voltage of the power source Vh being applied in this state, no current flows in the transistors M4 and M6, and a current flows in the resistor Rh-A. Here, the transistor M3 is on, and accordingly, the current flowing from the resistor Rh-A is divided into a current which flows in the transistor M3 and a current which flows in the resistor Rh-B. The current flowing in the transistor M3 flows in the transistor M2 for controlling the current, following which the current flows into the ground. On the other hand, the current flowing in the resistor Rh-B flows in the transistor M1 which is on, following which the current flows into the ground. Accordingly, the relation between the current flowing the resistor Rh-A and the current flowing the resistor Rh-B is represented by I(Rh-A)>I(Rh-B). Note that I() denotes the current flowing in the resistor "".

Description has been made in a case of C being set to 1. Next, description will be made below regarding a case of C being set to 0, i.e., in the event that only the input of the deviation direction switch-over switch C is switched while maintaining the other input signals (the other switches A, J3 are set to the same values as described above).

In the event that C is set to 0, and J3 is set to 1, the XNOR gate X10 outputs 0. Accordingly, the input signals (0, 1 (from A)) are input to the AND gate X2, and accordingly, the AND gate X2 outputs 0. Accordingly, the transistor M3 is turned off.

On the other hand, the NOT gate X11 outputs 1 due to the output of the XNOR gate X10 of 0, and accordingly, the input signals (1, 1 (from A)) are input to the AND gate X3, and accordingly, the transistor M5 is turned on.

While in the event that the transistor M5 is on, a current flows in the transistor M6, a current flows in the transistor M4, as well, due to the nature of the CM circuit.

As a result, currents flow in the resistor Rh-A, and the transistors M4 and M6 from the power source Vh. In this case, all the current flowing from the resistor Rh-A flows into the resistor Rh-B (the current flowing from the resistor Rh-A does not flow into the transistor M3 due to the transistor M3 being off). Furthermore, all the current flowing from the transistor M4 flows into the resistor Rh-B due to the transistor M3 being off. Furthermore, the current flowing from the transistor M6 flows into the transistor M5.

As described above, while upon C being set to 1, the current flowing from the resistor Rh-A is divided into the resistor Rh-B and the transistor M3, upon C being set to 0, the current flowing from the Rh-A and the current flowing from the transistor M4 flow into the resistor Rh-B. As a result, the relation between the current flowing in the resistor Rh-A and the current flowing in the resistor Rh-B is represented by I(Rh-A)<I(Rh-B). The ratio of I(Rh-A) to I(Rh-B) in a case of C being set to 1 is symmetrical to that in a case of C being set to 0.

As described above, the liquid discharge device according to the present embodiment generates the time difference in ink bubble generation between the two divided heating resistors 13 by adjusting the currents supplied to the resistors Rh-A and Rh-B, thereby controlling deviation of the discharge direction of an ink liquid droplet.

Furthermore, with the liquid discharge device according to the present embodiment, the deviation direction of the discharge direction of the ink liquid droplet can be switched to either of two directions symmetrical one to another, along the direction of an array of the nozzles 18 by switching the input signal of C to 0 or 1.

Description has been made regarding a case of only the deviation control switch J3 being adjusted to on or off. Note that with the present embodiment, the deviation is not controlled only by adjusting the deviation control switch J3, but is also controlled by adjusting the deviation control switches J2 and J1, and accordingly, the currents applied to the resistors Rh-A and Rh-B can be controlled in more detail.

That is to say, while the currents applied to the transistors M4 and M6 can be controlled by the deviation control switch J3, the currents applied to the transistors M9 and M11 can be controlled by the deviation control switch J2 in the same way. Furthermore, the currents applied to the transistors M14 and M16 can be controlled by the deviation control switch J1 in the same way.

As described above, the drain currents flow in the transistors M4 and M6, the transistors M9 and M11, and the transistors M14 and M16, with the ratio of 4:2:1, respectively. Accordingly, the deviation of the discharge direction of the ink liquid droplet can be controlled by controlling the deviation control switches J1 through J3 using 3-bit signals with a deviation level from eight levels of (J1, J2, J3)=(0, 0, 0), (0, 0, 1), (0, 1, 0), (0, 1, 1), (1, 0, 0), (1, 0, 1), (1, 1, 0), and (1, 1, 1).

Furthermore, with the present embodiment, the voltage supplied to the deviation amplitude control terminal B is applied between each gate of the transistors M2, M7, M12, and M17, and the ground, and accordingly, the change in the voltage supplied to the deviation amplitude control terminal B causes a change in the currents flowing the transistors, thereby controlling an increment deviation per level while maintaining the ratio of the drain currents flowing the transistors to 4:2:1.

Thus, with the present embodiment, the deviation of the discharge direction of the ink liquid droplet can be controlled, thereby controlling landing position of the ink liquid droplet on a recording medium, e.g., the ink liquid droplet can be discharged with a deviation on a predetermined side as to the array of the ink discharge portions, and furthermore, the ink liquid droplet can be discharged with a deviation on the reverse side, not to mention the fact that the ink liquid droplet can be discharged from the nozzle 18 with no deviation (in the direction vertical to the face of a recording medium for the ink liquid droplets such as a printing paper sheet or the like). With a circuit example shown in FIG. 6, the landing position of the ink liquid droplet is controlled with a positional level from eight levels on a predetermined side. Furthermore, with the present embodiment, the deviation direction of the discharge direction of the ink liquid droplet can be switched between two directions symmetrical one to another as to the direction of the array of the nozzles 18 by performing on/off switching for the deviation direction switch-over switch C between C=1 and C=0. Furthermore, the landing position of the ink liquid droplet is controlled with a positional level from the eight levels corresponding to the input values of J1, J2, and J3, as described above.

While description has been made regarding an example wherein the deviation of the discharge direction of the ink liquid droplet is controlled with a deviation level from eight levels using 3-bit control signals with reference to FIG. 6, an arrangement may be made wherein the deviation of the discharge direction of the ink liquid droplet is controlled with a deviation level from M levels using an application circuit of the circuit example shown in FIG. 6.

With the liquid discharge device having the above-described configuration according to the present embodiment, the target landing position is set to a position selected from M (M is an integer of 2 or more) portions divided from the corresponding pixel region along the direction of the nozzles 18 of the array (deviation direction in the present invention, i.e., the direction generally vertical to the main scanning direction in the line method), wherein at least a part of the region of the ink liquid droplet which has landed on the recording medium is included within the pixel region. That is to say, with the present embodiment, M target landing position candidates are determined for each pixel region, a target landing position is selected from the M target landing position candidates, and the ink liquid droplet is discharged with a deviation such that the ink liquid droplet lands at the target landing position on the recording medium.

Note that with the present embodiment, the aforementioned M target landing position candidates are determined for each pixel region on the recording medium with the interval of 1/M of the pitch on the recording medium corresponding to the array pitch of the ink discharge portions.

With the present embodiment, the target landing position is determined from the aforementioned M landing target position candidates at random (in an irregular manner, or without pattern). While various methods are known wherein aforementioned selection is performed at random, with the present embodiment, a target landing position is selected from the M divided target landing position candidates using a random number generating circuit 22 described later.

With the present embodiment, in the event that two or more ink liquid droplets are discharged onto a single pixel region, i.e., in the event that multi-tone printing is performed, the target landing position is determined at random for each ink liquid droplet from the M target landing position candidates, and the ink liquid droplet is discharged with a deviation such that the ink liquid droplet lands at the determined target landing position on the recording medium.

Figure 7:
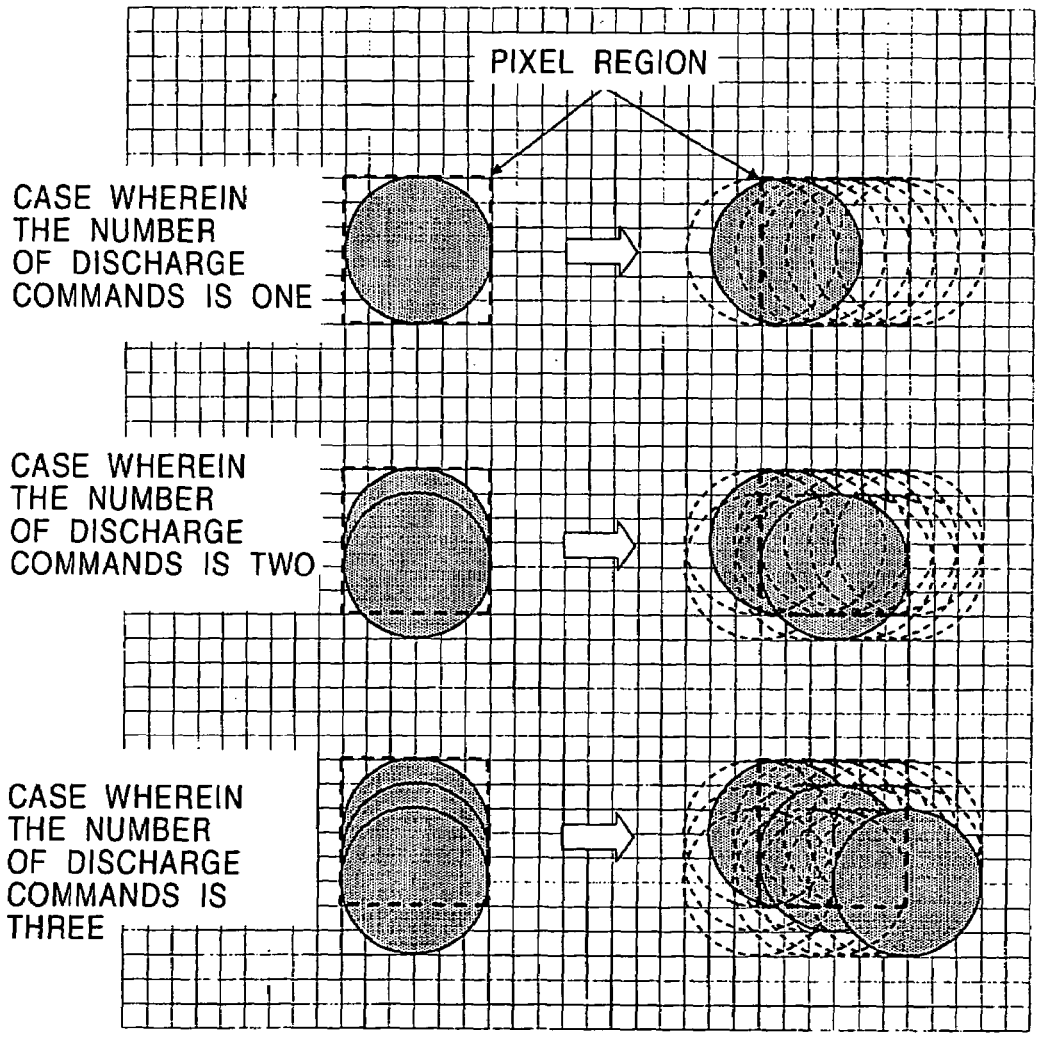
FIG. 7 is a plan view which shows a state example wherein ink liquid droplets are discharged so as to land at any of an M number of different target landing position candidates for a single pixel region.

FIG. 7 is a plan view which shows the state wherein the ink liquid droplet has landed at positions selected from the M divided target landing position candidates for a single pixel region, wherein the state of the landing positions with the present embodiment is shown on the right side in the drawing, while the state thereof with the conventional arrangement is shown on the left side as a comparative example. In FIG. 7, the square regions enclosed by dashed lines denote the pixel regions. On the other hand, the circular regions denote the ink liquid droplets which have landed on the recording medium.

First, description will be made regarding an example wherein the number of the discharge command signals is one for each pixel region, i.e., two-tone printing is performed. With the conventional arrangement, the ink liquid droplet lands on the recording medium such that the ink liquid droplet is generally included within the pixel region (FIG. 7 shows the ink liquid droplets which have landed on the recording medium with a size so as to serve as inscribing circles of the pixel regions).

On the other hand, with the present embodiment, the ink liquid droplet is discharged so as to land at a position selected from the M divided target landing position candidates arrayed along the direction of the array of the nozzles 18. In the example shown in FIG. 7, the state is shown wherein a single ink liquid droplet has landed at a position selected from the M (=8) divided target landing position candidates (in actual practice, one of the eight target landing position candidates corresponds to the state wherein the ink liquid droplet has not discharged, so FIG. 7 shows seven divided target landing positions). Note that in the drawing, the solid circles denote the positions where the ink liquid droplet has landed on the recording medium, and on the other hand, the dashed-line circles denote the position of the other target landing position candidates. In this example, the target landing position is determined at the second position from the left side, and the drawing shows the state wherein the ink liquid droplet has landed at the selected position on the recording medium.

On the other hand, in the event that the number of the discharge command signals is two, an ink liquid droplet is further discharged to the pixel region where one discharge command has been executed. Note that in the example shown in FIG. 7, the drawing shows the state wherein the nozzle center axis is shifted downward by one division, giving consideration to transporting of the printing paper sheet.

With the conventional arrangement, in the event that the number of the discharge command signals is two, the second ink liquid droplet is discharged so as to land at a position generally on the same vertical line as with the first landing position in the drawing (on the same line in the direction parallel to the transporting direction of the recording medium) (without deviation in the horizontal direction).

On the other hand, with the present embodiment, as described above, the first ink liquid droplet is discharged so as to land at a position selected at random. In the same way, the target landing position of the second ink liquid droplet is selected at random regardless of the first target landing position (there is no relation between the first and second ink liquid droplets), and the second ink liquid droplet is discharged so as to land at the selected target landing position on the recording medium. In the example shown in FIG. 7, the drawing shows an example wherein the second ink liquid has landed at the center position in the horizontal direction within the pixel region.

Furthermore, in the event that the number of the discharge command signals is three, the ink liquid droplets are discharged in the same way as with the above described case of two discharge command signals. With the conventional arrangement, the first through third ink liquid droplets are discharged so as to land at the same position within each pixel region without deviation in the horizontal direction. On the other hand, with the present embodiment, the target landing position of the third ink liquid droplet is selected at random regardless of the first and second target landing positions, and the third ink liquid droplet is discharged so as to land at the selected target landing position on the recording medium in the same way as with the second ink liquid droplet.

With the present embodiment, the ink liquid droplets are discharged for forming an image formed of an array of dots with the above-described method, thereby preventing occurrence of streaks due to irregularities in the discharge properties of the ink discharge portions, whereby the irregularities in the image become less conspicuous.

That is to say, with the present embodiment, there is no relation between the landing positions of the ink liquid droplets within a single pixel region, and each ink liquid droplet is arrayed at random for a single pixel region. As a result, each array of the ink liquid droplets has a random pattern, but rather overall arrays thereof follow a uniform and isotropic distribution, whereby the irregularities in the image becomes less conspicuous.

Thus, the liquid discharge device according to the present embodiment has the advantage of reduction of the irregularities in an image due to irregularities in the ink-liquid-droplet discharge properties of the ink discharge portions. With the conventional method arrangement wherein the ink liquid droplets are not discharged at random for each pixel region, all the pixels are arrayed in a regular pattern, and accordingly, the portion deviating from the regular pattern is more conspicuous. In particular, with regard to a dot image wherein the color tone is manifested by the ratio of the area of the dots as to the area of the unprinted region (the portion where the dots do not cover on the printing paper sheet), the more regular the pattern of the unprinted region is, the more conspicuous the portion deviating from the regular pattern is.

On the other hand, with the present embodiment, the dots are arrayed at random without regularity, a small deviation of the array is less conspicuous.

Furthermore, the liquid discharge device according to the present embodiment including a color line head formed of the above-described multiple line heads 10, wherein each line head 10 provides different color dots and has the advantages as follows.

The conventional color ink jet printers, wherein multiple ink liquid droplets are superimposed so as to form a single dot, requires higher precision of the landing positions than with a mono-tone arrangement for preventing occurrence of moire. On the other hand, with the present embodiment, the ink liquid droplets are arrayed at random for each pixel region, thereby preventing occurrence of moire, and thereby suppressing the irregularities in the dot landing positions to a simple problem of the irregularities in color. Thus, the liquid discharge device according to the present embodiment prevents deterioration in an image due to occurrence of moire.

In particular, while the serial-method arrangement, wherein the head is repeatedly driven in the main scanning direction so as to discharge the ink liquid droplets such that the dots are overlapped each other, has little problem of moire, the line-method arrangement has the problem of moire. On the other hand, the line-method arrangement employing the method according to the present embodiment wherein the ink liquid droplets are discharged at random prevents occurrence of moire. That is to say, the present embodiment has the advantage with regard to line-method ink jet printers.

Furthermore, with the present embodiment, the ink liquid droplets for each pixel land on the recording medium at random, and the total amount of the ink is spread on a wide region, thereby reducing the drying period of time for the ink liquid droplets which have landed on the recording medium as compared with a conventional arrangement using the same amount of ink. In particular, the method according to the present embodiment has the marked advantage of high-speed printing (short time) with regard to the line-method arrangement as compared with the serial-method arrangement.

Description has been made regarding the arrangements wherein ink liquid droplets are discharged on the recording medium at random with deviation along the direction of the array of the nozzles 18. However, the present invention is not restricted to the above-described arrangements, rather, an arrangement may be made wherein the ink liquid droplets are discharged at random with deviation along the transporting direction for the printing paper sheet (the direction generally vertical to the direction of the array of the nozzles 18).

Figure 8:
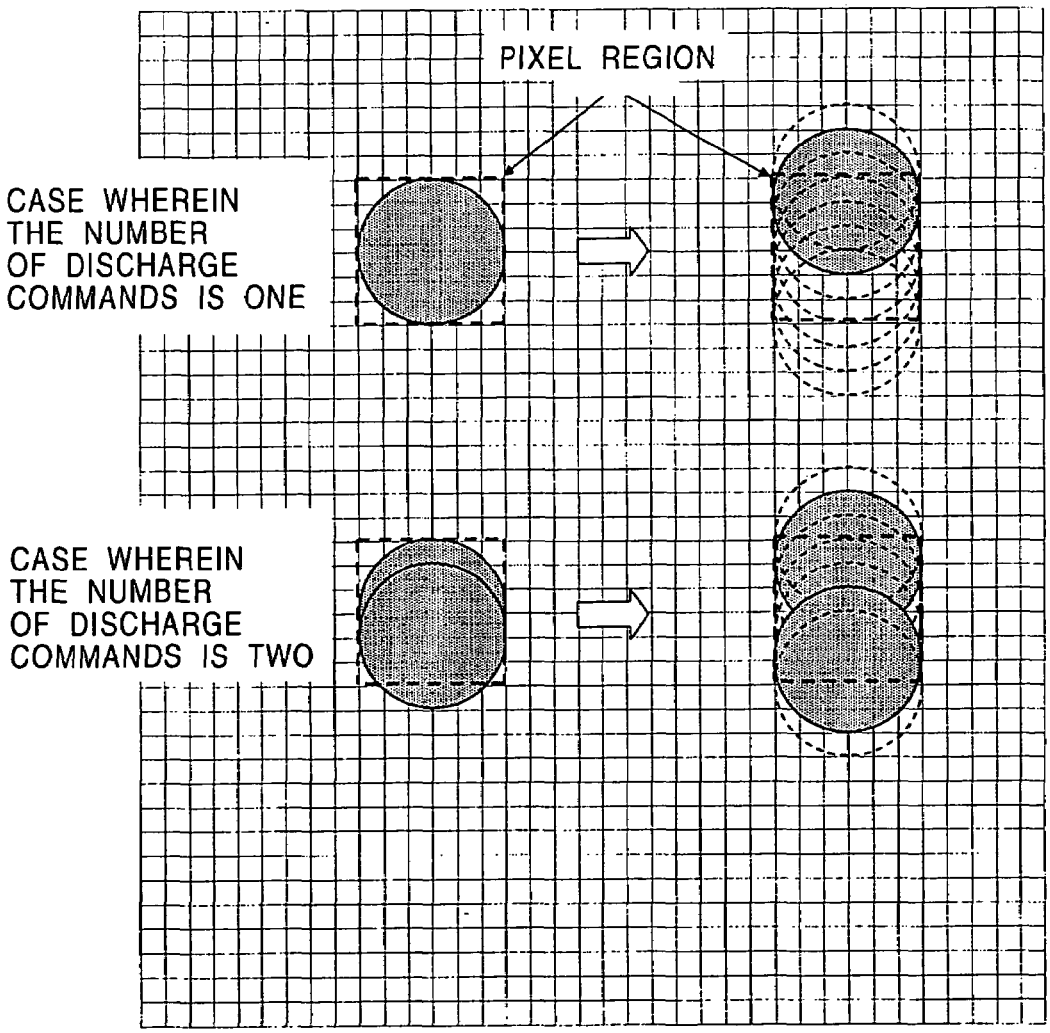
FIG. 8 is a plan view which shows a state example wherein a maximum of N ink liquid droplets are arrayed and overlapped at random within a single pixel region along the transporting direction for the printing paper sheet.

FIG. 8 is a plan view which shows an example wherein a maximum of N (N=8 in the present embodiment) ink liquid droplets are arrayed and overlapped at random within a single pixel region along the transporting direction for the printing paper sheet. Note that the state of the landing positions with the present embodiment is shown on the right side in the drawing, while the state thereof with the conventional arrangement is shown on the left side as a comparative example, in the same way as in FIG. 7. In this example, the state is shown wherein the ink liquid droplet has landed at a position selected from the N (=8) target landing position candidates (one of the eight target landing portions corresponds to the state wherein the ink liquid droplet has not been discharged), in the same way as in FIG. 7.

Note that with the present embodiment, the ink liquid droplets can be discharged N times for each pixel region along the main scanning direction.

First, with the conventional arrangement, in the event that the number of the discharge command signals is one for each pixel region, the ink liquid droplet is discharged in the same way as described above. On the other hand, with the present embodiment, a maximum of N target landing position candidates of the ink liquid droplet are determined for each pixel along the vertical direction (the transporting direction for the printing paper sheet, main scanning direction, or the direction vertical to the direction of the array of the nozzles 18), the target landing position is selected therefrom at random, and the ink liquid droplet is discharged so as to land at the selected position.

FIG. 8 shows an example wherein with the present embodiment with the number of the discharge command signals of one, the ink liquid droplet is discharged so as to land at the second target landing position from the top.

Note that with the present embodiment, the ink liquid droplets are discharged so as to land on the recording medium at random along the transporting direction for the printing paper sheet, and accordingly, such a circuit as described above is not required for causing deviation of the discharge direction, rather, the discharge command signals should be input to the head 11 at a predetermined time corresponding to transporting of the printing paper sheet. For example, in FIG. 8, let us say that the center of the pixel region generally matching the center of the ink liquid droplet will be referred to as "reference point" hereafter, and the discharge-time difference corresponding to the landing-position deviation of one division will be referred to as ΔT.

In the example according to the present embodiment shown in FIG. 8, wherein the number of the discharge command signals is one, the ink liquid droplet has landed at a position upward from the reference position by two divisions. Accordingly, the ink liquid droplet should be discharged at an earlier time than the reference discharge time by 2×Δ. Conversely, in the event that the ink liquid droplet is discharged so as to land at a the lowest position within the pixel region, for example, the ink liquid droplet should be discharged so as to land at a position downward from the reference position by three divisions. Accordingly, the ink liquid droplet should be discharged at a later time than the reference discharge time by 3×Δ.

In the same way, with the conventional method arrangement with two discharge command signals, the ink liquid droplets are discharged in the same way as in FIG. 7. On the other hand, with the second discharge according to the present embodiment, the target landing position is selected from the candidates at random regardless of the discharge of the first ink liquid droplet, and the ink liquid droplet is discharged so as to land in the selected position. In the example shown in FIG. 8, the drawing shows the state wherein with the method arrangement with two discharge commands, the ink liquid droplet has landed at a position deviating downward from the reference position.

The number of the pattern combinations with a discharge command signal number of 0 to N, and the number of discharge times of K is the number of the combinations of K taken from N, and accordingly, the aforementioned number of the pattern combinations is represented by the following expression.

$$_{N}C_{K}={}_{N}P_{K}/K!$$

Accordingly, the probability of occurrence of the same random pattern for the same discharge command signal is represented by $1/_{N}C_{K}$.

As described above, with the present embodiment, the ink liquid droplets are discharged so as to land on random positions for each pixel region, thereby leveling power consumption for discharging, and thereby leveling the timing of ink supply, as well as having the advantage of the fact that the irregularities in the image are less conspicuous.

With the thermal-method arrangement as with the present embodiment, wherein the ink liquid droplets are discharged by heating the ink using the heating resistors 13, a relatively large amount of energy is required for discharging the ink liquid droplet. For example, the energy of around 0.7 to 0.8 W is required for each ink discharge portion. With the conventional arrangement, the line head 10 has a configuration wherein the multiple heads 11 having such properties are arrayed, and power consumption occurs at the same time for discharging the ink, and accordingly, the load on the power source is extremely high. On the other hand, with the present embodiment, the ink liquid droplets are discharged with random timing, and accordingly, the number of the ink discharge portions, which is to be driven so as to perform discharge at the same time during printing operation, is reduced, thereby reducing concentration of occurrence of power consumption.

Furthermore, one point which is true with regard to both the thermal method and the piezo-method, is that the higher the printing speed is, the higher the movement speed of the ink is within the ink channels. In this case, in the event that the ink is supplied for all the ink channels at the same time, the pressure of the ink within the ink channels is reduced, often leading to a problem of occurrence of bubbles in the ink. The problem of the occurrence of the bubbles leads to a problem of the change in the meniscus, further leading to a problem of the change in the amount of the discharged ink liquid droplet. Accordingly, the movement of the ink within the ink channels is preferably performed with a low and uniform speed over a period for ink supply. With the present embodiment, the ink liquid droplets are discharged with random timing, thereby improving the uniformity of the ink supply from the ink channels.

Furthermore, with the liquid discharge device employing both the method wherein the ink liquid droplets are discharged so as to land at random at a position along the transporting direction for the printing paper sheet (the direction generally vertical to the direction of the array of the nozzles 18) within each pixel region as shown in FIG. 8, and the method wherein the ink liquid droplets are discharged with deviation so as to land at random at a position along the direction of the array of the nozzles 18 as described with reference to FIG. 7, the ink liquid droplets land within a wider region at random for each pixel region, thereby improving the advantages due to the landing positions of the ink liquid droplets being determined at random.

Figure 9:
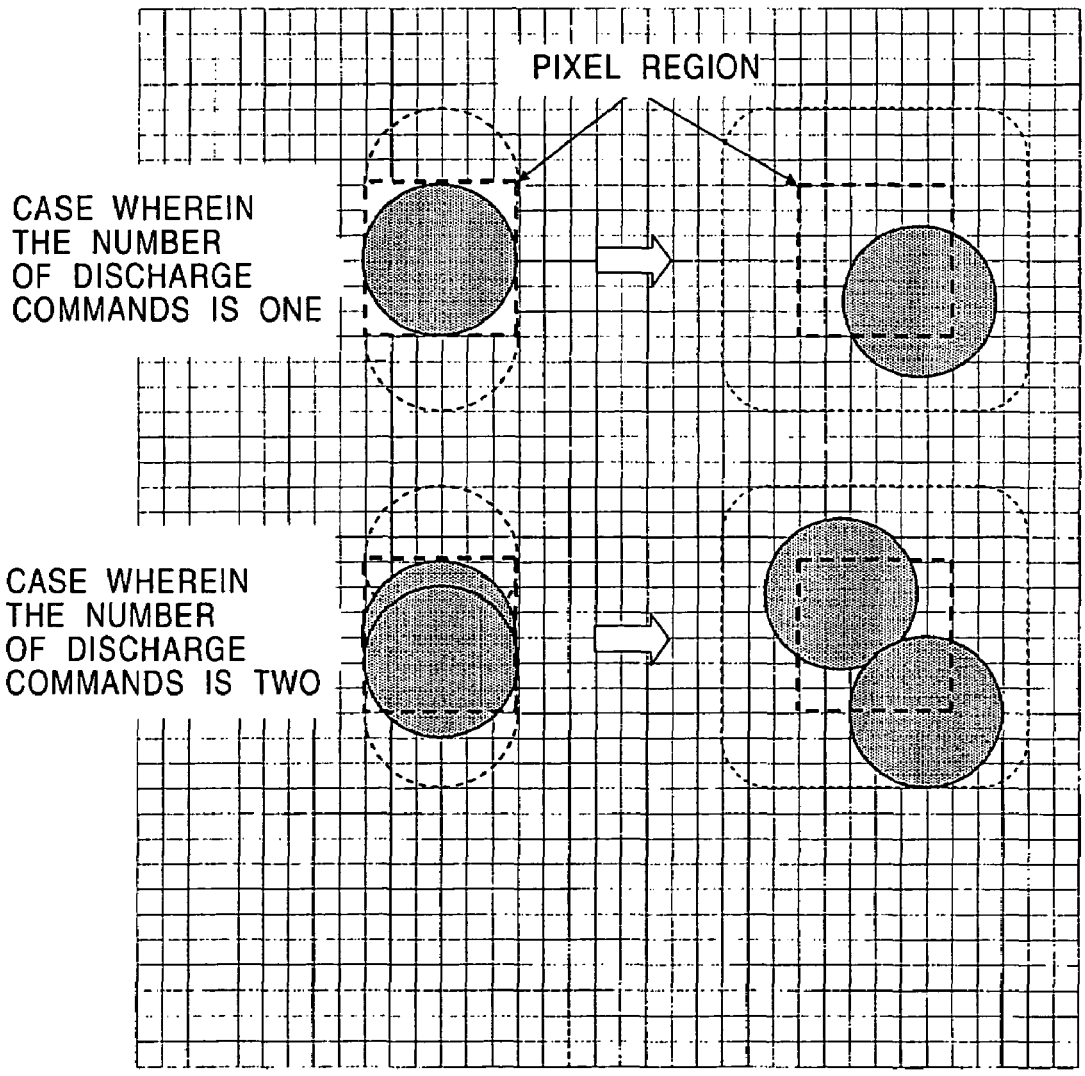
FIG. 9 is a plan view which shows a state example wherein the ink liquid droplets are discharged so as to land at predetermined pixel region with random deviation in both the vertical and horizontal directions.

FIG. 9 is a plan view for describing the above-described example, wherein a conventional method arrangement is shown on the left side, and a method arrangement according to the present embodiment is shown on the right side.

With the conventional method arrangement, the ink liquid droplet lands at a target landing position without deviating in the direction of the array of the nozzles 18, or in the direction vertical to the aforementioned direction. On the other hand, with the present embodiment, the ink liquid droplets are discharged so as to land with deviation in the direction of the array of the nozzles 18 (in the horizontal direction in the drawing), and in the direction vertical to the aforementioned direction (in the vertical direction in the drawing). Thus, the ink liquid droplet lands at a position with a deviation at random in both the vertical and horizontal directions. With the present embodiment, the ink liquid droplets are discharged so as to land at random within the pixel region expanding in the horizontal and vertical direction by the radius of the dot. Thus, the gap between the adjacent dots is filled with a random pattern of dots.

Figure 10:
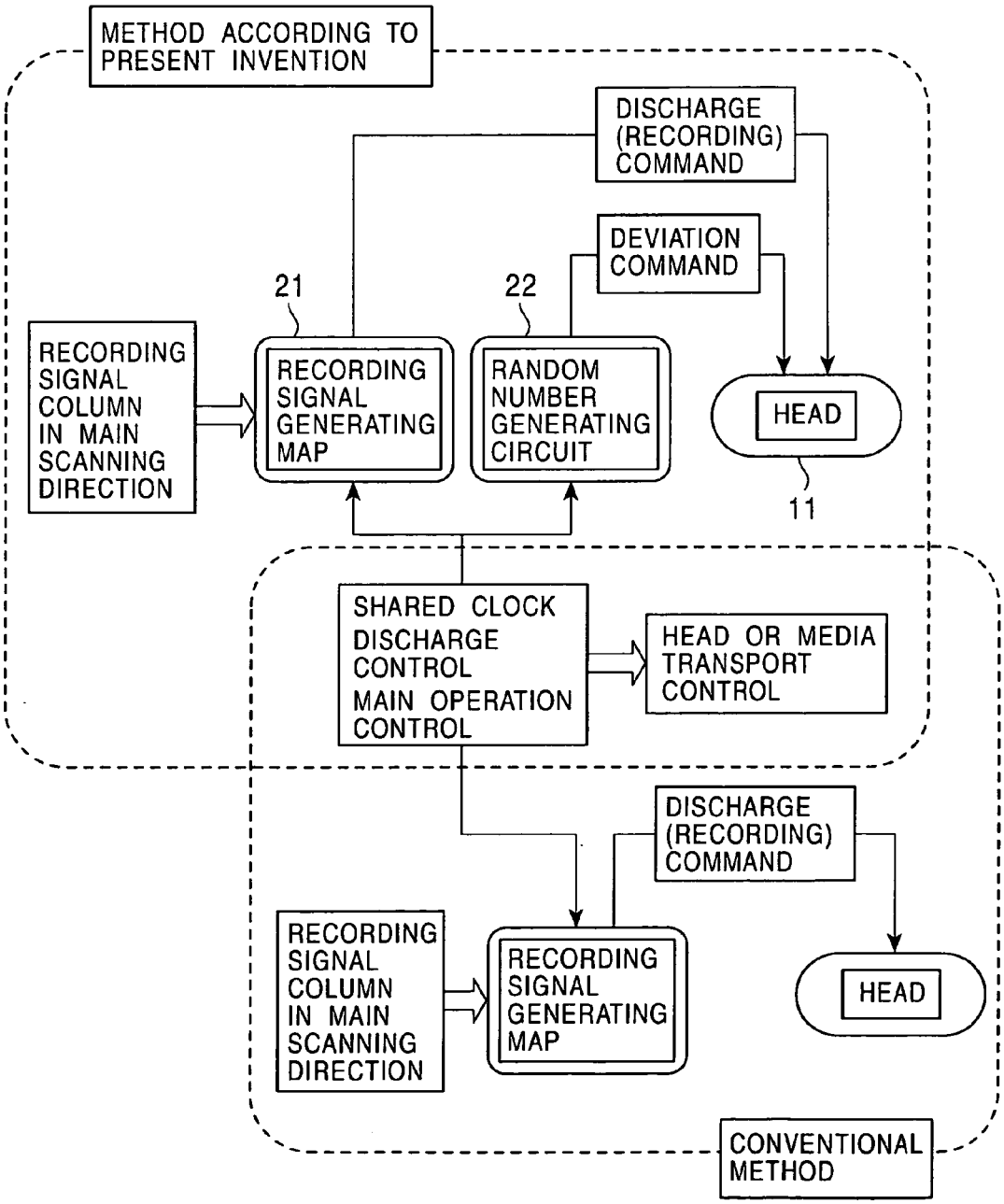
FIG. 10 is a schematic diagram for describing control performed such that an ink liquid droplet is discharged so as to land within a predetermined pixel region with random deviation.

FIG. 10 is a diagram for describing a schematic configuration of the control for discharging the ink liquid droplet so as to land at random as described above. FIG. 10 shows a schematic configuration of the control with a conventional method arrangement as a comparative example.

In FIG. 10, a recording signal generating map 21 is used for determining a position, at which the ink liquid droplet is discharged so as to land, along the transporting direction for the printing paper sheet. For example, in the event that two ink liquid droplets are discharged for each pixel region, two positions are selected from N target landing position candidates shown in FIG. 8. The discharge timing corresponding to the transporting direction for the printing paper sheet is controlled according to the recording signal generating map 21.

With the conventional method arrangement, discharge command signals are transmitted to the head 11 only based upon the recording signal generating map. On the other hand, with the present embodiment, discharge is performed by the head 11 according to the command signals from the recording signal generating map 21 and a ransom number generating circuit 22. More specifically, for deviation in the direction of the array of the nozzles 18, deviation direction (target landing position of the ink liquid droplet) is determined at random based upon the signals from the random number generating circuit 22, and the deviation command signals are transmitted to the head 11.

At the same time, the system determines the timing for the ink-liquid-droplet discharge with reference to the recording signal generating map 21, and the determined discharge command signals are transmitted to the head 11. Thus, the ink liquid droplet is discharged on the pixel region with a random deviation in both the direction of the array of the nozzles 18, and the direction (main scanning direction) generally vertical to the aforementioned direction. Thus, the ink liquid droplet lands at a position for each pixel region with random deviation in both the direction of the array of the nozzles 18, and the direction vertical to the aforementioned direction, as shown in FIG. 9.

Next, description will be made regarding a configuration for providing the deviation command signals for controlling the deviation of the discharge direction of the ink liquid droplet. In principle, the deviation command signals are preferably provided to each ink discharge portion. In this case, the arrangement, wherein the ink liquid droplets are discharged onto M divided positions from each ink discharge portion, requires $\log_2 M$ bit signals. For example, in the event that M=8 as described above, 3-bit signals are required.

The head 11 is formed of an array of at least several hundred of the ink discharge portions. Accordingly, an arrangement, wherein independent data signals for controlling a timing and voltage value are provided to all the ink discharge portions, requires wiring for the great number of data signals, and accordingly, the size of the head 11 is extremely increased. Accordingly, it is impossible to manufacture such an arrangement in actual practice. Accordingly, with the present embodiment, an arrangement has a configuration wherein the terminals of all the ink discharge portions for controlling the same bit are connected one to another for controlling the discharge direction for each ink discharge portion, or an arrangement has a configuration wherein the discharge direction is controlled for all the ink discharge portions using the serialized signals.

Figure 11:
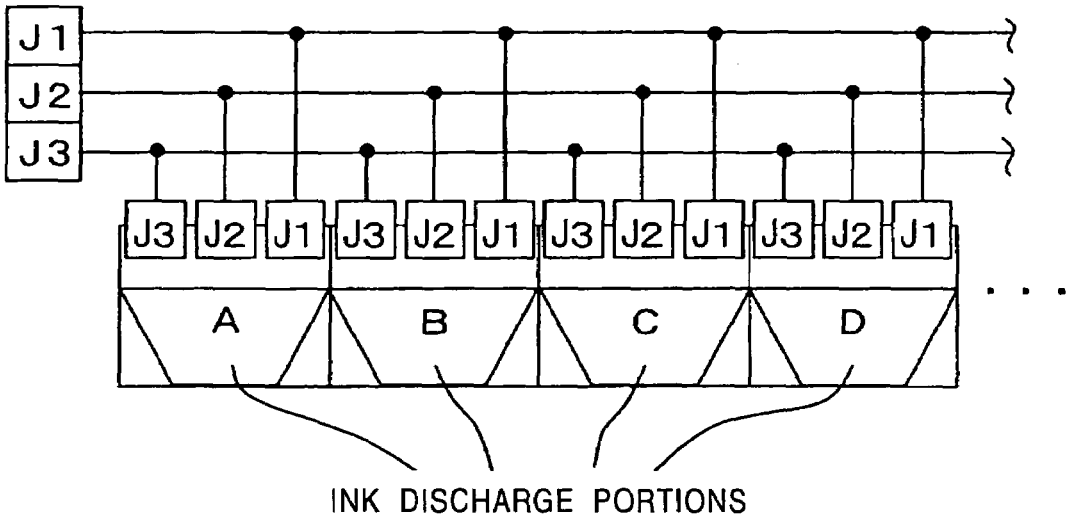
FIG. 11 is a diagram which shows the wiring of the ink discharge portions in the present embodiment.

FIG. 11 is a diagram for describing a connection configuration for each ink discharge portion according to the present embodiment. In this example, let us say that the number M is 8, i.e., 3-bit signals are used, and the bits of the signal will be referred to as "J1", "J2", and "J3". Note that FIG. 11 illustrates four ink-discharge portions A through D.

While in this case, each ink discharge portion is controlled with 3-bit signals with a configuration wherein the terminals of all the ink discharge portions for the same bit are connected one to another in parallel for each bit, a circuit arrangement may be made wherein signals are serialized so as to be provided to each ink discharge portion with a single line.

Next, description will be made below regarding the reasons why the adjacent ink discharge portions discharge the ink liquid droplet so as to form different random dot patterns even in a case of employing the above-described method wherein the terminals of all the ink discharge portions for the same bit are connected one to another in parallel for each bit.

The first reason is that all the ink discharge portions connected in parallel are not driven so as to discharge the ink liquid droplets at the same time. Furthermore, while multiple ink discharge portions are driven at the same time, the adjacent ink discharge portions are not driven at the same time. With the present embodiment, such a countermeasure is employed, and accordingly, the adjacent ink discharge portions hardly form the same random dot pattern.

While in general, multiple ink discharge portions discharge the ink liquid droplets at the same time, the ink liquid droplets discharging at the same time are somewhat distanced one from another. Now, description will be made below regarding another advantage due to the fact that the adjacent ink discharge portions are not driven at the same time. For example, in the event that an ink liquid droplet is discharged from an ink discharge portion, the vibration due to the discharge operation propagates to the ink liquid chamber or the ink channels, and furthermore, the adjacent ink discharge portion is influenced by the discharge operation.

Specifically, the change in the meniscus (the position of the ink level within the nozzle) occurs in the adjacent ink discharge portion due to the discharge operation. In the event that the ink liquid droplet is discharged from the ink discharge portion with irregularities of the meniscus, the dot which has landed on the recording medium has irregularities in the size thereof, and accordingly, the ink discharge portions close one to another are not driven at the same time. Accordingly, ink discharge control is performed such that upon an ink liquid droplet being discharged from an ink discharge portion, the adjacent ink discharge portions are not driven for a predetermined period required for the meniscus returning to the normal state, as well as the ink discharge portions somewhat distanced therefrom being driven so as to discharge the ink liquid droplets. Thus, with the present embodiment, even in the event that the same 3-bit signals are provided to all the ink discharge portions, the adjacent ink discharge portions are not driven so as to discharge the ink liquid droplets at the same time, whereby no serious problem occurs.

Note that in the event that a problem occurs where the same signals are input to the adjacent ink discharge portions due to printed data, e.g., picture data or the like, an arrangement may be made wherein the multiple recording generating maps 21 are included, the adjacent ink discharge portions are driven based upon different recording generating maps. Furthermore, an arrangement may be made in the event that the number of times which the adjacent ink discharge portions are to be driven, so as to discharge the ink liquid droplets, is the same, different command signals are input to the adjacent ink discharge portions. Furthermore, in this case, an arrangement may be made wherein different deviation command signals are input to the adjacent ink discharge portions so as to form different random dot patterns, at a timing prior to the discharge operation of the adjacent ink discharge portions.

While description has been made regarding the line-method arrangements including a line head formed of the heads 11 arrayed so as to cover a length corresponding to the entire width of a printing paper sheet as shown in FIG. 2, the present embodiment may be applied to serial-method arrangements.

The serial-method arrangement according to the present embodiment has a configuration wherein a single head 11 is included, and the head 11 and a printing paper sheet are moved relatively in the scanning direction, as well as the ink liquid droplets are discharged onto the pixel regions during the relative movement. Note that in general, the relative movement is performed such that the printing paper sheet is maintained stationary, and head 11 is moved in the width direction of the printing paper sheet.

Figure 12:
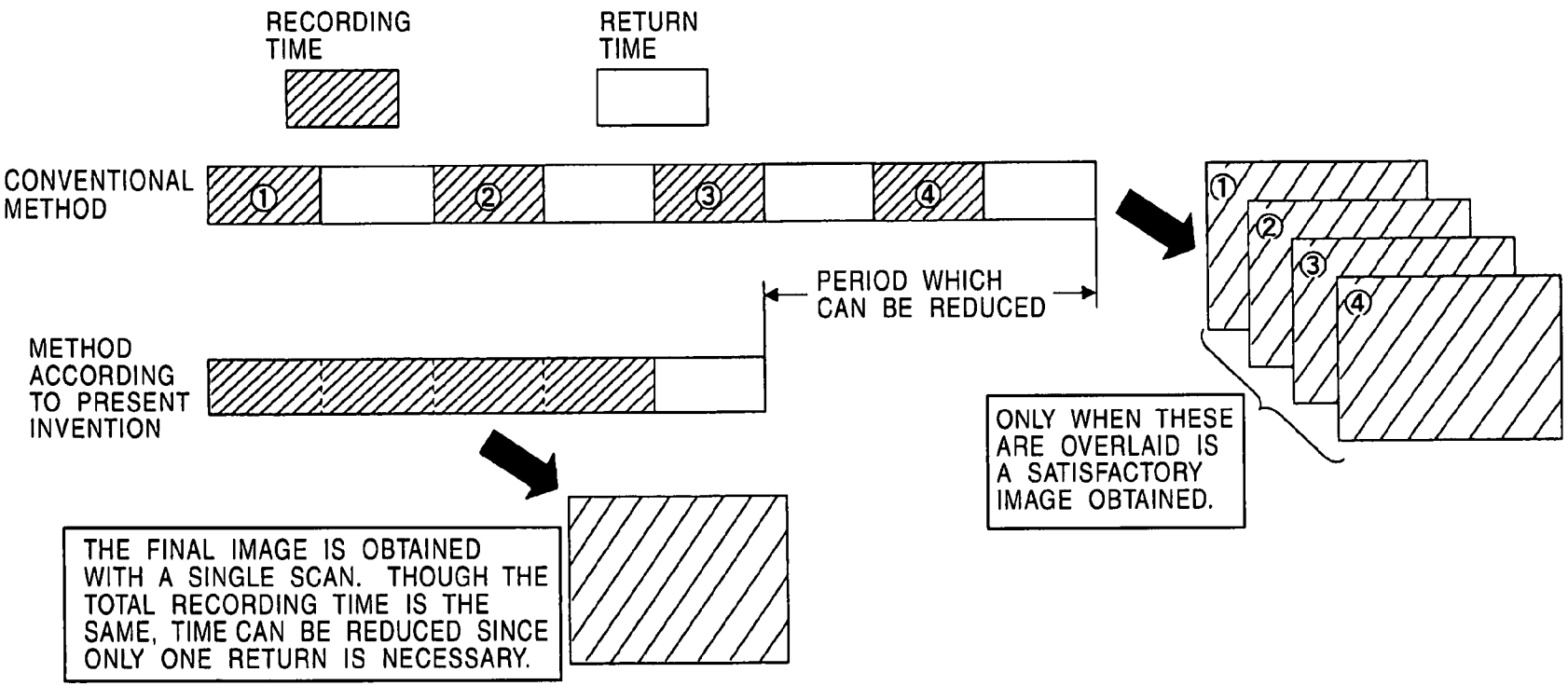
FIG. 12 is a diagram for describing a printing arrangement according to the present invention, and a conventional serial-method printing arrangement as a comparative example.

FIG. 12 is a diagram for describing a serial-method printing arrangement according to the present invention, and a conventional serial-method printing arrangement as a comparative example.

In the following description, let us say that four ink liquid droplets are discharged so as to land within a single pixel region, whereby a single pixel is formed.

In this case, with the conventional printing arrangement, printing four times by scanning along the main scanning direction is required for forming a pixel. For example, a first ink liquid droplet is discharged so as to land within a single pixel region along the main scanning direction, following which the printing paper sheet is moved a little, and print is performed again along the main scanning direction such that the first and the second ink liquid droplets overlap each other. Such print is repeated four times, whereby a pixel is formed.

Note that in the example shown in FIG. 12, the time for returning the head is determined to be generally the same as the time for performing printing with a single scanning along the main scanning direction.

On the other hand, the serial-method printing arrangement according to the present invention has a configuration wherein the head 11 is disposed such that the longitudinal direction of the head 11 matches the sub-scanning direction (transporting direction for the printing paper sheet). That is to say, the head 11 is disposed with an attitude rotated by 90° as compared with the parallel-method arrangement including a line head 10.

With the serial-method printing arrangement according to the present invention, at the time of performing printing while scanning the head 11 in the main scanning direction, the ink liquid droplets are discharged with a deviation of the discharge direction determined at random. Note that with the serial-method printing arrangement according to the present invention, the head 11 is disposed with an attitude rotated by 90° as compared with the parallel-method arrangement, and accordingly, the deviation direction of the discharge direction of the ink liquid droplets matches the sub-scanning direction (transporting direction of the printing paper sheet).

While in this example, four ink liquid droplets are discharged within a single pixel region, with the arrangement according to the present embodiment, the four discharge operations are performed during a single scanning of the head 11 along the main scanning direction. Accordingly, the method arrangement according to the present invention requires a scanning period four times as great as with the conventional method arrangement. That is to say, a single scanning period in the main scanning direction according to the present invention matches the sum of the four scanning periods for print in the main scanning direction with the conventional method arrangement.

However, in order to complete print of the pixel regions arrayed on a single line along the main scanning direction, the conventional printing arrangement requires four periods in time for printing with scanning along the main scanning direction, and four periods in time for returning the head. That is to say, with the conventional method arrangement, the ink liquid droplets cannot be discharged with deviation, and accordingly, in the event that multiple ink liquid droplets are discharged for each pixel region, printing with scanning along the main scanning direction must be repeated according to the number of the ink liquid droplets to be discharged within a single pixel region.

On the other hand, in order to complete print of the pixel regions arrayed on a single line along the main scanning direction, the method arrangement according to the present invention requires print with a single scan along the main scanning direction. That is to say, with the arrangement method according to the present invention, multi-printing can be performed by printing with a single scanning along the main scanning direction.

Thus, with the printing arrangement according to the present invention, the number of head-returning operations is reduced to one, and accordingly, the print time is reduced by the period required for three head-returning operations, as compared with the conventional printing arrangements.

Furthermore, with the conventional serial-method printing arrangement, a problem occurs often where streaks occur along the width direction of the printing paper sheet due to irregularities in an array of the landing ink liquid droplets along the sub-scanning direction (the longitudinal direction of the printing paper sheet, i.e., the transporting direction for the printing paper sheet). On the other hand, with the serial-method arrangement according to the present invention, the ink liquid droplets are discharged with random deviation in the sub-scanning direction, whereby the irregularities in the image due to irregularities in an array of the landing ink liquid droplets are less conspicuous.

While description has been made regarding the first embodiment according to the present invention, the present invention is not restricted to the above-described first embodiment, rather, various modifications may be made as follows.

(1) With the arrangement according to the present embodiment, while multiple ink liquid droplets are discharged so as to land at portions selected from M divided target landing position candidates at random for each pixel region, the number M may be any of positive integers of 2 or more, and is not restricted to a particular one employed in the first embodiment. In the same way, the number N which is the number of the landing ink liquid droplets within each pixel region along the transporting direction for the printing sheet paper (the direction generally vertical to the direction of the array of the ink discharge portions) may be determined to any positive integer. That is to say, M may be equal to N, or M may be different from N.

Furthermore, with the present invention, the maximum number of the landing ink droplets within each pixel region (which corresponds to the maximum number of tones) is not restricted to a particular one.

(2) While with the present embodiment, the ink liquid droplets are discharged such that the center of each landing ink liquid droplet is included within the corresponding pixel region, the present invention is not restricted to the above-described arrangement, rather an arrangement may be made wherein the ink liquid droplets are discharged such that at least a part of each landing ink liquid droplet is included within the corresponding pixel region, thereby obtaining a random dot pattern for each pixel region over a wider region than with the present embodiment.

(3) While with the arrangement according to the present embodiment, the target landing position of the ink liquid droplet is selected at random using the random number generating circuit 22, any method may be employed for selecting the target landing position of the ink liquid droplet at random, as long as the array of the selected landing positions exhibits a random dot pattern without a particular pattern. Furthermore, as methods for generating random numbers, the middle square method, the congruent method, shift-register method, and the like, are known.

(4) While with the present embodiment, 3-bit control signal of J1 through J3 is employed as shown in FIG. 11, the control signal according to the present invention is not restricted to a particular one, rather the control signal with any bit number may be employed.

(5) With the present embodiment, two-divided heating resistors 13 are disposed in parallel, and the currents supplied to the two-divided heating resistors 13 are adjusted so as to control the difference in time requiring for boiling the ink (bubble generating time) between these two divided heating resistors 13. However, the present invention is not restricted to the above-described embodiment, rather an arrangement may be made wherein the timing for supplying the currents to the two-divided resistors 13 is controlled while maintaining the same supplied current to the two-divided resistors 13. For example, an arrangement may be made wherein the two-divided heating resistors 13 include independent switches, and the timing of on/off switching of each switch is controlled so as to control the difference in bubble generation time between these two divided heating resistors 13. Furthermore, an arrangement according to the present invention may employ the combination of the above-described method wherein the currents supplied to the two-divided heating resistors 13 are adjusted, and the above-described method wherein the timing for supplying the currents to the two-divided resistors 13 is controlled.

(6) In the present embodiment, description has been made regarding the arrangement wherein each ink liquid chamber 12 includes two divided heating resistors 13 arrayed in parallel. In this case, it has been confirmed that the above-described arrangement has sufficient endurance. Furthermore, this arrangement has a simple configuration. However, an arrangement according to the present invention is not restricted to this arrangement, rather an arrangement may be made wherein each ink liquid chamber 12 includes three or more heating resistors 13 in parallel.

(7) In the present embodiment, while description has been made regarding the arrangement wherein each ink discharge portion includes the heating resistors 13 for performing discharge with the thermal method, the discharge method according to the present invention is not restricted to this method, rather, electrostatic-discharge method or the piezo method may be employed.

An electrostatic-discharge energy generating device (which corresponds to the heat resistor 13) has a configuration wherein two electrodes are disposed on the bottom face of a vibrating plate arrayed so as to introduce an air chamber therebetween. With the aforementioned electrostatic-discharge energy generating device, a voltage is applied between both the electrodes so as to cause deviation of the vibrating plate downward, following which the supplied voltage is turned off so as to release the electrostatic force. As a result, the vibrating plate is returned to the normal state, and the released elastic power causes ink discharge.

In order to control the difference in the energy occurring between the energy generating devices, the arrangement employing the aforementioned electrostatic-discharge energy generating devices has a configuration wherein the difference in the timing of returning the vibrating plate (releasing the electrostatic power by turning off the voltage) between the two energy generating devices is controlled, or each of the voltages supplied to the two energy generating devices are controlled.

On the other hand, a piezo energy generating device has a layered configuration formed of a piezo device having electrodes on both faces thereof, and a vibrating plate. In this case, upon a voltage being applied between both the electrodes of the piezo device, bending moment occurs as to the vibrating plate due to the piezoelectric effect, deviation of the vibrating plate occurs. With this arrangement, the ink liquid droplet is discharged using the energy due to the deviation.

In order to control the difference in the energy occurring between the energy generating devices, this arrangement has a configuration wherein the difference in the timing of voltage supply between two piezo devices is controlled, or each of the voltages supplied to the two piezo devices are controlled.

(8) In the present embodiment, description has been made regarding the arrangement wherein the deviation of the discharge direction of the ink liquid droplets is controlled along the direction of the array of the ink discharge portions (nozzles 18). The reason is that the two-divided heating resistors 13 are arrayed in the direction of the array of the ink discharge portions. However, there is no need for the direction of the array of the ink discharge portions to completely match the deviation direction of the discharge direction of the ink liquid droplets, rather, an arrangement wherein these two directions generally match each other has generally the same advantages. Thus, an arrangement may be made wherein these two directions generally match each other.

(9) In the present embodiment, while description has been made regarding the arrangement wherein the ink liquid droplet is discharged from the corresponding ink discharge portion, i.e., the ink discharge portion at a position generally directly above the pixel region, so as to land on the pixel region, the present invention is not restricted to this arrangement, rather, an arrangement may be made wherein the ink liquid droplet is discharged from one of the ink discharge portions adjacent to the corresponding discharge portion.

For example, let us say that the ink liquid droplets are discharged from the adjacent ink discharge portions "X" and "X+1", and the pixel regions corresponding to the ink discharge portions "X" and "X+1" are the pixel region "Y" and "Y+1", respectively.

In this case, the ink discharge portion "X" can discharge an ink liquid droplet on the adjacent pixel region "Y+1", as well as on the corresponding pixel region "Y". In the same way, the ink discharge portion "X+1" can discharge the ink liquid droplet on the adjacent pixel region "Y", as well as on the corresponding pixel region "Y+1".

Note that in this case, in the event that the ink discharge portion "X" discharges an ink liquid droplet on the pixel region "Y+1", adjacent to the corresponding pixel region, for example, the target landing position is selected from the M target landing position candidates for the pixel region "Y+1" described above. The same operation is performed in each case.

Thus, in the event that an ink liquid droplet is discharged on the pixel region "Y", for example, an ink droplet can be discharged from the ink discharge portion "X", and also an ink droplet can be discharged from the ink discharge portion "X−1", so as to land on the pixel region "Y". Furthermore, an ink liquid droplet can be discharged from the ink discharge portion "X+1" so as to land on the pixel region Y.

Note that the present invention is not restricted to the arrangement wherein the ink discharge portion "X" can discharge an ink liquid droplet on the pixel region "Y−1", or "Y+1", adjacent to the corresponding pixel region, for example, an arrangement may be made wherein the ink discharge portion "X" can discharge an ink liquid droplet on any pixel region near the corresponding pixel region, such as the pixel regions "Y−2" or "Y+2", for example.

Thus, with the above-described arrangement, multiple ink liquid droplets are discharged on each pixel region from multiple ink discharge portions for forming a single dot, whereby the irregularities in the image due to irregularities of an array of the ink discharge portions are even less conspicuous (detailed description will be made in a second embodiment regarding the advantage).

Furthermore, an arrangement may be made wherein while ink liquid droplets are discharged on a certain pixel region from a single ink discharge portion, ink liquid droplets are discharged on the pixel region at a position downward by one pixel from multiple ink discharge portions, for example.

Second Embodiment

Next, a second embodiment according to the present invention will be described. Note that description of the same configuration as with the first embodiment will be omitted.

It is a principal object of the present second embodiment to provide an arrangement wherein occurrence of defects in the image due to malfunctioning of the head, such as occurrence of streaks between the pixel columns or the like is suppressed, even in the event that malfunctioning such as non-discharge occurs in a part of the liquid discharge portions.

Furthermore, it is another object (secondary object) thereof to provide an arrangement wherein the irregularities in an array of landing positions of the liquid droplets are less conspicuous.

Accordingly, the arrangement according to the present embodiment includes the head 11 employing the discharge direction varying means described in the first embodiment, first discharge control means, second discharge control means, and third discharge control means, described below, so as to perform discharge control described below.

(First Discharge Control Means)

The first discharge control means performs discharge control such that multiple ink liquid droplets are discharged with deviation on each pixel column from at least two liquid discharge portions positioned close one to another so as to form each pixel column, or multiple ink liquid droplets are discharged with deviation on each pixel region from at least two liquid discharge portions positioned close one to another, so as to form each pixel column or each pixel.

A first arrangement of the first discharge control means according to the present invention has a configuration wherein the discharge direction of the ink liquid droplet from each nozzle 18 can be selected from the even number $2^J$ (J denotes a positive integer) of the different directions using J-bit control signals, and the maximal distance between the landing positions corresponding to the aforementioned $2^J$ different directions is determined to the value wherein the interval between the adjacent nozzles 18 is multiplied by $(2^J-1)$. With this arrangement, an ink liquid droplet is discharged from the nozzle 18 in a direction selected from the aforementioned $2^J$ directions.

A second arrangement of the first discharge control means according to the present invention has a configuration wherein the discharge direction of the ink liquid droplet from each nozzle 18 can be selected from the odd number $(2^J+1)$ (J denotes a positive integer) of the different directions using (J+1)-bit control signals, and the maximal distance between the landing positions corresponding to the aforementioned $(2^J+1)$ different directions is determined to the value wherein the interval between the adjacent nozzles 18 is multiplied by $2^J$. With this arrangement, an ink liquid droplet is discharged from the nozzle 18 in a direction selected from the aforementioned $(2^J+1)$ directions.

For example, with the above-described first arrangement employing the control signals with the bit number of (J=2), the number of the discharge direction candidates for selecting the discharge direction is $2^J=4$, which is an even number. On the other hand, the maximal distance between the landing positions corresponding to the aforementioned $2^J$ directions is the value wherein the interval between the adjacent nozzles 18 is multiplied by $((2^J-1)=3)$.

In this case, with the head 11 having the resolution of 600 DPI, the aforementioned value, wherein the interval between the adjacent nozzles 18 is multiplied by 3, is equal to (42.3 μm (the interval between the adjacent nozzles)×3)=126.9 μm. As described above, the maximal distance between the aforementioned landing position candidates is set to this value, i.e., 126.9 μm. Note that the distance H between the tip of the nozzle 18 and the printing paper sheet P is maintained to 2 mm (=2000 μm). Accordingly, in this case, the deviation angle θ (deg) is represented by tan 2θ=126.9/2000, which is approximately equal to 0.0635. Accordingly, the deviation angle θ is obtained, which is approximately equal to 1.8 (deg).

On the other hand, for example, with the above-described second arrangement employing the control signals with the bit number of J=2+1, the number of the discharge direction candidates for selecting the discharge direction is $2^J+1=5$, which is an odd number. On the other hand, the maximal distance between the landing positions corresponding to the aforementioned $(2^J+1)$ directions is the value wherein the interval between the adjacent nozzles 18 is multiplied by $(2^J=4)$.

Figure 13:
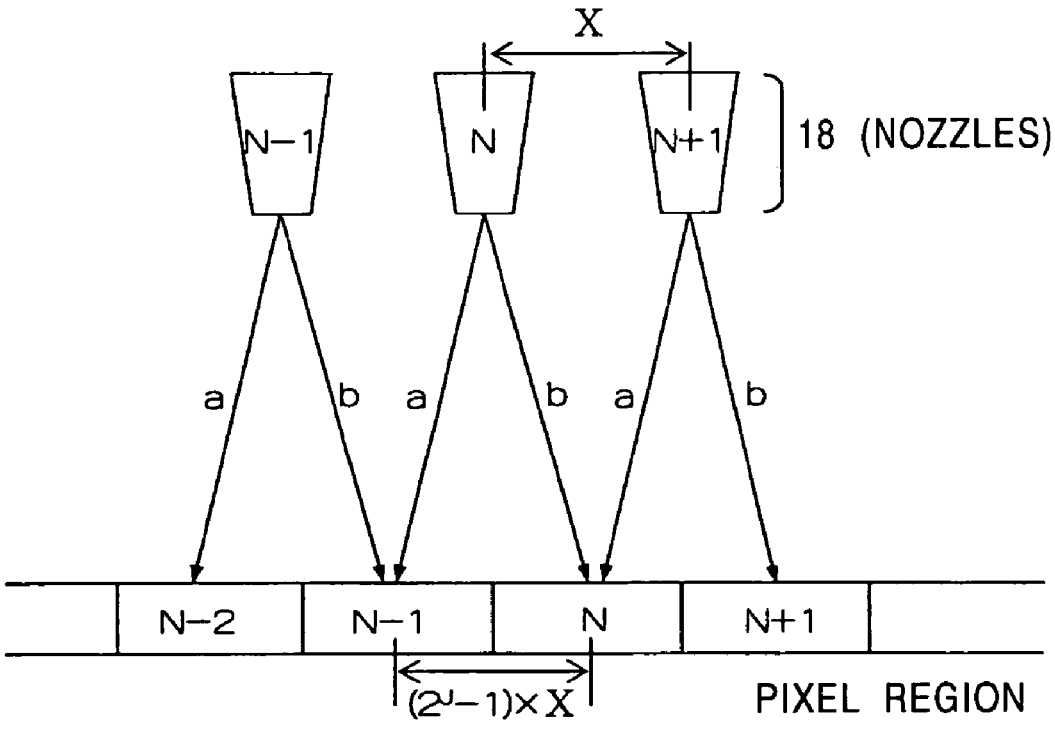
FIG. 13 is a diagram which shows a state example wherein the adjacent liquid discharge portions discharge ink liquid droplets so as to land at a single pixel, wherein the number of discharge direction candidates for each ink discharge portion is an even number.

FIG. 13 is a diagram for describing a more specific example wherein with the above-described first arrangement employing the control signals with the bit number of (J=1), the ink liquid droplets are discharged with deviation. With the above-described first arrangement, the range of the discharge direction of the ink liquid droplets can be determined in a shape left-right symmetrical along the direction of an array of the nozzles 18.

With the present arrangement, the distance between the two $(2^J=2)$ target landing position candidates, serving as the aforementioned maximal distance, is determined to the value wherein the distance between the two adjacent nozzles 18 is multiplied by 1 $(2^J-1=1)$, and accordingly, ink liquid droplets can be discharged onto each pixel region from both the nozzles 18 of the adjacent liquid discharge portions, as shown in FIG. 13. That is to say, as shown in FIG. 13, with the interval between the adjacent nozzles 18 as X, the distance between the adjacent pixel regions is represented by $(2^J-1)\times X$ (in the example shown in FIG. 13, $(2^J-1)\times X=X$).

Note that each landing position is at a position between the positions corresponding to the adjacent nozzles 18.

Figure 14:
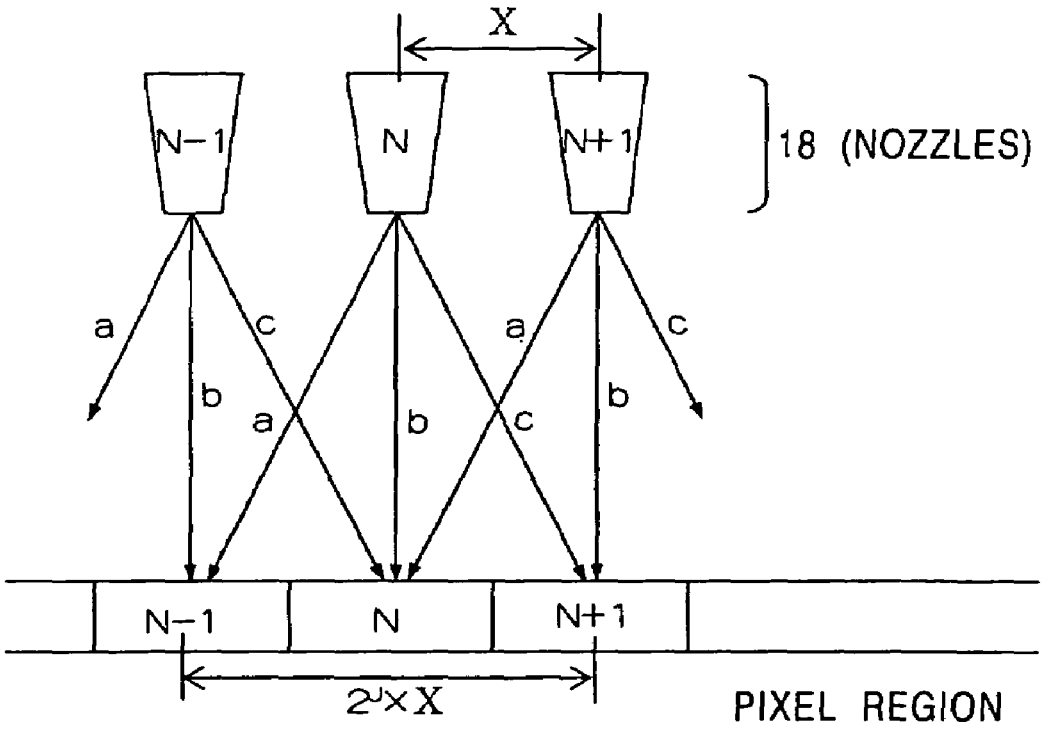
FIG. 14 is a diagram which shows a state example wherein each ink discharge portion discharges an ink liquid droplet with deviation in left-right symmetric directions, and discharges an ink liquid droplet without deviation so as to land at a position directly underneath the ink discharge portion, wherein the number of discharge direction candidates for each ink discharge portion is an odd number.

On the other hand, FIG. 14 is a diagram for describing a more specific example wherein with the above-described second arrangement employing the control signals with the bit number of (J=1+1), the ink liquid droplets are discharged with deviation. With the above-described second arrangement, the number of the discharge direction candidates of the liquid droplets from the nozzle 18 is an odd number. That is to say, while with the first arrangement, an even number of the discharge directions of the ink liquid droplets can be determined in a shape horizontally symmetrical along the direction of an array of the nozzles 18, with the second arrangement employing the control signals with the bit number of (J=1+1), which is greater than the bit number of the first arrangement by +1, each nozzle 18 can discharge an ink liquid droplet straight down. Thus, with the second arrangement, the ink liquid droplet can be discharged in the two left-right symmetrical directions (the discharge directions denoted by "a" and "c" in FIG. 14), and in the straight down direction (the discharge direction denoted by "b" in FIG. 14), whereby the discharge direction can be selected from an odd number of discharge direction candidates.

In the example shown in FIG. 14, the bit number of the control signal is 2 (J=1+1), and the number of the discharge direction candidates is 3 ($2^J$+1). Furthermore, the maximal distance between the landing positions corresponding to the aforementioned 3 (=$2^J$+1) discharge directions is determined to the value (($2^J$×X) in FIG. 14) wherein the interval between the adjacent nozzles 18 (X in FIG. 14) is multiplied by 2 (=$2^J$), and an ink liquid droplet is discharged in any direction selected from the three (=$2^J$+1) discharge direction candidates.

Thus, an ink liquid droplet can be discharged not only on a pixel region N immediately underneath an nozzle N, but also on a pixel regions N−1 and N+1, positioned on both sides thereof.

Furthermore, each landing position of the ink liquid droplet faces one of the nozzles 18.

As described above, with the present embodiment, while the discharge direction candidates are determined based upon the bit number of the control signal, ink liquid droplets can be discharged onto each pixel region from at least two liquid discharge portions (nozzles 18) positioned close one to another. Specifically, with the pitch of an array of the liquid discharge portions in the array direction as "X" as shown in FIGS. 13 and 14, each liquid discharge portion can discharge an ink liquid droplet so as to land at a position deviating from the position directly underneath the liquid discharge portion by (±(½×X)×P) (P is a positive integer).

Figure 15:
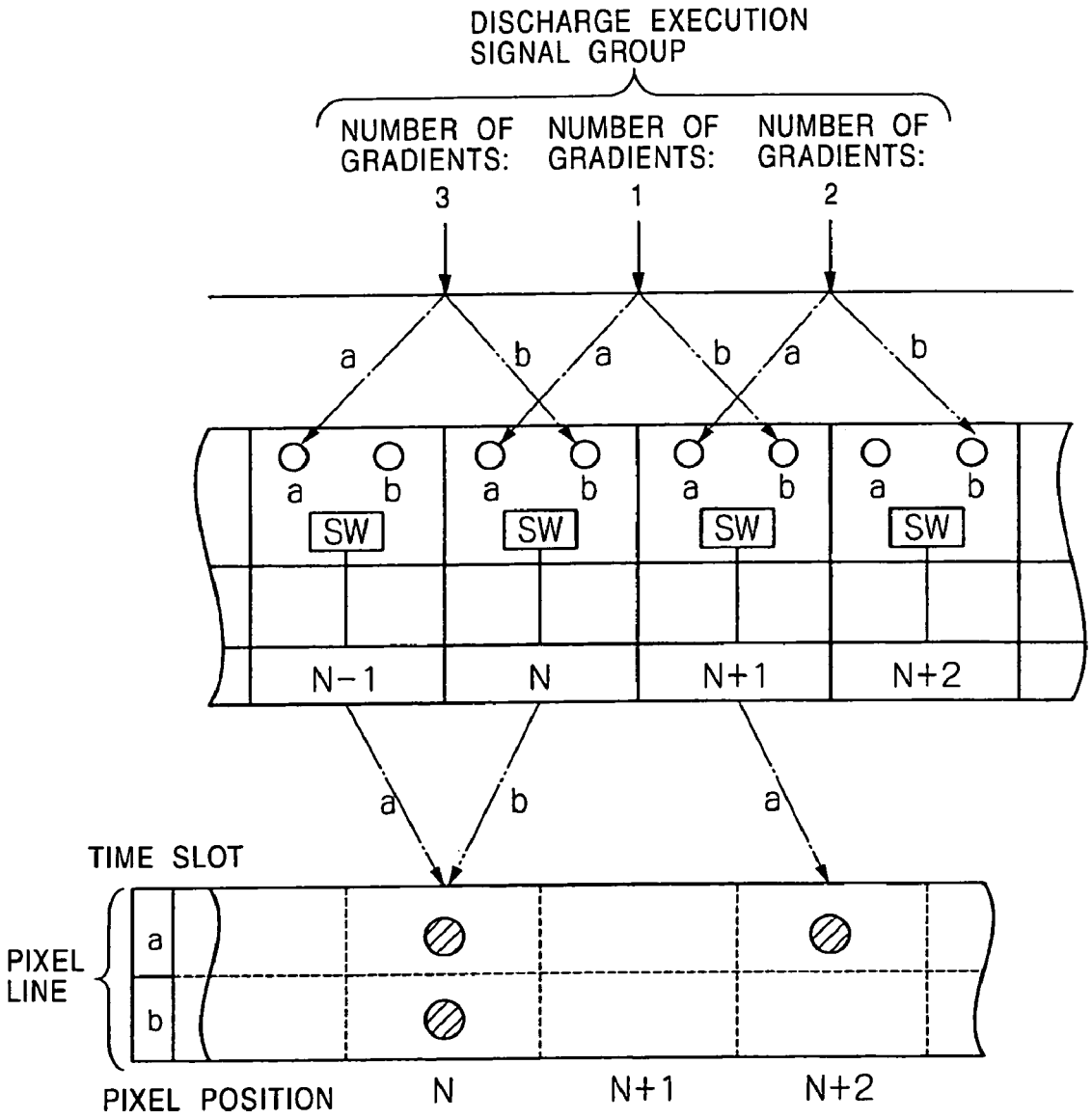
FIG. 15 is a diagram which shows a process for forming each pixel on a printing paper sheet by the liquid discharge portions according to discharge execution signals in a case of two-direction discharge (the number of discharge direction candidates is an even number)

FIG. 15 is a diagram for describing the pixel forming method (two discharge directions) according to the above-described first arrangement (an ink liquid droplet can be discharged in a direction selected from an even number of discharge direction candidates) employing the control signal with the bit number J of 1.

FIG. 15 shows a process wherein each pixel is formed on the printing paper sheet by the liquid discharge portions according to the discharge execution signals transmitted to the head 11 in parallel. The discharge execution signals correspond to the image signals.

In the example shown in FIG. 15, the tone number of the discharge execution signal for the pixel "N" is 3, the tone number of the discharge execution signal for the pixel "N+1" is 1, and the tone number of the discharge execution signal for the pixel "N+2" is 2.

The discharge signals for each pixel are transmitted to the corresponding liquid discharge portion with a cycle in the order of "discharge direction a" and "discharge direction b", and each liquid discharge portion discharges an ink liquid droplet at a timing and in a direction, corresponding to the aforementioned cycle in the order of "direction a" and "direction b". Here, the cycle of the discharge direction a and the discharge direction b corresponds to a timeslot of "a" and "b", and multiple dots corresponding to the tone number of the discharge execution signals are formed within each pixel region for each cycle of "a" and "b". For example at the cycle "a", the discharge execution signal for the pixel "N" is transmitted to the liquid discharge portion "N−1", and the discharge execution signal for the pixel "N+2" is transmitted to the liquid discharge portion "N+1".

As a result, the liquid discharge portion "N−1" discharges an ink liquid droplet in the direction a, whereby the ink liquid droplet lands at a position on the pixel "N" on the printing paper sheet. In the same way, the liquid discharge portion "N+1" discharges an ink liquid droplet in the direction a, whereby the ink liquid droplet lands at a position on the pixel "N+2" on the printing paper sheet.

Thus, an ink liquid droplet corresponding to the tone number of 2 lands at each pixel position on the printing paper sheet at a timing of the timeslot a. Now, the tone number of the discharge execution signal for the pixel "N+2" is 2, and accordingly, formation of the pixel "N+2" is completed. Furthermore, the same operation is performed for the timeslot b.

As a result, formation of the pixel "N" is completed, wherein the number (two) of the dots forming the pixel corresponds to the tone number 3 thereof.

Thus, each liquid discharge portion does not consecutively (two consecutively) discharge onto a single pixel region corresponding to a single pixel number for forming a pixel regardless of the tone number thereof, thereby reducing the influence of irregularities in the liquid discharge portions. Furthermore, this method reduces irregularities in the areas formed of the dots of the pixels, even in the event that the discharge amount of the ink liquid droplets from a part of the liquid discharge portions is small.

Furthermore, in the event that the pixel formed of one, two, or more dots on the M pixel line, and the pixel formed of one, two, or more dots on the (M+1) pixel line, are in generally the same column, for example, the system is preferably controlled such that the liquid discharge portion used for forming the pixel M, or the liquid discharge portion used for forming the first dot of the pixel M, is different from the liquid discharge portion used for forming the pixel (M+1), or the liquid discharge portion used for forming the first dot of the pixel (M+1).

Thus, in the event that each pixel is formed of one dot (two-tone image), for example, all the pixels in the same column are formed by different liquid discharge portions. Furthermore, in the event that each pixel is formed of a small number of dots, the first dots of all the pixels in the same column are formed by different liquid discharge portions.

With the conventional arrangements, all the pixels in generally the same column are formed by a single liquid discharge portion, for example, and accordingly, in the event that an ink liquid droplet is not discharged from any liquid discharge portion due to clogging or the like, all the pixels in the corresponding pixel column are not formed. On the other hand, the above-described method arrangement solves such a problem.

Furthermore, as a method arrangement other than the above-described method arrangement, an arrangement may be made wherein the liquid discharge portion is selected at random. In this case, the system is preferably controlled such that the liquid discharge portion used for forming the pixel M, or the liquid discharge portion used for forming the first dot of the pixel M, is different from the liquid discharge portion used for forming the pixel (M+1), or the liquid discharge portion used for forming the first dot of the pixel (M+1), in the same way as described above.

Figure 16:
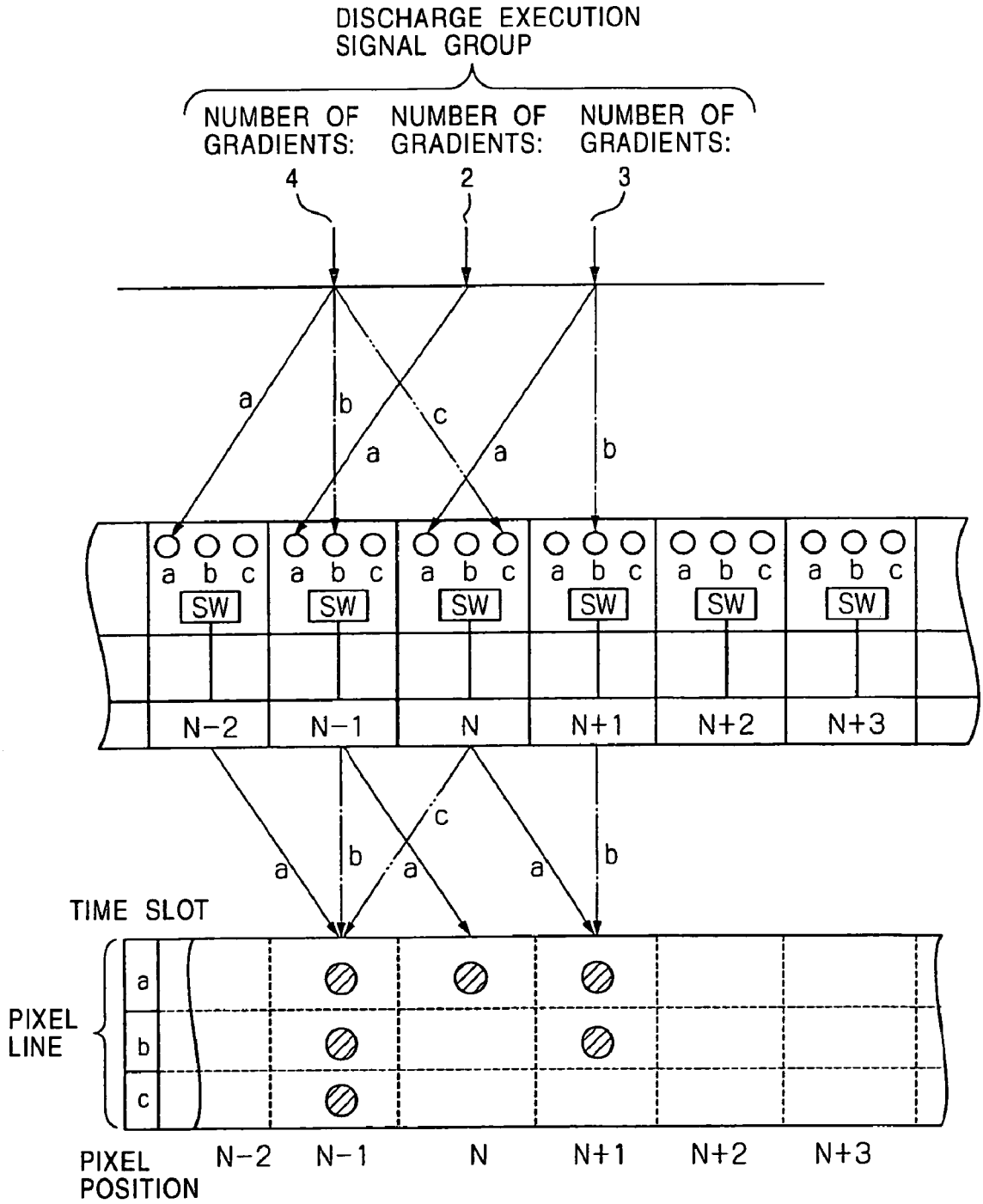
FIG. 16 is a diagram which shows a process for forming each pixel on a printing paper sheet by the liquid discharge portions according to discharge execution signals in a case of three-direction discharge (the number of discharge direction candidates is an odd number)

FIG. 16 is a diagram for describing the pixel forming method (three discharge directions) according to the above-described second arrangement (an ink liquid droplet can be discharged in a direction selected from an odd number of discharge direction candidates) employing the control signal with the bit number J of (1+1).

The pixel formation process shown in FIG. 16 is the same as in FIG. 15, so description thereof will be omitted.

With the above-second arrangement, discharge of liquid droplets can be controlled by the first discharge control means such that a single pixel column or a single pixel is formed by at least two different liquid discharge portions positioned close one to another, in the same way as with the first arrangement.

(Second Discharge Means)

Furthermore, with the present embodiment, discharge control of the ink liquid droplets is performed in the same way as with the first embodiment using the second discharge control means described below, as well as the above-described first discharge control means.

The second discharge means performs the same control as described in the first embodiment (control performed by the recording signal generating map 21, the random number generating circuit 22, and the like, in FIG. 10), wherein discharge control is performed such that the landing position of an ink liquid droplet within the corresponding pixel region is selected along the direction of an array of the nozzles 18. That is to say, the target landing position is selected from the M (M denotes an integer of 2 or more) target landing position candidates for the corresponding pixel region, for each discharge of an ink liquid droplet from the liquid discharge portion, wherein at least a part of the region of each target landing position candidate is included within the corresponding pixel region, and the target landing position candidates are arrayed in the direction of an array of the nozzles 18 (deviation direction in the present invention). Subsequently, discharge of the liquid droplet is controlled by the discharge direction varying means such that the liquid droplet lands at the selected target landing position.

Furthermore, with the present embodiment, the second discharge means selects a target landing position from the M divided target landing position candidates at random (irregularly, or without regularity) in the same way as with the first embodiment. Various methods are known wherein the target landing position is determined at random. For example, a method is known wherein a target landing position is selected from the M divided target landing position candidates at random using a random number generating circuit.

Note that in the present embodiment, let us say that an array of the M divided target landing position candidates is determined with pitch of 1/M according to the pitch of an array of the liquid discharge portions (nozzles 18).

With the second discharge control means, the ink liquid droplets are discharged such that the dots are arrayed and overlapped so as to form each pixel without occurrence of streaks or the like due to irregularities of the properties of the liquid discharge portions, whereby the irregularities in the image becomes less conspicuous, as described in the first embodiment. That is to say, an array of the landing positions of the ink liquid droplets is determined without regularity, and accordingly, the array of the ink liquid droplets (dots) exhibits a random pattern. As a result, each array of the ink liquid droplets has a random pattern, but rather overall arrays thereof follow a uniform and isotropic distribution, whereby the irregularities in the image becomes less conspicuous. This advantage has been described in the first embodiment with reference to FIGS. 7 through 9, so detailed description thereof will be omitted.

Thus, the arrangement according to the second embodiment has the advantage of reduction of the influence due to irregularities in the ink-liquid-droplet discharge properties of the liquid discharge portions, as with the first embodiment.

Furthermore, an arrangement according to the second embodiment including multiple line head 10 for discharging different color inks has the advantage of preventing deterioration of the image due to occurrence of moire, as with the first embodiment. Thus, the present embodiment is advantageous as compared to line ink jet printers, as with the first embodiment.

Furthermore, an arrangement according to the second embodiment has the advantage of reduction of drying time for the landing ink liquid droplets, as with the first embodiment.

(Third Discharge Control Means)

Furthermore, with the present embodiment, discharge control of ink liquid droplets is performed using third discharge control means described below, as well as the above-described first discharge control means and second discharge control means.

The third discharge means performs the same control as described in the first embodiment (control performed by the recording signal generating map 21, the random number generating circuit 22, and the like, in FIG. 10), wherein discharge control is performed such that the landing position of an ink liquid droplet within the corresponding pixel region is selected along the transporting direction for the printing paper sheet. That is to say, in the event that the number of liquid droplets which are to be discharged within a pixel region is equal to or greater than 1 and less than N, the target landing position is selected from the N target landing position candidates, wherein at least a part of the region of each target landing position candidate is included within the pixel region, and the target landing position candidates are arrayed within the pixel region in the direction different from the direction of an array of the nozzles 18 (deviation direction in the present invention), particularly, with the present embodiment, in the direction generally vertical to the direction of an array of the nozzles 18. Subsequently, discharge of the liquid droplet is controlled such that the liquid droplet lands at the selected target landing position. This has been described in the first embodiment, so detailed description thereof will be omitted.

Thus, with the number of the discharge command signals as N, and with the number of times of discharge as K, the probability that the same random pattern occurs for the same discharge command signals is represented by $1/{}_{N}C_{K}$.

As described above, with the second embodiment, an array of the landing positions of the ink liquid droplets exhibits a random pattern, thereby leveling power consumption for discharge, and leveling the timing of ink supply, as well as the irregularities in the image becoming less conspicuous, as with the first embodiment.

The arrangement according to the second embodiment has the advantage of leveling the amount of ink supplied from the ink channels. Furthermore, it is needless to say that with an arrangement according to the second embodiment employing both the second discharge control means and third discharge control means, the ink liquid droplets land within a wider region at random for each pixel region, thereby improving the advantages due to the landing positions of the ink liquid droplets being determined at random, as with the first embodiment.

Next, description will be made regarding a discharge control circuit serving as the above-described discharge direction varying means, first discharge control means, and second discharge control means.

Figure 17:
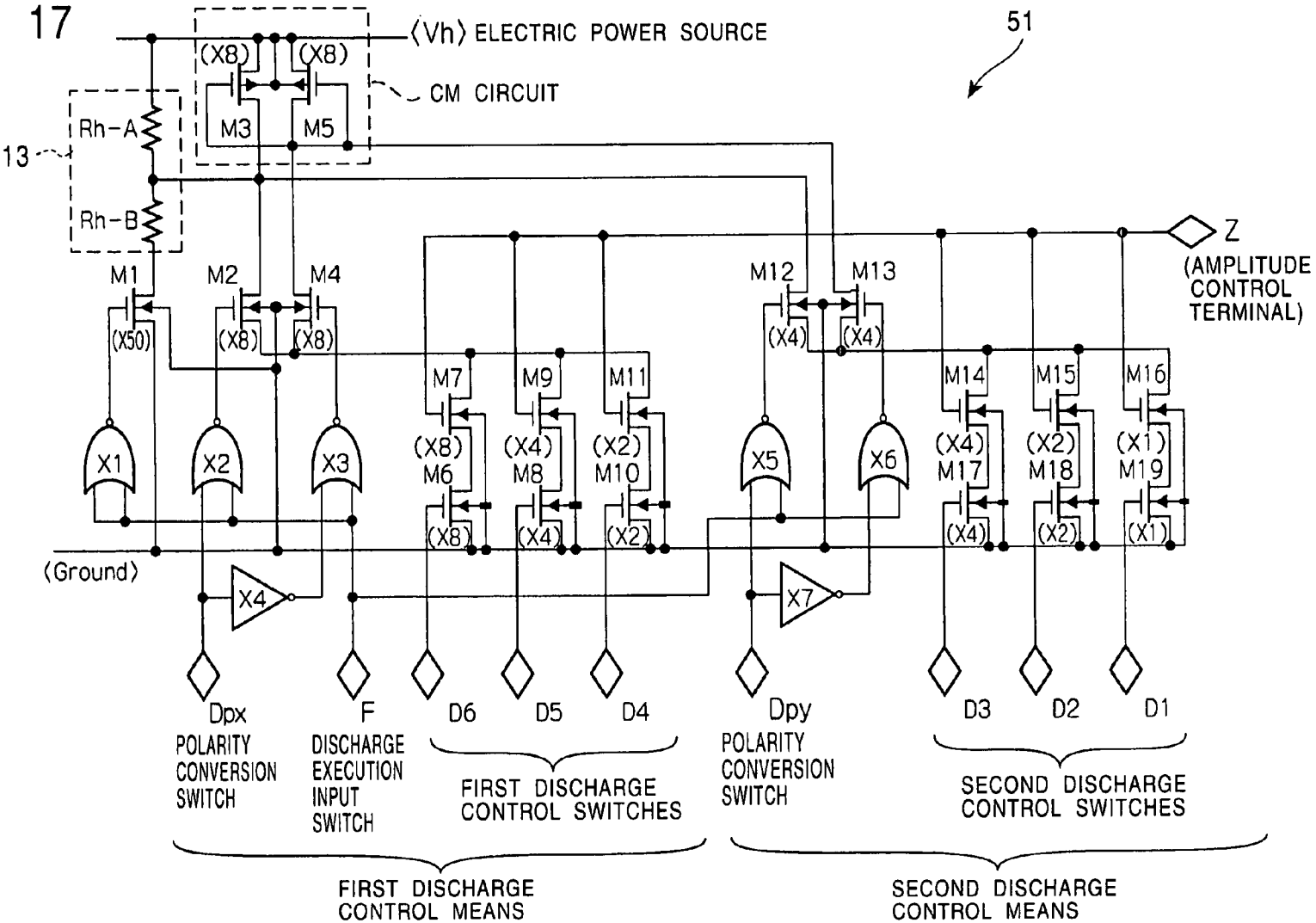
FIG. 17 is a diagram which shows a discharge direction control circuit including discharge direction varying means, first discharge control means, and second discharge control means.

FIG. 17 is a diagram which shows a discharge control circuit 51 including the discharge direction varying means, first discharge control means, and second discharge control means. The discharge control circuit 51 is a simplification of the discharge control circuit 50 in the first embodiment.

In the discharge control circuit 51, the resistors Rh-A and Rh-B, are two divided heating resistors 13 included within each ink liquid chamber 12, and are connected serially. Note that these two divided heating resistors 13 have generally the same electric resistance. Accordingly, upon applying a constant current to these serially-connected heating resistors 13, an ink liquid droplet is discharged from the nozzle 18 without deviation (in the direction of the dashed arrow shown in FIG. 4).

On the other hand, a CM circuit is connected to the node between the two serially-connected heating resistors 13. With the discharge control circuit 51, the current flowing from or to the node between the heating resistors 13 is controlled through the CM circuit so as to control the current flowing in each heating resistor 13, thereby controlling the discharge direction of the ink liquid droplet discharged from the nozzle 18 so as to select the discharge direction from multiple directions in a predetermined range along the direction of an array of the nozzles (liquid discharge portions) 18.

On the other hand, a power source Vh supplies a voltage to the resistors Rh-A and Rh-B. Furthermore, the discharge control circuit 51 includes transistors M1 through M19. Note that the reference character "×N (N=1, 2, 4, 8. or 50)" shown on the side of each transistor in the drawing denotes the number of sub-transistors connected in parallel included in an equivalent circuit corresponding to the transistor.

The transistor M1 serves as a switching device for performing on/off switching of current supply to the resistors Rh-A and Rh-B. The circuit has a configuration wherein the drain of the transistor M1 is connected to the resistor Rh-B serially, and upon the signal 0 being input to the discharge execution input switch F, the transistor M1 is turned on so as to apply a current to the resistors Rh-A and RH-B. Note that with the present embodiment, the discharge execution input switch F operates in the negative logic mode in convenience of IC layout, and accordingly, at the time of driving (only at the time of discharging ink liquid droplets), the signal of 0 is input to the discharge execution input switch F. In this case, when the signal 0 is supplied to the switch F, the input signals of an NOR-gate X1 are (0, 0), and accordingly, the NOR-gate X1 outputs 1, whereby the transistor M1 is turned on.

Note that with the present embodiment, at the time of the ink liquid droplet being discharged from the nozzle 18, the discharge execution input switch F is set to 0 (on) only during the period of 1.5 μsec (1/64) so that electric power is supplied to the resistors Rh-A and Rh-B from the power source Vh (around 9V). On the other hand, the discharge execution input switch F is set to 1 (off) during the other period of 94.5 μsec (63/64), and ink supply is performed during this period for the ink liquid chamber 12 of the ink discharge portion which has discharged an ink liquid droplet.

The polarity conversion switches Dpx and Dpy serve as switches for determining the deviation of the discharge direction of the ink liquid droplet along the direction of an array of the nozzles 18 (horizontal direction).

Furthermore, first discharge control switches D4, D5, and D6, and second discharge control switches D1, D2, and D3, serve as switches for determining the amount of deviation of the discharge direction of the ink liquid droplet.

The transistors M2, M4, M12, and M13, serve as operation amplifier (switching devices) of the CM circuit formed of the transistors M3 and M5. That is to say, the transistors M2, M4, M12, and M13, perform control of the current flowing in or from the node between the resistors Rh-A and Rh-B through the CM circuit.

Furthermore, the transistors M7, M9, M11, M14, M15, and M16, are devices serving as constant current sources for the CM circuit. The drains of the transistors M7, M9, and M11, are connected to the sources and the back-gates of the transistors M2 and M4. In the same way, the drains of the transistors M14, M15, and M16, are connected to the sources and the back-gates of the transistors M12 and M13.

Of these transistors serving as constant current source devices, the transistor M7 serves as a current source device having the current capacity "×8" (which is represented by an equivalent circuit including eight sub-transistors connected in parallel), the transistor M9 serves as a current source device having the current capacity "×4" (which is represented by an equivalent circuit including four sub-transistors connected in parallel), and the transistor M11 serves as a current source device having the current capacity "×2" (which is represented by an equivalent circuit including two sub-transistors connected in parallel). The three transistors M7, M9, and M11, are connected in parallel, and form a current source device group.

In the same way, the transistor M14 serves as a current source device having the current capacity "×4", the transistor M15 serves as a current source device having the current capacity "×2", and the transistor M16 serves as a current source device having the current capacity "×1". The three transistors M14, M15, and M16, are connected in parallel, and form a current source device group.

Furthermore, the transistors (transistors M6, M8, M10, M17, M18, and M19) having the same current capacities as with the corresponding transistor are connected to the transistors M7, M9, M11, M14, M15, and M16, respectively, which serves as current source devices. The first discharge control switches D6, D5, and D4, and the second discharge control switches D3, D2, and D1, are connected to the gates of the transistors M6, M8, M10, M17, M18, and M19, respectively.

Accordingly, for example, upon turning on the first discharge control switch D6, as well as a predetermined voltage Vx being applied between an amplitude control terminal Z and the ground, the transistor M6 is turned on, and accordingly, a current corresponding to the voltage Vx flows in the transistor M7.

As described above, on/off switching can be controlled for the transistors M6 through M11, and M14 through M19, by controlling on/off switching of the first discharge control switches D6, D5, and D4, and the second discharge control switches D3, D2, and D1.

Each of the transistors M7, M9, M11, M14, M15, and M16, are represented by equivalent circuits including a predetermined number of sub-transistors connected in parallel. Note that the number of the sub-transistors is different for each transistor, and accordingly, upon turning on the transistors, currents flow from M2 to M7, from M2 to M9, from M2 to M11, from M12 to M14, from M12 to M15, and from M12 to M16, with the ratio of the numbers denoted in parentheses on the sides of the transistors in the drawing.

In this case, the current capacities of the transistors M7, M9, and M11, are "×8", "×4", and "×2", respectively, and accordingly, the drain currents Id thereof flow with the ratio of 8:4:2. In the same way, the current capacities of the transistors M14, M15, and M16, are "×4", "×2", and "×1", respectively, and accordingly, the drain currents Id thereof flow with the ratio of 4:2:1.

Next, description will be made regarding the flow of currents only on the side of the first discharge control means in the discharge control circuit 51 (left-half in FIG. 17).

First, at the time of F=0 (ON), and Dpx=0, the input values of the NOR-gate X1 are (0, 0), and accordingly, the NOR-gate X1 outputs 1, whereby the transistor M1 is turned on. Furthermore, the input values of the NOR-gate X2 are (0, 0), and accordingly, the NOR-gate X2 outputs 1, whereby the transistor M2 is turned on. Furthermore, in the above-described case (F=0 and Dpx=0), the input values of the NOR-gate X3 are (1, 0) (one is due to F=0, the other is due to "1" from the output of NOT-gate X4 wherein Dpx=0 is input). Accordingly, the output of the NOR-gate X3 becomes 0, and the transistor M4 is turned off.

In this case, while a current flows from the transistor M3 to M2 (due to the transistor M2 being on), no current flows from the transistor M5 to M4 (due to the transistor M4 being off). Furthermore, in the event that no current flows in the transistor M5, no current flows in the transistor M3, as well, due to the nature of the CM circuit.

In this state, upon a voltage being applied from the power source Vh, no current flows in the transistors M3 and M5 due to these transistors being off, and all the current flow in the resistor Rh-A. On the other hand, the transistor M2 is turned on, the current flows from the resistor Rh-A is divided into a current flowing in the transistor M2 and a current flowing in the resistor Rh-B. In the event that all the first discharge control switches D6 through D4 are turned off, no current flows in the transistors M7, M9, and M11, and accordingly, no current flows in the transistor M2. Accordingly, all the current flowing from the resistor Rh-A flows in the resistor Rh-B. Furthermore, the current flowing from the resistor Rh-B flows in the transistor M1 which is on, following which the current is sent to the ground.

On the other hand, upon turning on at least one of the first discharge control switches D6 through D4, the transistors M6, M8, and M10, corresponding to the on-state first discharge control switches D6 through D4, are turned on, and furthermore, the transistors M7, M9, and M11, connected to the on-state transistors, are turned on.

Accordingly, in the above-described case, upon turning on the first discharge control switch D6, for example, the current flowing from the resistance Rh-A divided to currents flowing in the transistor M2 and the resistor Rh-B, whereby a part of the current flows in the transistor M2. Furthermore, the current flowing from the transistor M2 is sent to the ground through the transistors M7 and M6.

That is to say, upon setting F=0, and Dpx=0, as well as at least one of the first discharge control switches D6 through D4 being on, no current flows into the transistors M3 and M5, all the current flows in the resistor Rh-A, following which the current is divided to currents flowing in the transistor M2 and the resistor Rh-B.

Thus, the relation between the currents I flowing in the resistors Rh-A and Rh-B is represented by the following expression.

$$I(Rh\text{-}A)>I(Rh\text{-}B)$$

On the other hand, upon inputting F=0, and Dpx=1, the input values of the NOR-gate X1 are (0, 0) in the same way as described above, and accordingly, the NOR-gate X1 outputs "1", whereby the transistor M1 is turned on.

Furthermore, the input values of the NOR-gate X2 are (1, 0), and accordingly, the NOR-gate X2 outputs "0", whereby the transistor M2 is turned off. Furthermore, the input values of the NOR-gate X3 are (0, 0), and accordingly, the NOR-gate X3 outputs "1", whereby the transistor M4 is turned on. In the event that the transistor M4 is turned on, a current flows in the transistor M5, and accordingly, a current flows in the transistor M3, as well, due to the nature of the CM circuit.

Accordingly, upon a voltage being applied from the power source Vh, currents flow in the resistor Rh-A, and the transistors M3 and M5. Subsequently, all the current flowing from the resistor Rh-A flows in the resistor Rh-B (since the transistor M2 is off, and accordingly, no current flowing from the resistor Rh-A flows in the transistor M2). On the other hand, all the current flowing from the transistor M3 flows in the resistor Rh-B due to the transistor M2 being off.

Accordingly, the sum of the current flowing from the resistor Rh-A and the current flowing from the transistor M3 flows in the resistor Rh-B. As a result, the relation between the currents I flowing in the resistors Rh-A and Rh-B is represented by I(Rh-A)<I(Rh-B).

Note that while in the above-described case, the transistor M4 needs to be on so that a current flows in the transistor M5, upon inputting F=0, and Dpx=1, as described above, the transistor M4 is turned on.

Furthermore, at least one of the transistors M7, M9, and M11, is needed to be turned on so that a current flows in the transistor M4. Accordingly, there is the need to turning on at least one of the first discharge control switches D6 through D4, as well as inputting F=0, and Dpx=1, as described above. That is to say, in the event that all the first discharge control switches D6 through D4 are off, the current state under the setting of F=0, and Dpx=1, and the current state under the setting of F=0, and Dpx=0, are the same, and accordingly, all the current flowing from the resistor Rh-A flows in the resistor Rh-B. Here, the resistors Rh-A and Rh-B have generally the same resistance, and accordingly, an ink liquid droplet is discharged without deviation.

As described above, the current flowing into and from the node between the resistors Rh-A and Rh-B can be controlled by controlling on/off switching of the polarity conversion switch Dpx and the first discharge control switches D6 through D4, as well as turning on the discharge execution switch F.

Furthermore, the transistors M7, M9, and M11, serving as current source devices, have different current capacities, and accordingly, the amount of current flowing from the transistors M2 and M4 can be controlled by controlling on/off switching of the first discharge control switches D6 through D4. That is to say, the ratio of the current flowing in the resistance Rh-A as to the current flowing in the resistance Rh-B can be controlled by controlling on/off switching of the first discharge control switches D6 through D4.

With the present embodiment, the landing position of an ink liquid droplet can be controlled so as to be selected from the multiple target landing position candidates along the direction of an array of the nozzles 18 by independently performing on/off switching operation for the polarity conversion switch Dpx, and the first discharge control switches D4, D5, and D6, as well as a predetermined voltage Vx being applied between the amplitude control terminal Z and the ground.

Furthermore, the amount of deviation between the adjacent target landing position candidates can be controlled by adjusting the voltage Vx applied to the amplitude control terminal Z while maintaining the ratio of the drain currents, which can flow in the transistors M7 and M6, and M9 and M8, and M11 and M10, to the ratio of 8:4:2.

FIG. 18, consisting of FIGS. 18A and 18B, shows tables which show the relation between the on/off states of the polarity conversion switch Dpx and the first discharge control switches D6 through D4, and the landing position of a dot (ink liquid droplet) along the direction of an array of the nozzles 18.

As shown in the table of FIG. 18A, upon setting D4 to 0, both the landing position wherein (Dpx, D6, D5, D4) is set to (0, 0, 0, 0), and the landing position wherein (Dpx, D6, D5, D4) is set to (1, 0, 0, 0), match the dot landing position without deviation (directly underneath the corresponding nozzle 18). Note that description has been made regarding this relation.

As shown in the table, in a case of fixing the first discharge control switch D4 to 0, in the event that on/off switching operation is performed for the polarity conversion switch Dpx, and the first discharge control switches D6 and D5, using 3-bit signals, the dot landing position can be controlled so as to be selected from the seven target landing position candidates including the landing position without deviation. This agrees with the fact that the discharge direction can be selected from an odd number of the discharge direction candidates as shown in FIG. 14.

Note that with an arrangement wherein the first discharge control switch D4 is not fixed to 0, but is controlled to be "0" or "1", as well as the other first discharge control switches D6 and D5, the dot landing position can be controlled so as to be selected from the fifteen target landing position candidates, not from the seven target landing position candidates.

On the other hand, in a case of fixing the first discharge control switch D4 to 1, as shown in the table of FIG. 18B, the dot landing position can be selected from eight target landing position candidates which are arrayed with uniform pitch. That is to say, the dot landing position can be selected from four landing position candidates arrayed on one side from the discharge direction with deviation of zero (without deviation), and four landing position candidates arrayed on the other side, wherein an array of the former four landing position candidates and an array of the latter four landing position candidates are positioned symmetrical one to another with the axis in the discharge direction with deviation of zero therebetween.

As described above, in a case of fixing the first discharge control switch D4 to 1, the dot landing position candidates does not include the landing position directly underneath the corresponding nozzle 18 (corresponding to the discharge direction without deviation). In this case, the number of the ink-liquid-droplet discharge direction candidates is determined to be an even number, as shown in FIG. 13.

While description has been made regarding the first discharge control means, the second discharge control means can be controlled in the same way.

As shown in FIG. 17, with the second discharge control means, the transistors M12 and M13 correspond to the transistors M2 and M4 of the first discharge control means, respectively. Furthermore, the polarity conversion switch Dpy of the second discharge control means corresponds to the polarity conversion switch Dpx of the first discharge control means. Furthermore, the transistors M14 through M19, serving as current source devices of the second discharge control means correspond to the transistors M6 through M11 of the first discharge control means, respectively. Furthermore, the second discharge control switches D3, D2, and D1, of the second discharge control means correspond to the first discharge control switches D6, D5, and D4, of the first discharge control means, respectively.

On the other hand, the difference between the second discharge means and the first discharge means is the current capacities of the transistor M14 and the like, which serve as current source devices. The current capacities of the transistors M14 and the like, which serve as current source devices of the second discharge control means, are determined to be half of those of the corresponding transistors M7 and the like, which serve as current source devices of the first discharge control means. The other configuration of the second discharge control means is the same as with the first discharge control means.

Thus, the ratio of the current flowing in the resistor Rh-A as to the current flowing in the resistor Rh-B can be controlled by controlling on/off switching of the second discharge control switches D3 through D1, as well as the polarity conversion switch Dpy, in the same way as with the above-described first discharge control means.

Note that with the second discharge control means, as shown in FIG. 7, the maximal distance between the two ink-liquid-droplet landing position candidates is preferably determined as the pitch of an array (x shown in FIG. 13 or FIG. 14) of the nozzles 18 from the point of practice. Furthermore, with the second discharge control means, the variable pitch of an array of the ink-liquid-droplet landing position candidates is preferably small.

Accordingly, with the second discharge control means, switching is preferably controlled as shown in the table of FIG. 18A, from the point of practice. That is to say, with the second discharge control means, in FIGS. 18A and 18B, the polarity conversion switch Dpx corresponds to the polarity conversion switch Dpy, the first discharge control switch D6 corresponds to the second discharge control switch D3, the first discharge control switch D5 corresponds to the second discharge control switch D2, and the first discharge control switch D4 corresponds to the second discharge control switch D1. Accordingly, with the second discharge control means, switching operation is preferably controlled with the second discharge control switch D1 being fixed to 1 (note that it is needless to say that switching operation corresponding to the table of FIG. 18A may be performed).

Note that with the second discharge control means, the voltage Vx applied to the amplitude control terminal Z should be adjusted such that the maximal distance between the two ink-liquid-droplet landing position candidates is the same as the pitch of an array of the nozzles 18.

Note that the amplitude control terminal Z of the second discharge control means is the same as with the first discharge control means. Accordingly, upon determining the voltage Vx applied to the amplitude control terminal Z based upon the calculation results with regard to the second discharge control means, the ink-liquid droplet landing position candidates for the first discharge control means are determined at the same time.

Accordingly, with the present embodiment, the system is adjusted such that the ink-liquid-droplet discharge control by the first discharge control means and the ink-liquid-droplet discharge control by the second discharge control means have a predetermined relation. Accordingly, upon determining the ink-liquid-droplet discharge control (the pitch of an array of the ink-liquid-droplet landing position candidates) by the second discharge control means, the ink-liquid-droplet discharge control (the pitch of an array of the ink-liquid-droplet landing position candidates) by the first discharge control means is automatically determined, thereby providing simple control operation.

In the event that determination has been made as described above, the maximal distance between the two ink liquid droplet landing position candidates with the first discharge control means is two times as great as with the second discharge control means. The reason is as follows.

That is to say, the amount of deviation of the ink-liquid-droplet discharge direction is determined by the transistors M7, M9, and M11, for the first discharge control means, and by the transistors M14, M15, and M16, for the second discharge control means. Furthermore, with the present embodiment, the current capacities of the aforementioned transistors for the first discharge control means are set to values two times as great as with the second discharge control means.

Note that the discharge control circuit 51 shown in FIG. 17 is provided to each liquid-droplet discharge portion, and the above-described control is performed for each liquid discharge portion, or for each head 11.

Note that each transistor requires eight terminals for the drain, the source, and the like, so as to be disposed in a circuit. Accordingly, the size of the circuit configuration wherein a single large-sized transistor is disposed with eight wiring electrodes thereof is markedly smaller than the size of the circuit configuration wherein a number of small-sized transistors are disposed with eight wiring electrodes for each transistor. Accordingly, with the present embodiment, a single CM circuit including a couple of transistors having the current capacity of "×8" is formed as shown in FIG. 17, thereby reducing the total size of the discharge control circuit 50.

Thus, the discharge control circuit 50 can be disposed for each liquid discharge portion on the head 11. Note that the discharge control circuit 50 can be disposed for each liquid discharge portion on the head 11, even in a case of the head 11 having the resolution of 600 dpi (the pitch of an array of the liquid discharge portions is approximately 42.3 μm).

Figure 19:
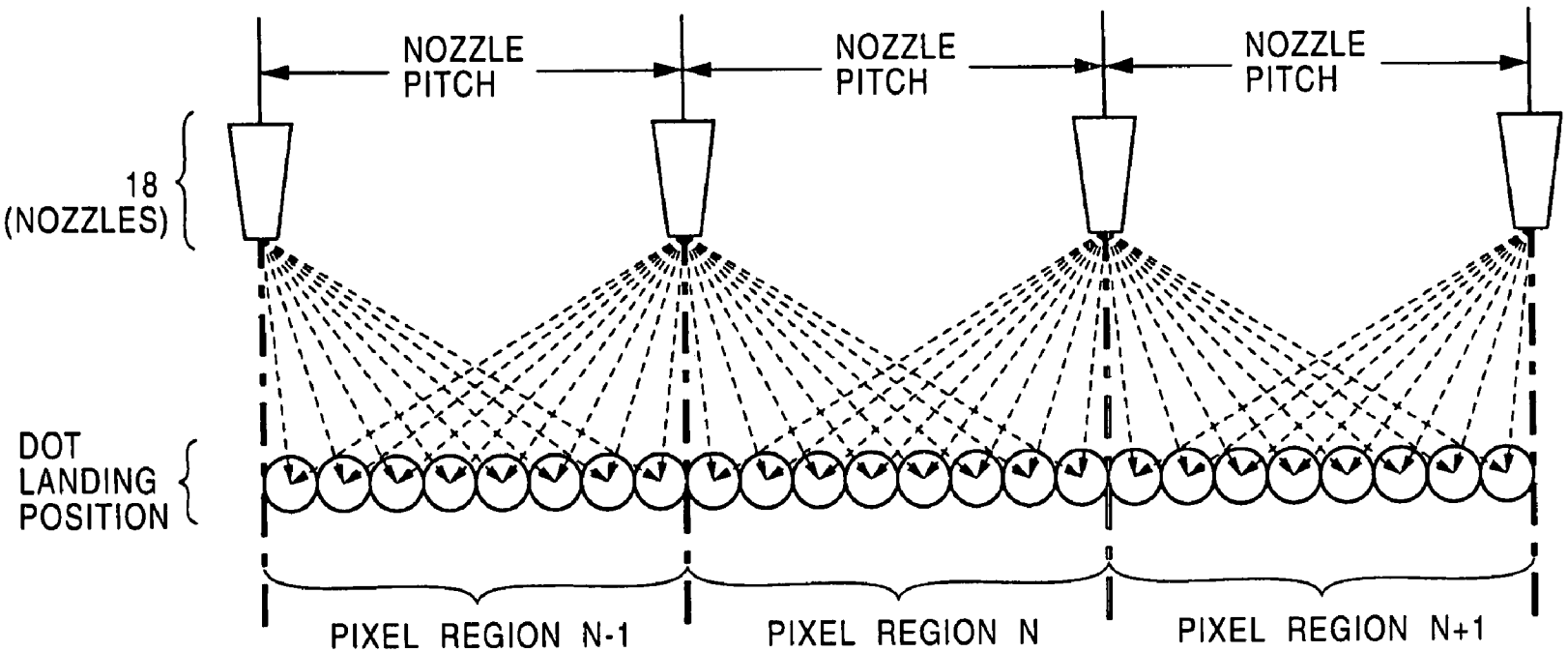
FIG. 19 shows the discharge direction candidates of an ink liquid droplet, and the distribution of the dot landing position candidates, in a case of performing control with the first discharge control means and the second discharge control means, with the number of the discharge direction candidates being an even number.
Figure 20:
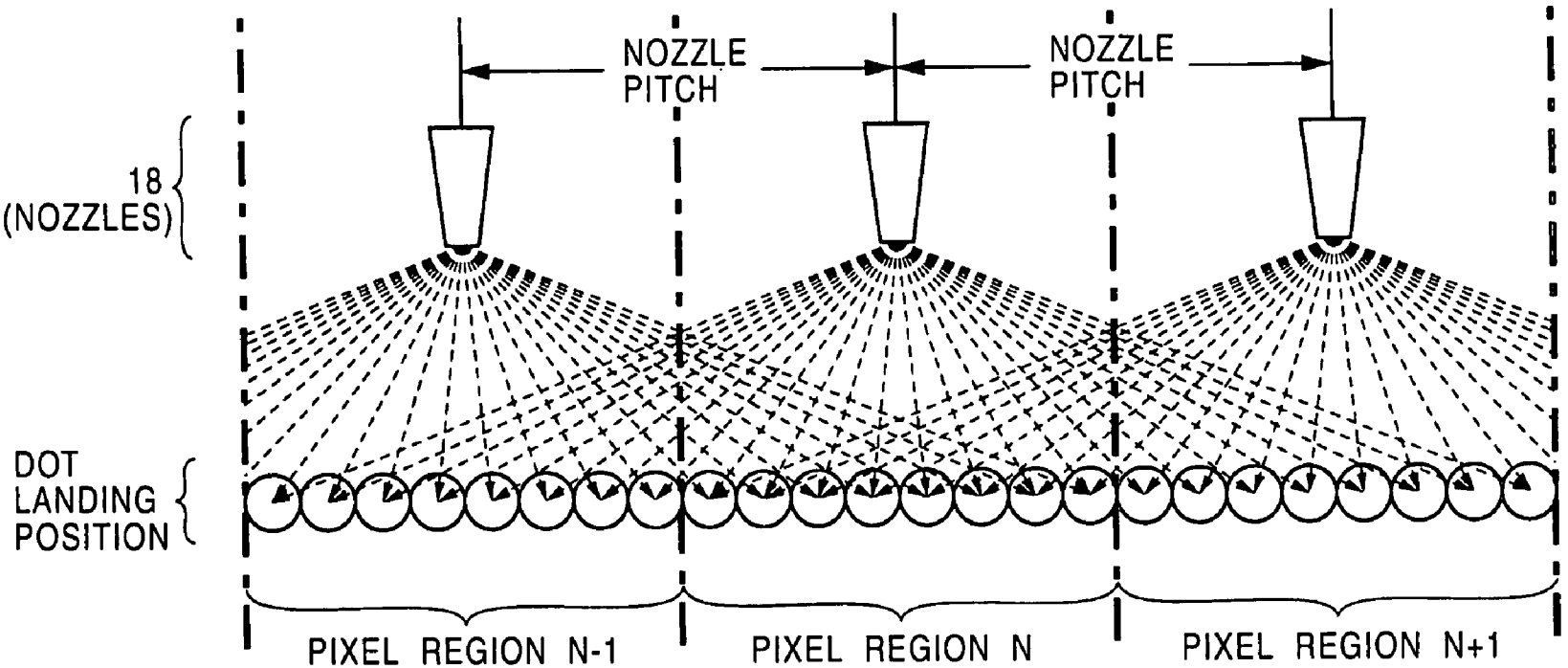
FIG. 20 shows the discharge direction candidates of an ink liquid droplet, and the distribution of the dot landing position candidates, in a case of performing control with the first discharge control means and the second discharge control means, with the number of the discharge direction candidates being an odd number.
Figure 21A:
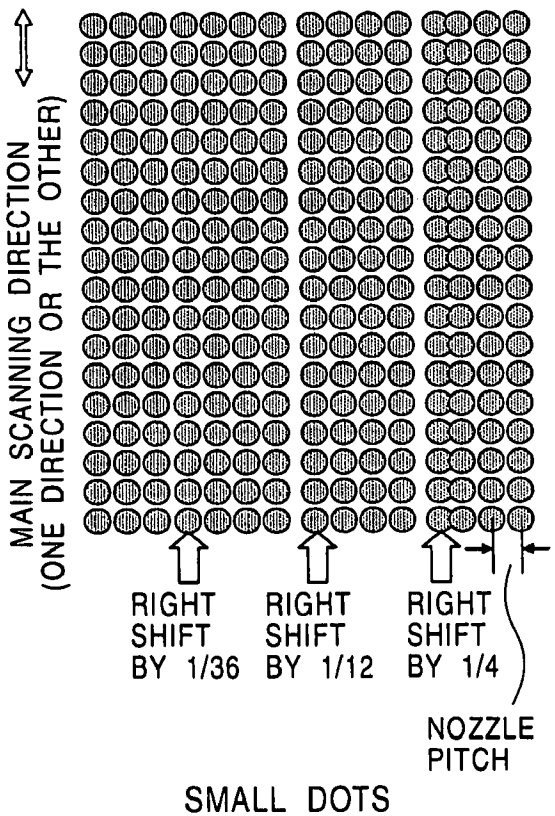
FIG. 21, consisting of FIGS. 21A, 21B, and 21C, is a diagram for describing irregularities in a dot array.
Figure 21B:
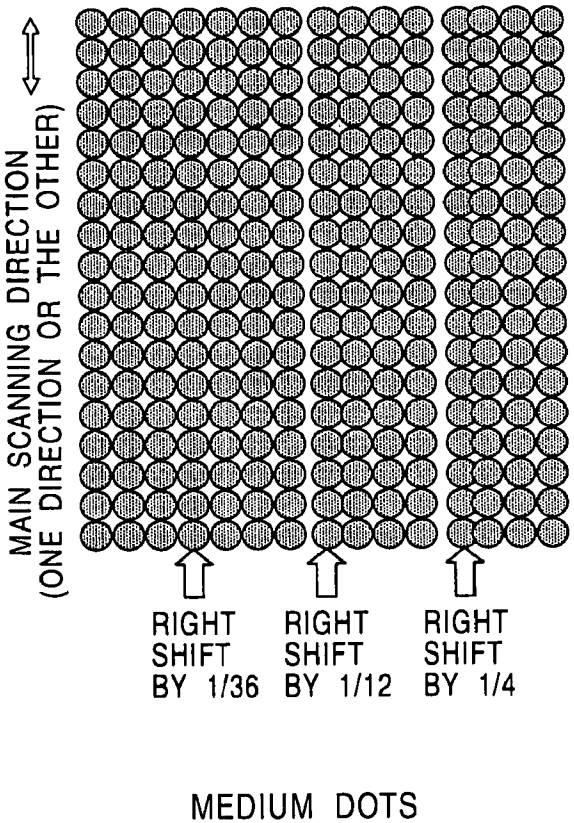
Figure 21C:
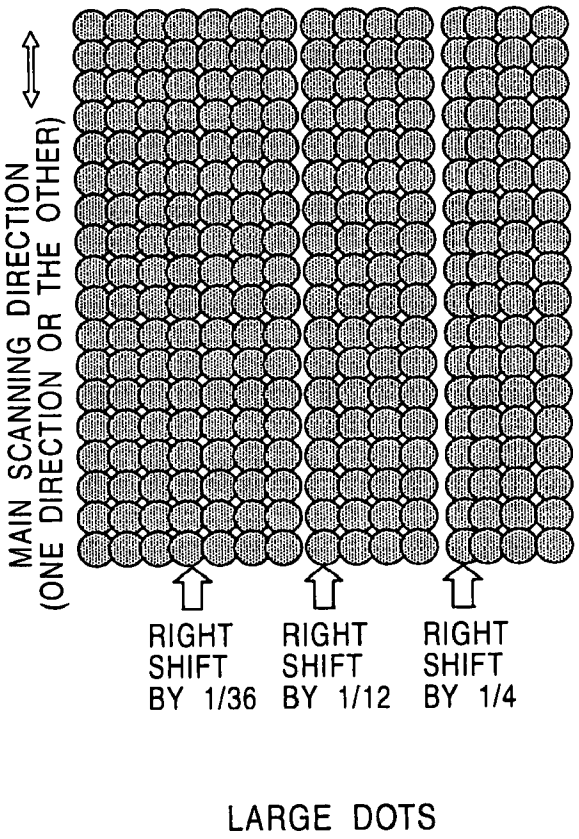
Figure 22:
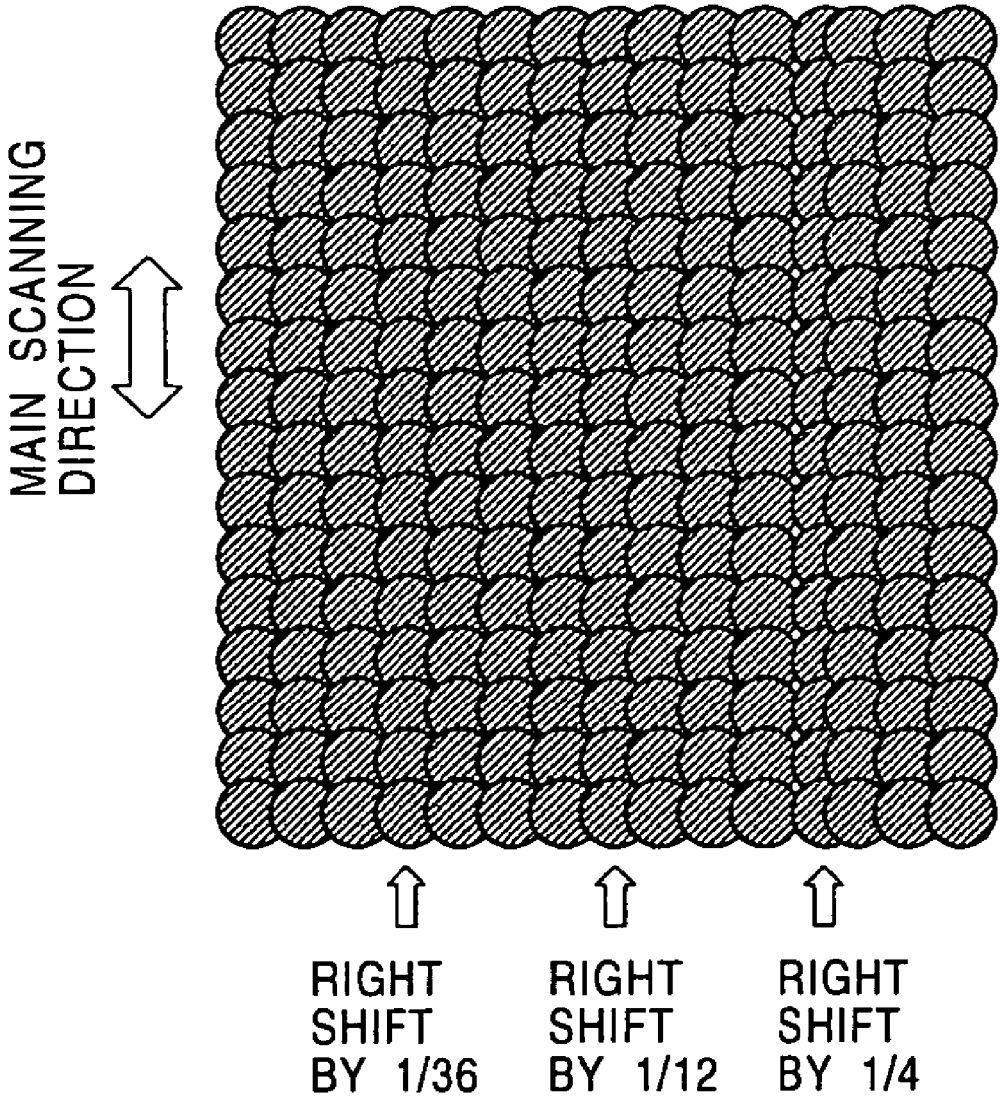
FIG. 22 is a diagram which shows an example of the printing results in a case of the same positional irregularities in a dot column as in FIG. 21, with an overall dot size a little greater than $\sqrt{2}$ times as great as the dot pitch.
Figure 23:
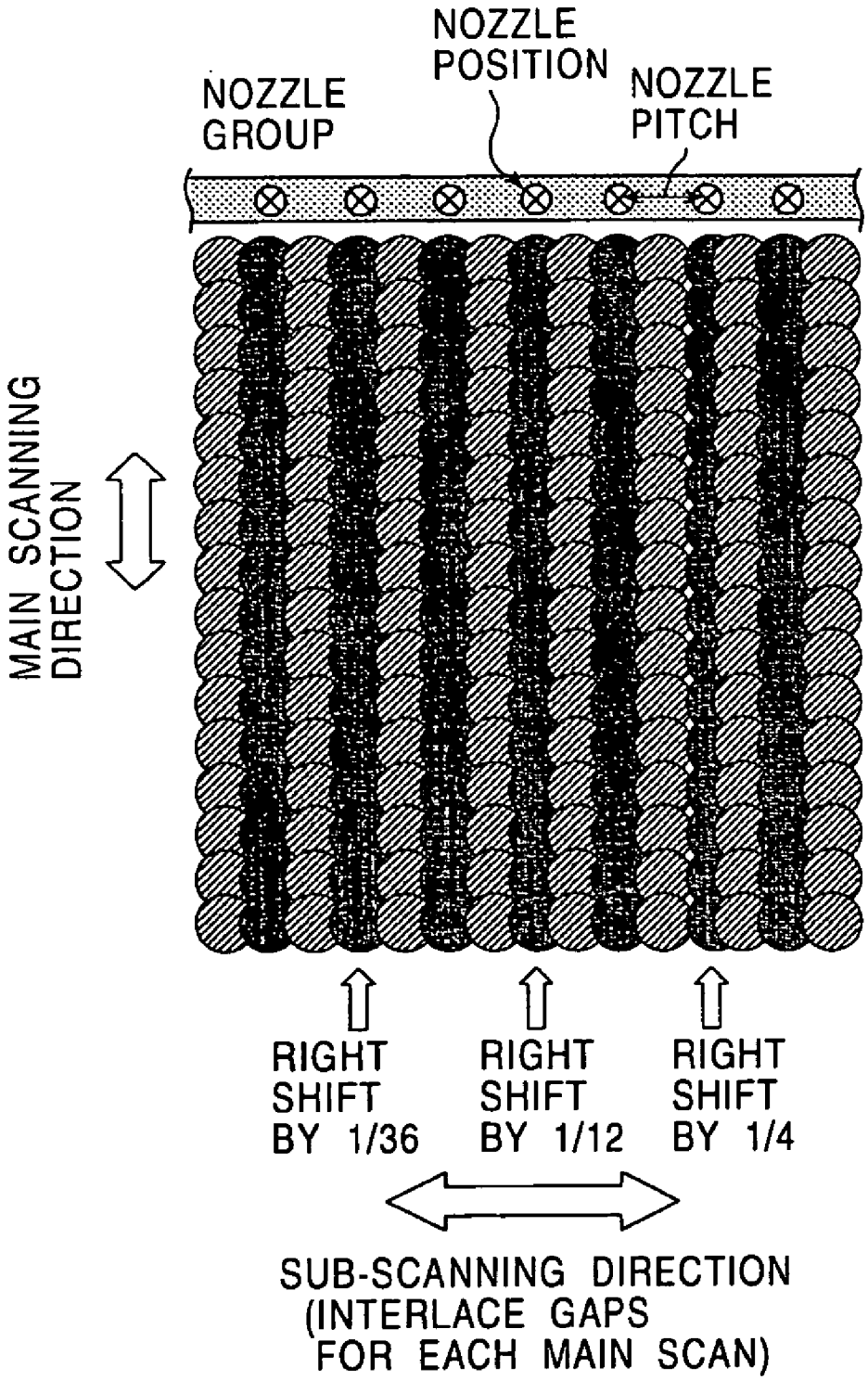
FIG. 23 is a diagram which shows printing results obtained with the double printing method.

FIGS. 19 and 20 show the discharge directions of the ink liquid droplets, and the distribution states of the dot landing positions at the time of performing discharge control by the first discharge control means and the second discharge control means.

FIG. 19 shows a case wherein the number of the ink-liquid-droplet discharge direction candidates determined by the first discharge control means is an even number, i.e., each nozzle 18 is positioned directly above the boundary between the corresponding adjacent pixel regions. FIG. 19 shows an example wherein an ink liquid droplet can be discharged with deviation of ±½ of the pixel pitch along the direction of an array of the nozzles 18 under the control by the first discharge control means. That is to say, the arrangement shown in FIG. 19 includes the second discharge control means, as well as the configuration shown in FIG. 13.

On the other hand, FIG. 20 shows a case wherein the number of the ink-liquid-droplet discharge direction candidates determined by the first discharge control means is an odd number, i.e., each nozzle 18 is positioned directly above center of the corresponding pixel region. FIG. 20 shows an example wherein an ink liquid droplet can be discharged with deviation of ±1 of the pixel pitch along the direction of an array of the nozzles 18 under the control by the first discharge control means. That is to say, the arrangement shown in FIG. 20 includes the second discharge control means, as well as the configuration shown in FIG. 14.

While description has been made regarding the second embodiment according to the present invention, the present invention is not restricted to the above-described embodiments, various modification may be made as follows.

(1) The bit number J of the control signal according to the present invention is not restricted to a particular one, rather the control signal with any bit number may be employed.

(2) With the present embodiment, two-divided heating resistors 13 are disposed in parallel, and the currents supplied to the two-divided heating resistors 13 are adjusted so as to control the difference in time requiring for boiling the ink (bubble generating time) between these two divided heating resistors. However, the present invention is not restricted to the above-described embodiment, rather an arrangement may be made wherein the timing for supplying the currents to the two-divided resistors 13 is controlled while maintaining the same supplied current to the two-divided resistors 13. For example, an arrangement may be made wherein the two-divided heating resistors include independent switches, and the timing of on/off switching of each switch is controlled so as to control the difference in bubble generation time between these two divided heating resistors 13. Furthermore, an arrangement according to the present invention may employ the combination of the above-described method wherein the currents supplied to the two-divided heating resistors 13 are adjusted, and the above-described method wherein the timing for supplying the currents to the two-divided resistors 13 is controlled.

(3) In the present embodiment, description has been made regarding the arrangement wherein each ink liquid chamber 12 includes two divided heating resistors 13 arrayed in parallel. In this case, it has been confirmed that the above-described arrangement has sufficient endurance. Furthermore, this arrangement has a simple configuration. However, an arrangement according to the present invention is not restricted to this arrangement, rather an arrangement may be made wherein each ink liquid chamber 12 includes three or more heating resistors 13 (energy generating devices) in parallel.

(4) In the present embodiment, while description has been made regarding the configuration employing the heating resistors 13 serving as energy generating devices as an example, energy generating devices using other energy generating methods, such as electrostatic-discharge energy generating devices or the piezo energy generating devices may be employed in the same way as with the first embodiment.

(5) In the present embodiment, description has been made regarding the arrangement wherein the deviation of the discharge direction of the ink liquid droplets is controlled along the direction of the array of the nozzles 18. The reason is that the two-divided heating resistors 13 are arrayed in the direction of the array of the nozzles 18. However, there is no need for the direction of the array of the nozzles 18 to completely match the deviation direction of the discharge direction of the ink liquid droplets, and an arrangement wherein these two directions generally match each other has generally the same advantages. Thus, an arrangement may be made wherein these two directions generally match each other.

(6) With the second discharge control means according to the present embodiment, while multiple ink liquid droplets are discharged so as to land at portions selected from M divided target landing position candidates at random, the number M may be any of positive integers of 2 or more, and is not restricted to a particular one employed in the present embodiment. In the same way, the number N which is the number of the landing ink liquid droplets within each pixel region along the transporting direction for the printing sheet paper (the direction generally vertical to the direction of the array of the liquid discharge portions) may be determined to any positive integer. That is to say, M may be equal to N, or M may be different from N.

Furthermore, with the present invention, the maximal number of the landing ink droplets within each pixel region is not restricted to a particular one.

(7) While with the second discharge control means according to the present embodiment, the ink liquid droplets are discharged such that the center of each landing ink liquid droplet is included within the corresponding pixel region, the present invention is not restricted to the above-described arrangement, rather an arrangement may be made wherein the ink liquid droplets are discharged such that at least a part of each landing ink liquid droplet is included within the corresponding pixel region, thereby obtaining a random dot pattern for each pixel region over a wider region than with the present embodiment.

(8) While with the second discharge control means according to the present embodiment, the target landing position of the ink liquid droplet is selected at random using a random number generating circuit, any method may be employed for selecting the target landing position of the ink liquid droplet at random, as long as the array of the selected landing positions exhibits a random dot pattern without a particular pattern. Furthermore, as methods for generating random numbers, the middle square method, the congruent method, shift-register method, and the like, are known. Furthermore, as a selecting method other than the method wherein selection is made at random, an arrangement may be made for a method wherein a combination of the multiple values is determined based upon a specified table.

While description has been made regarding the arrangements wherein the head 11 is applied to a printer, in the above-described first and second embodiment, the head 11 according to the present invention is not restricted to a printer, rather the head 11 may be applied to various kinds of liquid discharge devices. For example, the head 11 may be applied to an apparatus for discharging a DNA-containing solution for detecting biological samples.

As described above, with the present invention, liquid droplets within each pixel region are positioned at random, thereby reducing the irregularities in an array of dots (1). In particular, the line-method arrangement according to the present invention prevents occurrence of streaks between columns of dots due to irregularities in an array of the liquid discharge portions. Thus, the arrangement according to the present invention reduces deviation of the landing positions of the liquid droplets and the like due to irregularities in the properties of the liquid discharge portions, thereby forming a uniform overall dot array without a particular pattern, and thereby providing an high-quality image.

Furthermore, the arrangement according to the present invention has the advantage of reduction of the influence of irregularities in the liquid-droplet-discharge properties of the liquid discharge portions (2). That is to say, even in the event that non-discharge occurs in a part of the liquid discharge portions, the influence due to the liquid discharge portions where non-discharge occurs is reduced, whereby irregularities in an image due to the non-discharge become less conspicuous. Furthermore, the arrangement according to the present invention has the advantage of preventing occurrence of moire (3). In particular, color-printing arrangement according to the present invention has the marked advantage of preventing occurrence of moire. Furthermore, the arrangement according to the present invention has the advantage of improved tone properties due to the advantages (1) through (3).

Furthermore, with the present invention, each pixel or each pixel column can be formed using multiple different liquid discharge portions, and accordingly, the arrangement according to the present invention suppresses the influence of irregularities in the discharge amount of a liquid droplet for each pixel to a minimum, thereby preventing deterioration of image quality. Furthermore, even in the event that insufficient-discharge or non-discharge occurs in a part of the liquid discharge portions due to dusts or the like, the arrangement according to the present invention suppresses the influence thereof to a minimum. With the conventional arrangements, the occurrence of insufficient-discharge or non-discharge in a part of the liquid discharge portions of the head directly leads to malfunctioning of the head. However, the arrangement according to the present invention provides an image with image quality within a normal range, even if such malfunctioning occurs in the head.

Furthermore, the arrangement according to the present invention requires no particular back-up head for compensating for such malfunctioning. That is to say, even in the event that non-discharge occurs in a part of the liquid discharge portions, another normal liquid discharge portion near the malfunctioning discharge portion discharges an liquid droplet instead thereof.

Furthermore, with the present invention, each pixel can be formed of overlaid multiple liquid droplets without moving the head multiple times (without scanning the head multiple times), thereby improving the printing speed.

What is claimed is:

1. A liquid discharge device comprises:

a head wherein deviation of the discharge direction of a liquid droplet, discharged from a liquid discharge portion having a nozzle, can be controlled so as to be selected from a plurality of directions along a predetermined direction, wherein said liquid discharge portion comprises:

a liquid chamber for storing liquid which is to be discharged; and a plurality of energy generating devices for generating energy for discharging said liquid stored within said liquid chamber from said nozzle;

wherein said plurality of energy generating devices are arrayed within said liquid chamber in said predetermined direction;

a discharge control circuit controls the discharge direction of a liquid droplet discharged from said nozzle by controlling the difference in energy occurring between at least two of said plurality of energy generating devices within said liquid chamber, and wherein a plurality of liquid droplets are discharged so as to land on each pixel region for forming a pixel corresponding to said pixel region, and wherein a target landing position of a liquid droplet which is to be discharged on each pixel region is determined at random, and wherein the discharge direction of said liquid droplet which is to be discharged from said liquid discharge portion is controlled such that said liquid droplet lands at said determined target landing position.

2. A liquid discharge device comprises:

a head wherein deviation of the discharge direction of a liquid droplet, discharged from a liquid discharge portion having a nozzle, can be controlled so as to be selected from a plurality of directions along a predetermined direction, wherein said liquid discharge portion comprises:

a liquid chamber for storing liquid which is to be discharged; and a plurality of energy generating devices for generating energy for discharging said liquid stored within said liquid chamber from said nozzle;

wherein said plurality of energy generating devices are arrayed within said liquid chamber in said predetermined direction;

a discharge control circuit controls the discharge direction of a liquid droplet discharged from said nozzle by controlling the difference in energy occurring between at least two of said plurality of energy generating devices within said liquid chamber, and wherein a maximum of N (N denotes a positive integer) liquid droplets are discharged so as to land on each pixel region for forming a pixel corresponding to said pixel region, and wherein M (M denotes an integer of 2 or more) different landing position candidates forming an array in said predetermined direction are determined such that at least a part of the landing liquid droplet region corresponding to each landing position candidate is included within said pixel region, and wherein a target landing position of a liquid droplet is selected at random for each liquid droplet which is to be discharged from said liquid discharge portion, from an M number of said liquid landing position candidates, and wherein the discharge direction of said liquid droplet which is to be discharged from said liquid discharge portion is controlled such that said liquid droplet lands at said determined target landing position.

3. A liquid discharge device according to claim 2, wherein an N number of different landing position candidates forming an array in a direction different from said predetermined direction are determined such that at least a part of the landing liquid droplet region corresponding to each landing position candidate is included within said pixel region, and wherein in the event that the number of the liquid droplets which are to be discharged onto a pixel region is equal to or greater than 1, and is less than N, a target landing position is selected at random from said liquid landing position candidates, and wherein a liquid droplet is discharged so as to land at said determined landing position.

4. A liquid discharge device according to claim 2, wherein control of said M number of target lading position candidates is performed using multi-bit signals, and wherein said control system has a configuration wherein terminals of all said ink discharge portions for controlling the same bit are connected one to another for controlling the discharge direction of each ink discharge portion, or has a configuration wherein the discharge directions of all said ink discharge portions are controlled using the serialized signals.

5. A liquid discharge device according to claim 2, wherein said head has a configuration wherein a liquid droplet can be discharged from a liquid discharge portion so as to land on the pixel region corresponding to the target landing position in a case of discharge being performed without deviation, from another liquid discharge portion near said liquid discharge portion, and wherein in the event that two or more liquid droplets are discharged onto a pixel region, said ink liquid droplets are discharged from at least said two different liquid discharge portions positioned close one to another, and wherein at least one of said liquid discharge portions discharge a liquid droplet with deviation.

6. A liquid discharge device comprises:

a head including liquid discharge portions, each having a nozzle, wherein each of said liquid discharge portions comprises:

a liquid chamber for storing liquid which is to be discharged; and a plurality of energy generating devices for generating energy for discharging said liquid stored within said liquid chamber from said nozzle;

wherein said plurality of energy generating devices are arrayed within said liquid chamber in said predetermined direction;

a discharge control circuit controls the discharge direction of a liquid droplet discharged from said nozzle by controlling the difference in energy occurring between at least two of said plurality of energy generating devices within said liquid chamber, and wherein a maximum of N (N denotes a positive integer) liquid droplets are discharged so as to land within each pixel region while relatively moving a recording medium where said liquid droplets are to be discharged, and said head, in a predetermined direction, for forming a pixel corresponding to said pixel region, and wherein M (M denotes an integer of 2 or more) different landing position candidates forming an array in a direction generally vertical to said predetermined direction are determined such that at least a part of the landing liquid droplet region corresponding to each landing position candidate is included within said pixel region, and wherein a target landing position of a liquid droplet is selected at random for each liquid droplet which is to be discharged from said liquid discharge portion, from an M number of said liquid landing position candidates, and wherein the discharge direction of said liquid droplet which is to be discharged from said liquid discharge portion is controlled such that said liquid droplet lands at said determined target landing position, and wherein in the event that two or more liquid droplets are discharged onto a pixel region, said two or more liquid droplets are discharged so as to land on two or more positions selected from said M number of target landing position candidates while relatively moving said recording medium and said head in said predetermined direction, for forming a pixel corresponding to said pixel region.

7. A liquid discharge device comprises:

a head including a plurality of liquid discharge portions, each having a nozzle, arrayed in a predetermined direction, wherein said liquid discharge portion comprises:

a liquid chamber for storing liquid which is to be discharged; and a plurality of energy generating devices for generating energy for discharging said liquid stored within said liquid chamber from said nozzle;

wherein said plurality of energy generating devices are arrayed within said liquid chamber in said predetermined direction;

a discharge control circuit controls the discharge direction of a liquid droplet discharged from said nozzle by controlling the difference in energy occurring between at least two of said plurality of energy generating devices within said liquid chamber, and wherein a maximum of N (N denotes a positive integer) liquid droplets are discharged so as to land within each pixel region while relatively moving a recording medium where said liquid droplets are to be discharged, and said head, in a direction generally vertical to said predetermined direction, for forming a pixel corresponding to said pixel region, and wherein M (M denotes an integer of 2 or more) different landing position candidates forming an array in said predetermined direction are determined such that at least a part of the landing liquid droplet region corresponding to each landing position candidate is included within said pixel region, and wherein a target landing position of a liquid droplet is selected at random for each liquid droplet which is to be discharged from said liquid discharge portion, from an M number of said liquid landing position candidates, and wherein the discharge direction of said liquid droplet which is to be discharged from said liquid discharge portion is controlled such that said liquid droplet lands at said determined target landing position.

8. A liquid discharge device according to any of claims 2, 6, and 7, wherein said liquid discharge device includes a plurality of said heads;

and wherein different liquids are supplied to each of said heads, a plurality of droplets are discharged from said liquid discharge portions of a plurality of said heads so as to land on each pixel region for forming a pixel corresponding to said pixel region.

9. A liquid discharge method using a liquid discharge portion wherein a plurality of liquid droplets are discharged so as to land on each pixel region for forming a pixel corresponding to said pixel region, wherein a target landing position of a liquid droplet which is to be discharged on each pixel region is determined at random, and wherein the discharge direction of said liquid droplet is controlled such that said liquid droplet lands at said determined target landing position wherein said liquid discharge portion comprises:

a liquid chamber for storing liquid which is to be discharged; and a plurality of energy generating devices for generating energy for discharging said liquid stored within said liquid chamber from said nozzle;

wherein said plurality of energy generating devices are arrayed within said liquid chamber in said predetermined direction;

a discharge control circuit controls the discharge direction of a liquid droplet discharged from said nozzle by controlling the difference in energy occurring between at least two of said plurality of energy generating devices within said liquid chamber.

10. A liquid discharge method using a liquid discharge portion wherein a maximum of N (N denotes a positive integer) liquid droplets are discharged so as to land on each pixel region for forming a pixel corresponding to said pixel region, wherein said liquid discharge portion comprises:

a liquid chamber for storing liquid which is to be discharged; and a plurality of energy generating devices for generating energy for discharging said liquid stored within said liquid chamber from said nozzle;

wherein said plurality of energy generating devices are arrayed within said liquid chamber in said predetermined direction;

a discharge control circuit controls the discharge direction of a liquid droplet discharged from said nozzle by controlling the difference in energy occurring between at least two of said plurality of energy generating devices within said liquid chamber, and wherein a maximum of N (N denotes a positive integer) liquid droplets are discharged so as to land on each pixel region for forming a pixel corresponding to said pixel region, and wherein M (M denotes an integer of 2 or more) different landing position candidates forming an array in a predetermined direction are determined such that at least a part of the landing liquid droplet region corresponding to each landing position candidate is included within said pixel region, and wherein a target landing position of a liquid droplet is selected at random for each liquid droplet which is to be discharged, from an M number of said liquid landing position candidates, and wherein the discharge direction of said liquid droplet is controlled such that said liquid droplet lands at said determined target landing position.

11. A liquid discharge method using a liquid discharge portion wherein a maximum of N (N denotes a positive integer) liquid droplets are discharged so as to land within each pixel region while relatively moving a head including liquid discharge portions, each having a nozzle and a recording medium where said liquid droplets are to be discharged, in a predetermined direction, for forming a pixel corresponding to said pixel region, wherein said liquid discharge portion comprises:

a liquid chamber for storing liquid which is to be discharged; and a plurality of energy generating devices for generating energy for discharging said liquid stored within said liquid chamber from said nozzle;

wherein said plurality of energy generating devices are arrayed within said liquid chamber in said predetermined direction;

a discharge control circuit controls the discharge direction of a liquid droplet discharged from said nozzle by controlling the difference in energy occurring between at least two of said plurality of energy generating devices within said liquid chamber;

and wherein M (M denotes an integer of 2 or more) different landing position candidates forming an array in a direction generally vertical to said predetermined direction are determined such that at least a part of the landing liquid droplet region corresponding to each landing position candidate is included within said pixel region, and wherein a target landing position of a liquid droplet is selected at random for each liquid droplet which is to be discharged, from an M number of said liquid landing position candidates, and wherein the discharge direction of said liquid droplet is controlled such that said liquid droplet lands at said determined target landing position, and wherein in the event that two or more liquid droplets are discharged onto a pixel region, said two or more liquid droplets are discharged so as to land on two or more positions selected from said M number of target landing position candidates while relatively moving said recording medium and said head in said predetermined direction, for forming a pixel corresponding to said pixel region.

12. A liquid discharge method using a liquid discharge portion wherein a maximum of N (N denotes a positive integer) liquid droplets are discharged so as to land within each pixel region while relatively moving a head including a plurality of liquid discharge portions, each having a nozzle, arrayed in a predetermined direction, and a recording medium where said liquid droplets are to be discharged, in a direction generally vertical to said predetermined direction, for forming a pixel corresponding to said pixel region, wherein said liquid discharge portion comprises:

a liquid chamber for storing liquid which is to be discharged; and a plurality of energy generating devices for generating energy for discharging said liquid stored within said liquid chamber from said nozzle;

wherein said plurality of energy generating devices are arrayed within said liquid chamber in said predetermined direction;

a discharge control circuit controls the discharge direction of a liquid droplet discharged from said nozzle by controlling the difference in energy occurring between at least two of said plurality of energy generating devices within said liquid chamber, and and wherein M (M denotes an integer of 2 or more) different landing position candidates forming an array in said predetermined direction are determined such that at least a part of the landing liquid droplet region corresponding to each landing position candidate is included within said pixel region, and wherein a target landing position is selected at random for each liquid droplet which is to be discharged, from an M number of said liquid landing position candidates, and wherein the discharge direction of said liquid droplet is controlled such that said liquid droplet lands at said determined target landing position.

13. A liquid discharge device comprises:

a head including a plurality of liquid discharge portions, each having a nozzle, arrayed in a predetermined direction, wherein a plurality of liquid droplets are discharged so as to land on each pixel region for forming a pixel corresponding to said pixel region, wherein each of said liquid discharge portions comprises:

a liquid chamber for storing liquid which is to be discharged; and a plurality of energy generating devices for generating energy for discharging said liquid stored within said liquid chamber from said nozzle;

wherein said plurality of energy generating devices are arrayed within said liquid chamber in said predetermined direction;

a discharge control circuit controls the discharge direction of a liquid droplet discharged from said nozzle by controlling the difference in energy occurring between at least two of said plurality of energy generating devices within said liquid chamber, and wherein the discharge direction of a liquid droplet discharged from said nozzle of said liquid discharge portion is controlled so as to be selected from a plurality of discharge directions such that deviation of the landing position occurs in said predetermined direction, and wherein at least two different liquid discharge portions discharge liquid droplets in directions different one from another such that a plurality of liquid droplets land on said one pixel region, and wherein a target landing position of a liquid droplet which is to be discharged on a pixel region is selected from landing position candidates at random, and wherein the discharge direction of a liquid droplet which is to be discharged from said liquid discharge portion is controlled such that said liquid droplet lands at said determined target landing position.

14. A liquid discharge device comprises:

a head including a plurality of liquid discharge portions, each having a nozzle, arrayed in a predetermined direction, wherein a maximum of N (N denotes a positive integer) liquid droplets are discharged so as to land on each pixel region for forming a pixel corresponding to said pixel region, comprising:

discharge direction varying means for controlling the discharge direction of a liquid droplet discharged from said nozzle of each liquid discharge portion such that deviation of the landing position occurs in said predetermined direction;

first discharge control means for performing discharge control using said discharge direction varying means such that ink liquid droplets are discharged from at least said two different liquid discharge portions positioned close one to another, in the discharge directions different one from another, so as to land at the same pixel column or the same pixel region for forming a pixel column or a pixel; and second discharge control means for performing discharge control using said discharge direction varying means such that a landing position is selected for each liquid-droplet discharge from said liquid discharge portion, from an M (M denotes an integer of 2 or more) number of different landing position candidates forming an array in said predetermined direction, determined such that at least a part of the landing liquid droplet region corresponding to each landing position candidate is included within said pixel region, and a liquid droplet is discharged so as to land at said determined landing position, and wherein said discharge direction varying means controls the liquid-droplet discharge direction from said nozzle using control signals with the bit number of J (J denotes a positive integer) so as to select a discharge direction from an even number $2^J$ of different discharge direction candidates, and wherein the maximal distance between the landing positions corresponding to the said $2^J$ different direction candidates are determined to the value wherein the interval between the adjacent nozzles 18 is multiplied by $(2^J-1)$, and wherein said first discharge control means selects one direction from said $2^J$ different direction candidates at the time of liquid-droplet discharge from said nozzle of said liquid discharge portion.

15. A liquid discharge device according to claim 14, wherein said second discharge control means selects a landing position from said M different landing position candidates at random.

16. A liquid discharge device according to claim 14, further comprising third discharge control means for performing control of liquid-droplet discharge such that said N different landing position candidates forming an array in a direction different from said predetermined direction, are determined such that at least a part of the landing liquid droplet region corresponding to each landing position candidate is included within said pixel region, and in the event that the number of the liquid droplets which are to be discharged onto a pixel region is equal to or greater than 1, and is less than N, a target landing position is selected from said N different liquid landing position candidates, and a liquid droplet is discharged so as to land at said determined landing position.

17. A liquid discharge device according to claim 14, further comprising third discharge control means for performing control of liquid-droplet discharge such that said N different landing position candidates forming an array in a direction different from said predetermined direction, are determined such that at least a part of the landing liquid droplet region corresponding to each landing position candidate is included within said pixel region, and in the event that the number of the liquid droplets which are to be discharged onto a pixel region is equal to or greater than 1, and is less than N, a target landing position is selected at random from said N different liquid landing position candidates, and a liquid droplet is discharged so as to land at said determined landing position.

18. A liquid discharge device according to claim 14, wherein said liquid discharge portion comprises:

a liquid chamber for storing liquid which is to be discharged; and a plurality of energy generating devices for generating energy for discharging said liquid stored within said liquid chamber from said nozzle;

wherein said plurality of energy generating devices are arrayed within said liquid chamber in said predetermined direction;

and wherein said discharge direction varying means controls the discharge direction of a liquid droplet discharged from said nozzle by controlling the difference in energy occurring between at least two of said plurality of energy generating devices within said liquid chamber.

19. A liquid discharge device according to claim 14, wherein a plurality of said heads are arrayed in a particular direction so as to form a line head.

20. A liquid discharge device according to claim 14, wherein said first discharge control means and said second discharge control means are disposed on said head or a board for controlling or driving said head.

21. A liquid discharge device according to claim 14, wherein said first discharge control means determines the deviation direction and the amount of deviation, at the time of determining the discharge direction of a liquid droplet which is to be discharged from said liquid discharge portion.

22. A liquid discharge device according to claim 14, wherein the liquid-droplet discharge control by said first discharge control means and the liquid-droplet discharge control by said second discharge control means have a predetermined relation, such that upon either liquid-droplet discharge control is determined, the other liquid-droplet discharge control is automatically determined.

23. A liquid discharge device according to claim 14, wherein said discharge direction varying means controls the discharge direction of a liquid droplet so as to select a discharge direction from a plurality of discharge direction candidates symmetrical as to a line generally vertical to said predetermined direction passing through the center of nozzle.

24. A liquid discharge device comprises:

a head including a plurality of liquid discharge portions, each having a nozzle, arrayed in a predetermined direction, wherein a maximum of N (N denotes a positive integer) liquid droplets are discharged so as to land on each pixel region for forming a pixel corresponding to said pixel region, comprising:

discharge direction varying means for controlling the discharge direction of a liquid droplet discharged from said nozzle of each liquid discharge portion such that deflection of the landing position occurs in said predetermined direction;

first discharge control means for performing discharge control using said discharge direction varying means such that ink liquid droplets are discharged from at least said two different liquid discharge portions positioned close one to another, in the discharge directions different one from another, so as to land at the same pixel column or the same pixel region for forming a pixel column or a pixel; and second discharge control means for performing discharge control using said discharge direction varying means such that a landing position is selected for each liquid-droplet discharge from said liquid discharge portion, from an M (M denotes an integer of 2 or more) number of different landing position candidates forming an array in said predetermined direction, determined such that at least a part of the landing liquid droplet region corresponding to each landing position candidate is included within said pixel region, and a liquid droplet is discharged so as to land at said determined landing position, and wherein said discharge direction varying means controls the liquid-droplet discharge direction from said nozzle using control signals with the bit number of J+1 (J denotes a positive integer) so as to select a discharge direction from an odd number ($2^J$+1) of different discharge direction candidates, and wherein the maximal distance between the landing positions corresponding to the said ($2^J$+1) different direction candidates are determined to the value wherein the interval between the adjacent nozzles 18 is multiplied by $2^J$, and wherein said first discharge control means selects one direction from said ($2^J$+1) different direction candidates at the time of liquid-droplet discharge from said nozzle of said liquid discharge portion.

25. A liquid discharge method for discharging a plurality of liquid droplets so as to land on each pixel region for forming a pixel corresponding to said pixel region, using a head including a plurality of liquid discharge portions, each having a nozzle, arrayed in a predetermined direction, wherein said liquid discharge portion comprises:

a liquid chamber for storing liquid which is to be discharged; and a plurality of energy generating devices for generating energy for discharging said liquid stored within said liquid chamber from said nozzle;

wherein said plurality of energy generating devices are arrayed within said liquid chamber in said predetermined direction;

a discharge control circuit controls the discharge direction of a liquid droplet discharged from said nozzle by controlling the difference in energy occurring between at least two of said plurality of energy generating devices within said liquid chamber, and wherein the discharge direction of a liquid droplet discharged from said nozzle of said liquid discharge portion is controlled so as to be selected from a plurality of discharge directions such that deviation of the landing position occurs in said predetermined direction, and wherein at least two different liquid discharge portions discharge liquid droplets in directions different one from another such that a plurality of liquid droplets land on said one pixel region, and wherein a target landing position of a liquid droplet which is to be discharged on a pixel region is selected from landing position candidates at random, and wherein the discharge direction of a liquid droplet which is to be discharged from said liquid discharge portion is controlled such that said liquid droplet lands at said determined target landing position.

26. A liquid discharge device for discharging a maximum of N (N denotes a positive integer) liquid droplets so as to land on each pixel region for forming a pixel corresponding to said pixel region, using a head including a plurality of liquid discharge portions, each having a nozzle, arrayed in a predetermined direction, wherein the discharge direction of a liquid droplet discharged from said nozzle of each liquid discharge portion is controlled such that deviation of the landing position occurs in said predetermined direction;

and wherein discharge control is performed such that ink liquid droplets are discharged from at least said two different liquid discharge portions positioned close one to another, in the discharge directions different one from another, so as to land at the same pixel column or the same pixel region for forming a pixel column or a pixel;

and wherein discharge control is performed, using said discharge direction varying means such that a landing position is selected for each liquid-droplet discharge from said liquid discharge portion, from M (M denotes an integer of 2 or more) different landing position candidates forming an array in said predetermined direction, determined such that at least a part of the landing liquid droplet region corresponding to each landing position candidate is included within said pixel region, and a liquid droplet is discharged so as to land at said determined landing position, and wherein said discharge direction varying means controls the liquid-droplet discharge direction from said nozzle using control signals with the bit number of J+1 (J denotes a positive integer) so as to select a discharge direction from an odd number ($2^J$+1) of different discharge direction candidates, and wherein the maximal distance between the landing positions corresponding to the said ($2^J$+1) different direction candidates are determined to the value wherein the interval between the adjacent nozzles 18 is multiplied by $2^J$, and wherein said first discharge control means selects one direction from said ($2^J$+1) different direction candidates at the time of liquid-droplet discharge from said nozzle of said liquid discharge portion.

* * * * *

UNITED STATES PATENT AND TRADEMARK OFFICE

CERTIFICATE OF CORRECTION

PATENT NO. : 7,222,927 B2
APPLICATION NO. : 10/730135
DATED : May 29, 2007
INVENTOR(S) : Takeo Eguchi et al.

It is certified that error appears in the above-identified patent and that said Letters Patent is hereby corrected as shown below:

Column 50:
Line 3, Claim 13, “one from” should read -- from one --.
Line 29, Claim 14, “one from” should read -- from one --.

Column 52:
Line 18, Claim 24, “one from” should read -- from one --.

Column 53:
Line 9, Claim 25, “one from” should read -- from one --.
Line 31, Claim 26, “one from” should read -- from one --.

Signed and Sealed this

Second Day of October, 2007

JON W. DUDAS
*Director of the United States Patent and Trademark Office*